US007083906B2

(12) United States Patent
Suzuki et al.

(10) Patent No.: US 7,083,906 B2
(45) **Date of Patent: *Aug. 1, 2006**

(54) HEAT-DEVELOPABLE PHOTOSENSITIVE MATERIAL

(75) Inventors: Keiichi Suzuki, Kanagawa (JP); Hideyasu Ishibashi, Kanagawa (JP)

(73) Assignee: Fuji Photo Film Co., Ltd., Kanagawa (JP)

( * ) Notice: Subject to any disclaimer, the term of this patent is extended or adjusted under 35 U.S.C. 154(b) by 0 days.

This patent is subject to a terminal disclaimer.

(21) Appl. No.: 10/382,534

(22) Filed: Mar. 7, 2003

(65) Prior Publication Data

US 2003/0207217 A1 Nov. 6, 2003

(30) Foreign Application Priority Data

Mar. 7, 2002 (JP) ..... P. 2002-062112

(51) Int. Cl.
*G03C 1/815* (2006.01)
*G03C 1/498* (2006.01)

(52) U.S. Cl. ..... 430/510; 430/517; 430/576; 430/577; 430/580; 430/581

(58) Field of Classification Search ..... 430/510, 430/517, 619, 576, 577, 580, 581
See application file for complete search history.

(56) References Cited

U.S. PATENT DOCUMENTS

| | | | | |
|---|---|---|---|---|
| 5,416,890 | A * | 5/1995 | Beretta | 345/590 |
| 5,846,901 | A * | 12/1998 | Jubran | 503/201 |
| 5,965,333 | A * | 10/1999 | Chen et al. | 430/351 |
| 6,013,430 | A * | 1/2000 | Chen et al. | 430/584 |
| 6,060,228 | A * | 5/2000 | Suzuki | 430/522 |
| 6,174,657 | B1 | 1/2001 | Weidner et al. | |
| 6,284,442 | B1 | 9/2001 | Van Ackere et al. | |
| 6,319,661 | B1 * | 11/2001 | Shor et al. | 430/619 |
| 6,391,535 | B1 * | 5/2002 | Arimoto et al. | 430/619 |
| 6,514,677 | B1 | 2/2003 | Ramsden et al. | |
| 6,830,879 | B1 * | 12/2004 | Suzuki et al. | 430/522 |

* cited by examiner

*Primary Examiner*—Thorl Chea
(74) *Attorney, Agent, or Firm*—Sughrue Mion, PLLC

(57) ABSTRACT

A heat-developable photosensitive material having on a support at least one light-sensitive layer comprising an organic silver salt, a light-sensitive silver halide and a reducing agent and at least one light-insensitive layer, which comprises an antihalation dye causing no decoloration by heat and provides tone represented by an inequality L*≧92 on the CIELAB space in a background after heat development.

5 Claims, 1 Drawing Sheet

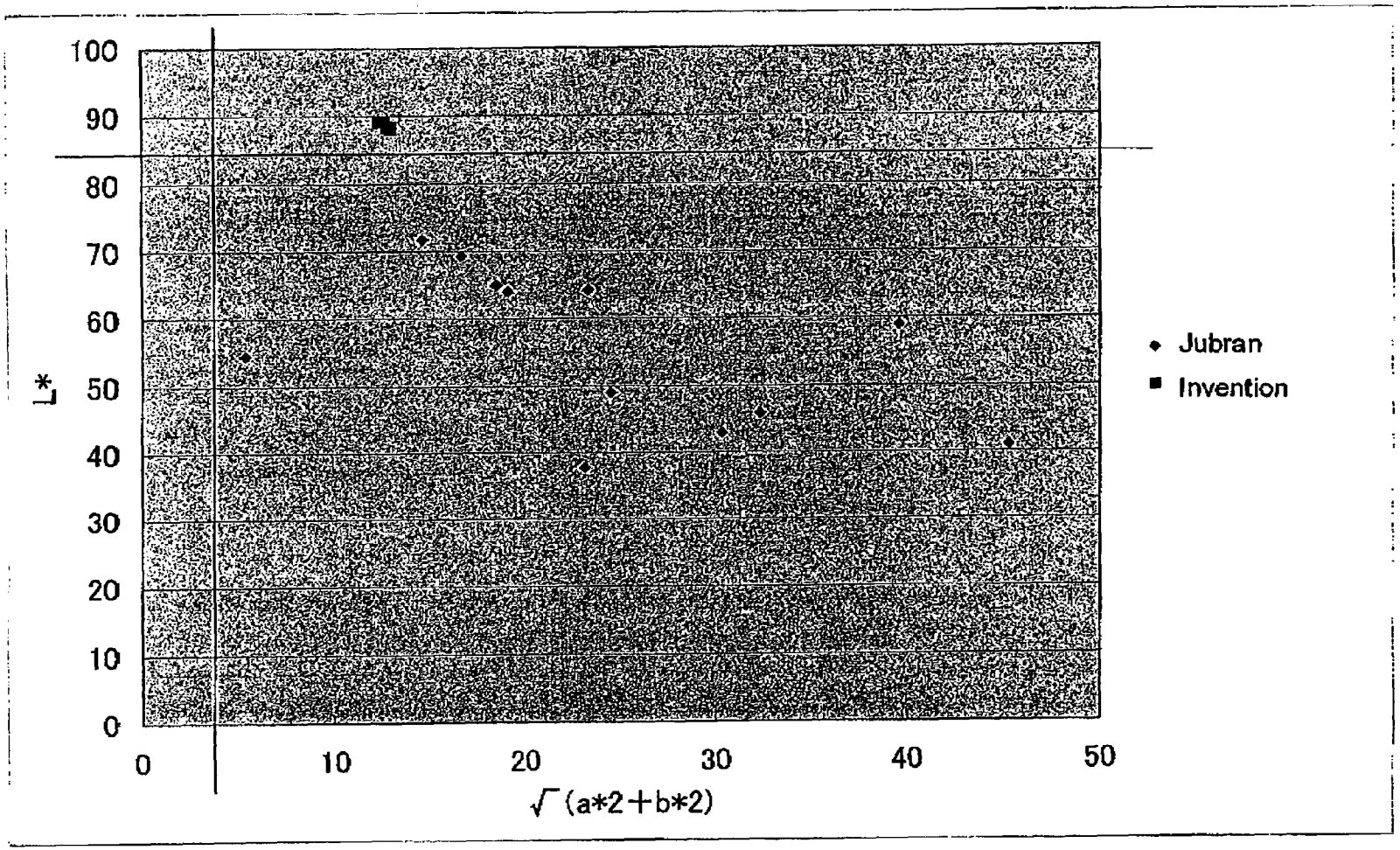
Jubran
Invention
L*
100
90
80
70
60
50
40
30
20
10
0
0
10
20
30
40
50
√(a*2+b*2)

HEAT-DEVELOPABLE PHOTOSENSITIVE MATERIAL

FIELD OF THE INVENTION

The present invention relates to a heat-developable photosensitive material, and more specifically, to a heat-developable photosensitive material capable of providing desirable tone and colored density in highlight areas after processing as well as highly sharp images.

BACKGROUND OF THE INVENTION

Heat-developable photosensitive materials have been already proposed from of old. For instance, such materials are disclosed in U.S. Pat. Nos. 3,152,904 and 3,457,075, and B. Shely, *Thermally Processed Silver Systems* in "Imaging Processes and Materials", Neblette's 8th ed., p. 2, compiled by Sturge, V. Walworth & A, Shepp (1996).

In general, a heat-developable photosensitive material has a photosensitive layer containing a catalytic amount of photocatalyst (e.g., silver halide), a reducing agent, a reducible silver salt (e.g., an organic silver salt) and a toning agent for controlling tone of silver, dispersed in a binder matrix. After imagewise exposure, the heat-developable photosensitive material is heated at a high temperature (e.g., at least 80° C.) to cause a redox reaction between the silver halide or reducible silver salt (functioning as an oxidizing agent) and the reducing agent, thereby forming black silver images. The redox reaction is accelerated by the catalytic action of latent images formed from the silver halide by exposure. Accordingly, the black silver images are formed in the exposed areas.

The heat-development processing requires no processing solutions in contrast to wet development processing, and has advantages in its simplicity and rapidity. However, methods of forming images by wet development processing constitute the mainstream in the field of photographic technology even now. And outstanding problems missing in the wet development processing remain in the heat-development processing.

One of the problems is discoloration of dyes. It is common practice to add dyes to a photographic light-sensitive material for the purposes of filter and preventing halation and irradiation from occurring. The dyes are added to light-insensitive layers, and function at the time of imagewise exposure. When the dyes remain in the photographic light-sensitive material after they have finished functioning, the images formed are colored by the remaining dyes. Accordingly, it is necessary to remove the dyes from the photographic light-sensitive material in development processing. In the wet development processing, the dyes can be easily removed from the photographic light-sensitive material by use of a processing solution. In heat-development processing, on the other hand, removal of the dyes is very difficult (or impossible in a practical sense).

In the recent photographic technology, especially in the technical fields of medical photography and graphic arts photography, simplicity and rapidity are demanded of development processing. However, improvements of wet development processing come up nearly to their limits. In the technical fields of medical photography and graphic arts photography, therefore, attention is being given again to methods of forming images by heat-development processing.

In the case of a photosensitive material to be exposed to near infrared, infrared or red lasers, dyes capable of producing sufficient e effects in preventing irradiation and halation at the wavelengths of exposure light are ordinarily incorporated into the photosensitive material for the purpose of forming images of high sharpness. In the heat-development processing, however, the removal of the dyes is difficult, so that the removal or decoloration of the dyes becomes a big problem.

The methods of decoloring dyes by heating in the heat development processing are proposed. For instance, the method of decoloring polymethine dyes of specific structure by heating is disclosed in U.S. Pat. No. 5,135,842. And the methods of decoloring polymethine dyes by heating in the presence of carbanion-producing agents are disclosed in U.S. Pat. Nos. 5,314,795, 5,324,627 and 5,384,237.

As to photosensitive materials for exposure to near infrared or infrared lasers, the photosensitive materials containing substantially no decoloring mechanisms but using dyes having the absorption maximum in the near infrared region, small half-value width and little absorption in the visible ranges are proposed, e.g., in JP-A-9-146220 and JP-A-11-228698.

As to photosensitive materials for exposure to red lasers, however, effective means are limited to adopting complex decoloring reaction mechanisms. The problem arising when the decoloring mechanisms are adopted is that dyes cannot be decolored to a sufficient extent or, on the contrary, the dyes are insufficient in stability, so that they are decolored during storage of the heat-developable photosensitive materials. In the case of using polymethine dyes, there comes up a further problem that the decomposition products of dyes remaining after decoloration have a little absorption of light and make color stains on images (particularly in highlight areas). In addition, there arises a problem that the dyes recover their colors after heat development (especially by contact with an acid), or there occurs a case where the by-products remaining after the complex reaction mechanism cause deterioration in easiness of handling of the photosensitive material after processing.

As to the case of employing no decoloring reaction mechanism, on the other hand, limitation to applications where visible images are not viewed or the method of enjoying visible images by peeling the antihalation layer away (though a waste material is multiplied) is disclosed, e.g., in JP-A-7-13294. In addition, the method of using additional coloring dyes other than dyes for antihalation is disclosed, e.g., in JP-A-2000-29164, but the highlight areas reproduced thereby do not attain to the same level as those in the images having undergone wet processing. Under the circumstances, methods capable of reaching practical utilization are not found yet. Thus, it has been desired to develop the arts of avoiding the need to employ any decoloring mechanism in photosensitive materials for exposure to red lasers.

SUMMARY OF THE INVENTION

An object of the invention is to provide a heat-developable photosensitive material by which the aforesaid pending problems are solved.

Another object of the invention is to provide a heat-developable photosensitive material for exposure to red lasers which offers sufficiently high sharpness, ensures satisfactory tone and colored density after processing and has superior handling property.

As a result of our intensive studies to attain the objects, we have found that it is important to fit a tone in highlight area of a heat-developable photosensitive material after processing into a specific region on the CIELAB space and it is possible to fit the tone into the specific region by use of a particular antihalation dye, thereby achieving the invention.

The invention provides the following heat-developable photosensitive materials (1) to (7).

(1) A heat-developable photosensitive material having on a support at least one light-sensitive layer comprising an organic silver salt, a light-sensitive silver halide and a reducing agent and at least one light-insensitive layer, which comprises an antihalation dye causing no decoloration by heat and provides tone represented by an inequality $L^* \geqq 92$ on the CIELAB space in a background after heat development.

(2) A heat-developable photosensitive material having on a support at least one light-sensitive layer comprising an organic silver salt, a light-sensitive silver halide and a reducing agent and at least one light-insensitive layer, which comprises an antihalation dye causing no decoloration by heat and provides a tone represented by inequalities $92 > L^* \geqq 85$ and $(a^*)^2+(b^*)^2 \geqq 16$ on the CIELAB space in a background after heat development.

(3) A heat-developable photosensitive material as described in (1) or (2), wherein the antihalation dye causing no decoloration by heat has an absorbance peak whose half width is 100 nm or below in its transmission absorption spectrum.

(4) A heat-developable photosensitive material as described in any one of (1) to (3), wherein the antihalation dye causing no decoloration by heat is a dye aggregate.

(5) A heat-developable photosensitive material as described in (4), wherein the dye aggregate is an aqueous fine-grain dispersion containing a hydrophilic colloid.

(6) A heat-developable photosensitive material as described in (4) or (5), wherein the dye aggregate comprises a polymethine dye.

(7) A heat-developable photosensitive material as described in (6), wherein the dye aggregate comprises a cyanine dye or an oxonol dye.

DETAILED DESCRIPTION OF THE INVENTION

In accordance with the invention, heat-developable photosensitive materials showing low absorption in highlight areas of high visibility and producing images having no problem with tint of the low-density areas from a practical point of view as well as high sharpness without substantial decoloration can be provided. In particular, the invention can offer heat-developable photosensitive materials suitable for production of medical-image output.

The invention will be described in more detail below.

In the present heat-developable photosensitive materials, the tone of the background after heat development is found in a region represented by (1) an inequality $L^* \geqq 92$ on the CIELAB space or (2) inequalities $92 > L^* \geqq 85$ and $(a^*)^2+(b^*)^2 \geqq 16$ on the CIELAB space.

The color coordinates in the L*a*b* color system are determined as follows.

To begin with, the transmission object color of the highlight area of images produced in accordance with the invention is determined according to the measurement method described in JIS Z 8722:2000. The light source for observation may be chosen from various rays of light for colorimetry so as to suit the actual conditions for observing the image. In general, the color coordinates can be worked out by use of the auxiliary standard light D50. From the object color, L*, a* and b* are determined according to the method described in JIS Z 8729:1994.

The reasons for adjusting the tone in the highlight area of the present heat-developable photosensitive material after heat development to satisfy (1) an inequality $L^* \geqq 92$ on the CIELAB space or (2) inequalities $92 > L^* \geqq 85$ and $(a^*)^2+(b^*)^2 \geqq 16$ on the CIELAB space are as follows.

The aforesaid condition (1) is suitable for the purpose of observing images that are faintly colored and highly transparent. In the cases of materials for medical-image output, the images formed are not blue-colored images ordinarily used but images providing a white background at the time of observation. As to a white color, there is a tendency to prefer psychologically the vicinity of a point represented by $a^*=0$ and $b^*=-5$. Therefore, the region on the a*–b* plane is preferably within the rectangular region corresponding to $7 \geqq a^* \geqq -7$ and $5 \geqq b^* \geqq -15$, more preferably within the rectangular region corresponding to $6 \geqq a^* \geqq -6$ and $0 \geqq b^* \geqq -10$.

The aforesaid condition (2) is suitable for the purpose of observing images that are desirably colored but highly transparent. In the cases of materials for medical-image output, the preferable region on the a*–b* plane is within the hollow circle surrounded by $324 \geqq (a^*)^2+(b^*)^2$ and $(a^*)^2+(b^*)^2 \geqq 16$. In general, medical care participants traditionally prefer a blue tone, so that the more preferable region lies within the hollow circle defined above and bounded by $0 \geqq a^*$ and $0 \geqq b^*$.

The term "antihalation dyes causing no decoloration by heat" as used in the invention is explained below.

The expression "causing no decoloration" as used herein means a case that the absorbance remaining at a maximum absorption wavelength in a state that the temperature is returned to 25° C. after heat-development processing is at least 60% of the absorbance at a maximum absorption wavelength under a temperature adjusted to 25° C. before the processing. It is preferable that there is no difference in the maximum absorption wavelength between before and after the processing. When the maximum absorption wavelength is shifted after the processing, however, the comparison is made between the absorbance at the maximum absorption wavelength before the processing and that after the processing.

From the viewpoint of absorption efficiency, it is preferable that the maximum absorption wavelength of antihalation dye used in the invention is close to a wavelength of exposure light for the present heat-developable photosensitive material, more preferably within the range from 50 nm longer to 50 nm shorter, still more preferably from 20 nm longer to 20 nm shorter, most preferably from 10 nm longer to 10 nm shorter, than the wavelength of the exposure light. As the present heat-developable photosensitive materials can fully achieve their effects when exposed to red laser, the maximum absorption wavelengths of their transmission absorption spectra lie preferably between 600 nm and 750 nm, more preferably between 600 nm and 720 nm, most preferably between 620 nm and 680 nm.

The antihalation dye suitably used in the invention preferably has in its transmission absorption spectrum the absorbance peak whose half width is 100 nm or below, more preferably 80 nm or below, still more preferably 40 nm or below, particularly preferably 25 nm or below.

Further, the antihalation dye used in the invention preferably has transmission density of 0.15 or below, more preferably 0.13 or below, still more preferably 0.10 or below, in the wavelength region from 400 nm to 600 nm before and after the heat-development processing.

It is preferable for the present heat-developable photosensitive material to have a light-insensitive layer containing the antihalation dye as defined above on a surface opposite to the photosensitive layer-coated side. In such a case, it is preferred that (1) the transmission density of the support and the total layers on the side having the antihalation dye-containing light-insensitive layer in the wavelength region from 400 nm to 600 nm is not higher than 0.15 before and after the heat-development processing, and (2) the aforesaid transmission density at the wavelength of exposure light is not lower than 0.2 before the heat-development processing. More preferably, (1) is not higher than 0.13 and (2) is not lower than 0.2, still more preferably (1) is not higher than 0.10 and (2) is not lower than 0.2.

The antihalation dye usable in the invention may be present in an aggregation state in the present heat-developable photosensitive material. The dye in an aggregation state forms a so-called J-band and exhibits a sharp peak in its absorption spectrum. Descriptions of the aggregated dye and J-band can be found in various references (e.g. *Photographic Science and Engineering*, Vol. 18, pages 323–335 (1974)). The absorption maximum of dye in a J-aggregation state shifts to the longer wavelength side than that of dye in a solution state. Accordingly, a judgement whether the dye contained in a layer is in an aggregation state or not can easily be made by absorption maximum measurement. The absorption maximum shift caused by dye aggregation is preferably at least 30 nm, more preferably at least 40 nm, most preferably at least 45 nm.

Although some of antihalation dyes can form the aggregate only by dissolution or dispersion into water, the aggregate of antihalation dye is ordinarily formed by adding gelatin or a salt (e.g., potassium chloride, sodium chloride, barium chloride, calcium chloride, ammonium chloride) to an aqueous solution of the dye. In particular, gelatin addition to an aqueous dye solution or dye addition to an aqueous gelatin solution is preferable for the formation of dye aggregation.

The dye aggregate can be also formed as solid fine particulate dispersion of dye. In order to bring dye to a solid fine particulate state, known dispersing machines can be used. Examples of the dispersing machine usable for such an operation include a ball mill, a vibrating mill, a planetary ball mill, a sand mill, a colloid mill, a jet mill and a roller mill. Vertical or horizontal medium dispersing machines (as disclosed in JP-A-52-92716 and WO 88/074794) are preferably used.

The dispersion may be performed in the presence of an appropriate medium (e.g., water, alcohol). Further, the use of surfactant is preferable for the dispersion. As to the surfactant, anionic surfactants (as disclosed in JP-A-52-92716 and WO 88/074794) are preferably used. Also, anionic polymers, nonionic surfactants or cationic surfactants may be used, if desired.

The dye may be formed into fine particulate powder by dissolving it in an appropriate solvent, and then adding thereto a poor solvent. In this case, the surfactants as mentioned above can also be used. On the other hand, the dye may be deposited as microcrystals by pH adjustment of the solution of dye. The microcrystals are also dye aggregates.

In the invention, two or more antihalation dyes may be used in the aggregation state. In such a case, two or more antihalation dyes may be brought to one aggregation state, or two or more antihalation dyes which are each in the aggregation states may be used together.

The antihalation dye used in the invention is not particularly limited, but it is preferably a polymethine dye.

The polymethine dyes can be grouped into cyanine dyes, merocyanine dyes, arylidene dyes, styryl dyes and oxonol dyes. The polymethine dyes classified in these groups are expressed in the following formulae.

Cyanine dyes: Bs=Lo–Bo

Merocyanine dyes: Bs=Le=Ak

Arylidene dyes: Ak=Lo–Ar

Styryl dyes: Bo–Le–Ar

Oxonol dyes: Ak=Lo–Ae

In the above formulae, Bs stands for a basic nucleus, Bo stands for an onium body of basic nucleus, Ak stands for a keto-form acidic nucleus, Ae stands for an enol-form acidic nucleus, Ar stands for an aromatic nucleus, Lo stands for a methine chain having an odd number of methine groups, and Le stands for a methine chain having an even number of methine groups.

Of the polymethine dyes, cyanine dyes and oxonol dyes are preferably used, and cyanine dyes are more preferably used.

The cyanine dyes preferably used in the invention include compounds represented by the following formula (I):

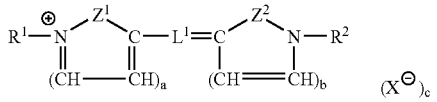

(I)

In formula (I), $Z^1$ and $Z^2$ independently represent a non-metallic atomic group for forming a 5- or 6-membered nitrogen-containing heterocyclic ring. The nitrogen-containing heterocyclic ring may be fused with a heterocyclic ring, an aromatic ring or an aliphatic ring. Examples of the nitrogen-containing heterocyclic ring and fused ring thereof include an oxazole ring, an oxazoline ring, an isoxazole ring, a benzoxazole ring, a naphthoxazole ring, a thiazole ring, a thiazoline ring, a benzothiazole ring, a naphthothiazole ring, a selenazole ring, a selenazoline ring, a benzoselenazole ring, an indolenine ring, a benzindolenine ring, an imidazole ring, an imidazoline ring, a benzimidazole ring, a naphthimidazole ring, a quinoline ring, a pyridine ring, a pyrrolopyridine ring, a furopyrrole ring, an indolizine ring, an imidazoquinoxaline ring, a quinoxaline ring, an oxadiazole ring, a thiadiazole ring, a tetrazole ring and a pyrimidine ring. Of these nitrogen-containing heterocyclic rings, the 5-membered rings are preferable to the 6-membered rings. It is more preferable that each of the 5-membered rings is fused with a benzene ring or a naphthalene ring. Of such fused rings, a benzimidazole ring, a naphthimidazole ring, a benzoxazole ring, a naphthoxazole ring, a benzothiazole ring and a naphthothiazole ring are more preferred. In particular, benzothiazole and naphthothiazole rings are preferred.

The nitrogen-containing heterocyclic rings and their fused rings may have substituents. Examples of such substituents include an alkyl group, a cycloalkyl group, an aralkyl group, analkoxygroup, an aryl group, anaryloxy group, a halogen atom (e g., Cl, Br, F), an alkoxycarbonyl group, an alkylthio group, an arylthio group, an acyl group, an acyloxy group, an amino group, a substituted amino group, an amido group, a sulfonamido group, an ureido group, a substituted ureido group, a carbamoyl group, a substituted carbamoyl group, a sulfamoyl group, a substituted sulfamoyl group, an alkylsulfonyl group, an arylsulfonyl group, a hydroxyl group, a cyano group, a nitro group, a sulfo group, a carboxyl group and a heterocyclic group. The sulfo group and the carboxyl group may be in a salt state.

The alkyl group may have a branch. The number of carbon atoms contained in the alkyl group is preferably from 1 to 20. The alkyl group may have a substituent. Examples of such a substituent include a halogen atom (e.g., Cl, Br, F), an alkoxy group (e.g.,methoxy, ethoxy), a hydroxyl group and a cyano group. Examples of the alkyl group (including substituted alkyl groups) include a methyl group, an ethyl group, a propyl group, a tert-butyl group, a hydroxyethyl group, a methoxyethyl group a cyanoethyl group and a trifluoromethyl group.

Examples of the cycloalkyl group include a cyclopentyl group and a cyclohexyl group.

The number of carbon atoms contained in the aralkyl group is preferably from 7 to 20. Examples of the aralkyl group include a benzyl group and a 2-phenetyl group.

The alkoxy group may have a branch. The number of carbon atoms contained in the alkoxy group is preferably from 1 to 12. The alkoxy group may have a substituent. Examples of such a substituent include an alkoxy group and a hydroxyl group. Examples of the alkoxy group (including substituted alkoxy groups) include a methoxy group, an ethoxy group, a methoxyethoxy group and a hydroxyethoxy group.

The aryl group is preferably a phenyl group. The aryl group may have a substituent. Examples of such a substituent include an alkyl group, an alkoxy group, a halogen atom and a nitro group. Examples of such a substituted aryl group include a p-tolyl group, a p-methoxyphenyl group, an o-chlorophenyl group and a m-nitrophenyl group.

The aryloxy group is preferably a phenoxy group. The aryloxy group may have a substituent. Examples of such a substituent include an alkyl group, an alkoxy group and a halogen atom. Examples of such a substituted aryloxy group include a p-chlorophenoxy group, a p-methylphenoxy group and an o-methoxyphenoxy group.

The number of carbon atoms in the alkoxycarbonyl group is preferably from 2 to 20. Examples of such an alkoxycarbonyl group include a methoxycarbonyl group and an ethoxycarbonyl group.

The number of carbon atoms in the alkylthio group is preferably from 1 to 12. Examples of such an alkylthio group include a methylthio group, an ethylthio group and a butylthio group.

The arylthio group is preferably a phenylthio group. The arylthio group may have a substituent. Examples of such a substituent include an alkyl group, an alkoxy group and a carboxyl group. Examples of such a substituted arylthio group include a p-methylphenylthio group, a p-methoxyphenylthio group and an o-carboxyphenylthio group.

The number of carbon atoms in the acyl group is preferably from 2 to 20. Examples of such an acyl group include an acetyl group and a butyroyl group.

The number of carbon atoms in the acyloxy group is preferably from 2 to 20. Examples of such an acyloxy group include an acetoxy group and a butyryloxy group.

The number of carbon atoms in the substituted amino group is preferably from 1 to 20. Examples of such a substituted amino group include a methylamino group, an anilino group and a triazinylamino group.

The number of carbon atoms in the amido group is preferably from 2 to 20. Examples of such an amido group include an acetamido group, a propionamido group and an isobutanamido group.

The number of carbon atoms in the sulfonamido group is preferably from 1 to 20. Examples of such a sulfonamido group include a methanesulfonamido group and a benzenesulfonamido group.

The number of carbon atoms in the substituted ureido group is preferably from 2 to 20. Examples of such a substituted ureido group include a 3-methylureido group and a 3,3-dimethylureido group.

The number of carbon atoms in the substituted carbamoyl group is preferably from 2 to 20. Examples of such a substituted carbamoyl group include a methylcarbamoyl group and a dimethylcarbamoyl group.

The number of carbon atoms in the substituted sulfamoyl group is preferably from 2 to 20. Examples of such a substituted sulfamoyl group include a dimethylsulfamoyl group and a diethylsulfamoyl group.

The number of carbon atoms in the alkylsulfonyl group is preferably from 1 to 20. Examples of such an alkylsulfonyl group include a methanesulfonyl group.

The arylsulfonyl group is preferably a benzenesulfonyl group.

Examples of the heterocyclic group include a pyridyl group and a thienyl group.

In formula (I), $R^1$ and $R^2$ independently represent an alkyl group, an alkenyl group, an aralkyl group or an aryl group. Of these groups, an alkyl group is preferred.

The alkyl group may have a branch. The number of carbon atoms in the alkyl group is preferably from 1 to 20. The alkyl group may have a substituent. Examples of such a substituent include a halogen atom (e.g., Cl, Br, F), an alkoxycarbonyl group (e.g., methoxycarbonyl, ethoxycarbonyl), a hydroxyl group, a sulfo group and a carboxyl group. The sulfo and carboxyl groups each may be in a salt state.

The alkenyl group may have a branch. The number of carbon atoms in the alkenyl group is preferably from 2 to 10. Examples of such an alkenyl group include a 2-pentenyl group, a vinyl group, an allyl group, a 2-butenyl group and a 1-propenyl group. The alkyl group may have a substituent. Examples of such a substituent include the same substituents as the alkyl group may have.

The number of carbon atoms in the aralkyl group is preferably from 7 to 12. Examples of such an aralkyl group include a benzyl group and a phenetyl group. The aralkyl group may have a substituent. Examples of such a substituent include an alkyl group (e.g., methyl, ethyl, propyl), an alkoxy group (e.g., methoxy, ethoxy), an aryloxy group (e.g., phenoxy, p-chlorophenoxy), a halogen atom (e.g., Cl, Br, F), an alkoxycarbonyl group (e.g., ethoxycarbonyl), a halogenated hydrocarbon group (e.g., trifluoromethyl), an alkylthio group (e.g., methylthio, ethylthio, butylthio), an arylthio group (e.g., phenylthio, o-carboxylphenylthio), a cyano group, a nitro group, an amino group, an alkylamino group (e.g., methylamino, ethylamino), an amido group (e.g., acetamido, propionamido), an acyloxy group (e.g., acetoxy, butyryloxy), a hydroxyl group, a sulfo group and a carboxyl group. The sulfo and carboxyl groups each may be in a salt state.

Examples of the aryl group include a phenyl group and a naphthyl group. The aryl group may have a substituent. Examples of such a substituent include the same substituents as the aralkyl group may have.

$L^1$ in formula (I) is a methine chain having an odd number of methine groups. The number of methine groups is preferably 1, 3, 5 or 7, more preferably 3 or 5, particularly preferably 3.

The methine chain may have a substituent. The methine group having a substituent is preferably a methine group situated at the center (meso-position) of the methine chain. Examples of such a substituent include an alkyl group, an alkoxy group, an aryloxy group, a halogen atom, an alkoxycarbonyl group, a halogenated hydrocarbon group, an alkylthio group, an arylthio group, a cyano group, a nitro group, an amino group, an alkylamino group, an amido group, an acyloxy group, a hydroxyl group, a sulfo group and a carboxyl group. Two substituents on the methine chain may combine with each other to form a 5-membered or 6-membered ring.

In formula (I), a, b and c independently represent 0 or 1. Both a and b are preferably 0. When the cyanine dye has an anionic substituent such as a sulfo or carboxyl group to form an inner salt, c is 0.

In formula (I), X is an anion. Examples of such an anion include a halide ion (e.g., $Cl^-$, $Br^-$, $I^-$), a p-toluenesulfonic acid ion, an ethylsulfuric acid ion, $PF_6^-$, $BF_4^-$ and $ClO_4^-$.

The oxonol dyes are preferably compounds represented by the following formula (II):

(II)

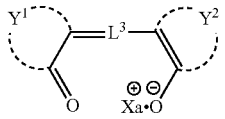

In formula (II), $Y^1$ and $Y^2$ independently represent non-metallic atomic group for forming an aliphatic or heterocyclic ring. The heterocyclic ring is preferable to the aliphatic ring. Examples of the aliphatic ring include an indanedione ring. Examples of the heterocyclic ring include a 5-pyrazolone ring, an oxazolone ring, a barbituric acid ring, a pyridone ring, a rhodanine ring, a pyrazolidinedione ring and a pyrazolopyridone ring. The aliphatic and heterocyclic rings each may have a substituent. Examples of such a substituent include the same substituents as the nitrogen-containing heterocyclic ring completed by $Z^1$ or $Z^2$ in formula (I) may have.

$L^3$ in formula (II) is a methine chain having an odd number of methine groups. The number of methine groups is preferably 3, 5 or 7, more preferably 3 or 5, particularly preferably 3. The methine chain may have a substituent. The methine group having a substituent is preferably a methine group situated at the center (meso-position) of the methine chain. Examples of such a substituent include the same substituents as $L^1$ in formula (I) may have. Two substituents on methine groups may combine with each other to form a 5-membered or 6-membered ring. However, it is preferred that the methine chain have no substituent.

Xa in formula (II) is a proton or a cation. When Xa is a proton, the oxygen atom adjacent to the proton forms a hydroxyl group. Examples of such a cation include alkali metal ion (e.g., sodium ion, potassium ion), ammonium ion, triethylammonium ion, tributylammonium ion, pyridinium ion, tetrabutylammonium ion and onium ions.

Examples of the polymethine dye preferably used in the invention are illustrated below, but these examples should not be construed as limiting the scope of the invention.

(1)–(10)

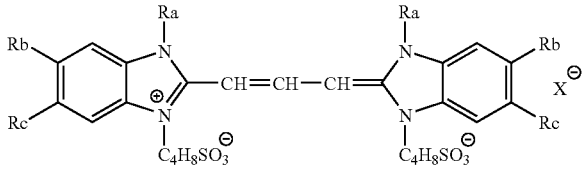

(1) Ra: —$CH_3$, Rb: —Cl, Rc: —Cl, X: Na
(2) Ra: —$CH_3$, Rb: —Cl, Rc: —$CF_3$, X: K
(3) Ra: —$CH_3$, Rb: —H, Rc: —Cl, X: K
(4) Ra: —$CH_3$, Rb: —H, Rc: —$CONH_2$, X: Na
(5) Ra: —$C_2H_5$, Rb: —Cl, Rc: —Cl, X: Na
(6) Ra: -n-$C_3H_7$, Rb: —Cl, Rc: —Cl, X: Na
(7) Ra: —$C_2H_4OC_2H_5$, Rb: —Cl, Rc: —Cl, X: Na
(8) Ra: —$C_2H_4OH$, Rb: —Cl, Rc: —Cl, X: Na
(9) Ra: —$CH_2$-Ph, Rb: —Cl, Rc: —Cl, X: K
(10) Ra: -Ph, Rb: —Cl, Rc: —Cl, X: K

Therein, Ph stands for a phenyl group.

(11)–(15)

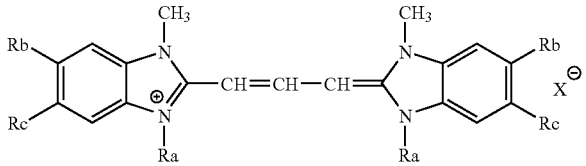

(11) Ra: —$C_2H_4SO_3^-$, Rb: —Cl, Rc: —Cl, X: K
(12) Ra; —$C_3H_6SO_3^-$, Rb: —Cl, Rc: —$CF_3$, X: Na
(13) Ra: —$CH_2CH_2CH(CH_3)SO_3$, Rb: —H, Rc: —CN, X: Na
(14) Ra: —$C_2H_4SO_3^-$, Rb: —H, Rc: —CN, X: $(C_2H_5)_3HN$
(15) Ra: —$C_4H_8SO_3^-$, Rb: —H, Rc: —CN, X: K (16)

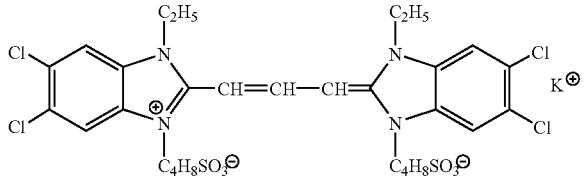

(17)

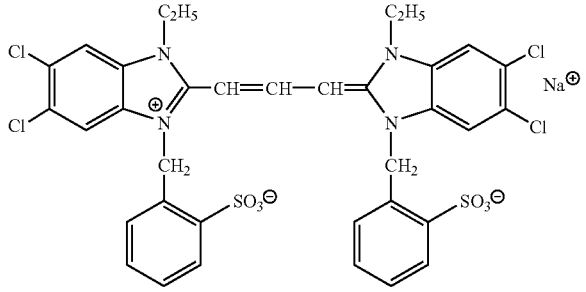

-continued (18)

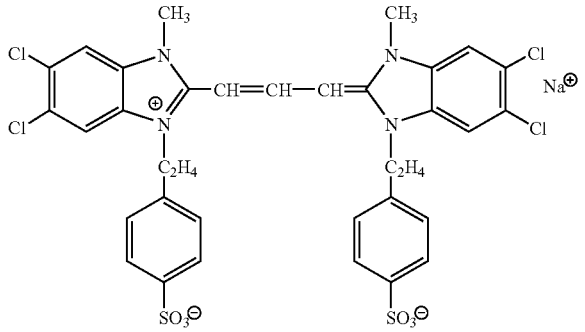

(19)-(29)

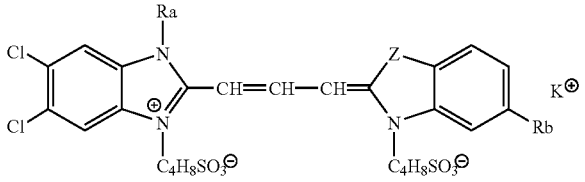

(19) Ra: —$CH_3$, Rb: -Ph, Z: —S—

(20) Ra: —$C_2H_5$, Rb: -Ph, Z: —S—(21) Ra: —$C_2H_4OCH_3$, Rb: -Ph, Z: —S—

(22) Ra: -Ph, Rb: -Ph, Z: —S—

(23) Ra: —$CH_2Ph$, Rb: -Ph, Z: —S—

(24) Ra: —$CH_3$, Rb: —Cl, Z: —S—

(25) Ra: —$CH_3$, Rb: —Cl, Z: —O—

(26) Ra: —$C_2H_5$, Rb: -Ph, Z: —O—

(27) Ra: —$C_2H_5$, Rb: —Cl, Z: —Se—

(28) Ra: —$C_2H_5$, Rb: —Cl, Z: —$C(CH_3)_2$—

(29) Ra: —$CH_3$, Rb: -Ph, Z: —Se—

Therein, Ph stands for a phenyl group.

(30)–(33)

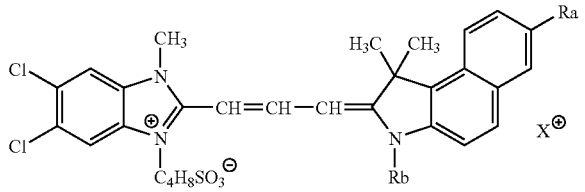

(30) Ra: —H, Rb: —$C_3H_6SO_3^-$, X: $(C_2H_5)_3NN$

(31) Ra: —$SO_3^-$, Rb: —$C_3H_6SO_3^-$, X: 2K

(32) Ra: —$SO_3^-$, Rb: —$C_3H_6SO_3^-$, X: 2Na

(33) Ra: —$SO_3^-$, Rb: —$CH_2CH_2CH(CH_3)SO_3^-$, X: 2K (34)–(41)

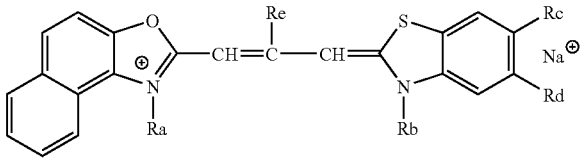

(34) Ra: —$C_3H_6SO_3^-$, Rb: —$C_3H_6SO_3^-$, Rc: —H, Rd: —Cl, Re: —$C_2H_5$

(35) Ra: —$C_4H_8SO_3^-$, Rb: —$C_4H_6SO_3^-$, Rc: —H, Rd: —Cl, Re: —$C_2H_5$

(36) Ra: —$C_2H_4SO_3^-$, Rb: —$C_4H_8SO_3^-$, Rc: —Cl, Rd: —Cl, Re: —$C_2H_5$

(37) Ra: —$C_2H_4SO_3^-$, Rb: —$C_2H_4SO_3^-$, Rc: —$CH_3$, Rd: —$CH_3$, Re: —$C_2H_5$

(38) Ra: —$C_4H_8SO_3^-$, Rb: —$C_4H_8SO_3^-$, Rc: —$CH_3$, Rd: —$CH_3$, Re: —$C_2H_5$

(39) Ra: —$C_4H_8SO_3^-$, Rb: —$C_3H_6SO_3^-$, Rc: —H, Rd: -Ph, Re: —$C_2H_5$

(40) Ra: —$C_4H_8SO_3^-$, Rb: —$C_4H_8SO_3^-$, Rc: —H, Rd: —$OCH_3$, Re: —$CH_3$

(41) Ra: —$C_4H_8SO_3^-$, Rb: —$C_4H_8SO_3^-$, Rc: —H, Rd: —$OCH_3$, Re: —$C_2H_5$

Therein, Ph stands for a phenyl group.

(42)–(44)

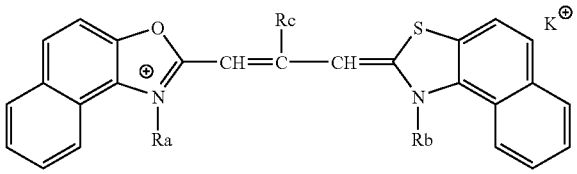

(42) Ra: —$C_3H_6SO_3^-$, Rb: —$C_3H_6SO_3^-$, Rc: —H

(43) Ra: —$C_3H_6SO_3^-$, Rb: —$C_3H_6SO_3^-$, Rc: —$CH_3$

(44) Ra: —$C_4H_8SO_3^-$, Rb: —$C_4H_8SO_3^-$, Rc: —$C_2H_5$ (45)–(47)

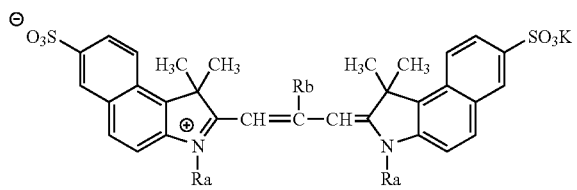

(45) Ra: —$C_4H_8SO_3K$, Rb: —H

(46) Ra: —$C_4H_8SO_3K$, Rb: —$CH_3$

(47) Ra: —$C_3H_6SO_3K$, Rb: —H (48)–(50)

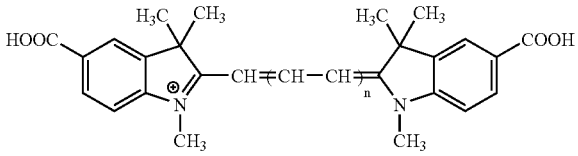

(48) n: 1

(49) n: 2

(50) n: 3

(51)–(55)
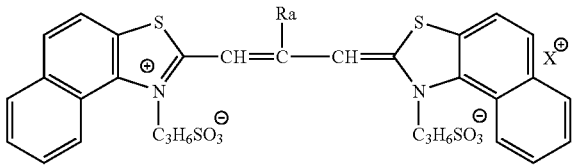
(51) Ra: —$C_2H_5$, X: $(C_2H_5)_3HN$
(52) Ra: —H, X: $(C_2H_5)_3HN$
(53) Ra: -Ph, X: Na
(54) Ra: —$CH_2Ph$, X: $(C_2H_5)_3HN$
(55) Ra: —$CH_3$, X: $(C_2H_5)_3HN$
(56)–(59)
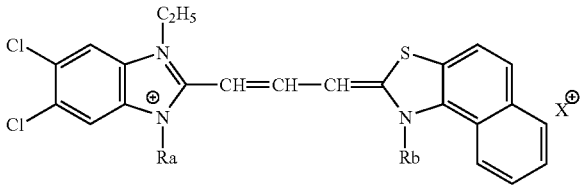
(56) Ra: —$C_2H_4SO_3^-$, Rb: —$C_3H_6SO_3^-$, X: Na
(57) Ra: —$C_4H_8SO_3^-$, Rb: —$C_4H_8SO_3^-$, X: Na
(58) Ra: —$C_2H_4SO_3^-$, Rb: —$C_2H_4SO_3^-$, X: Na
(59) Ra: —$C_3H_6SO_3^-$, Rb: —$C_3H_6SO_3^-$, X: K
(60)–(62)
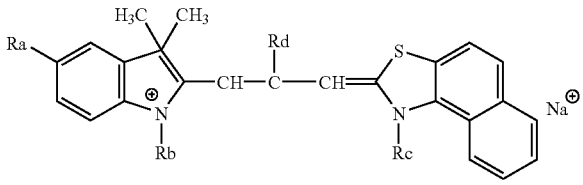
(60) Ra: —COOH, Rb: —$C_4H_8SO_3^-$, Rc: —$C_3H_6SO_3^-$, Rd: —$C_2H_5$
(61) Ra: —COOH, Rb: —$C_4H_8SO_3^-$, Rc: —$C_4H_8SO_3^-$, Rd: —H
(62) Ra: —H, Rb: —$C_3H_6SO_3^-$, Rc: —$C_3H_6SO_3^-$, Rd: —$CH_3$
(63)
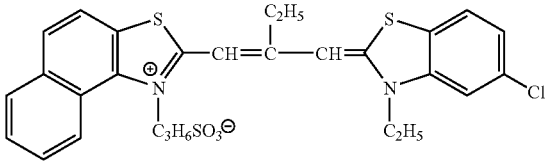
-continued
(64)
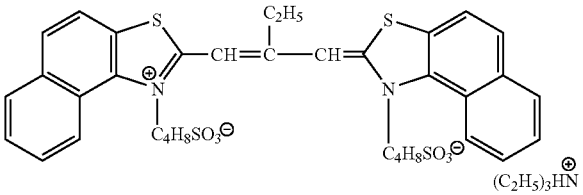
(65)
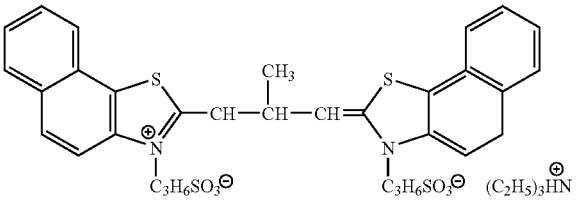
(66)
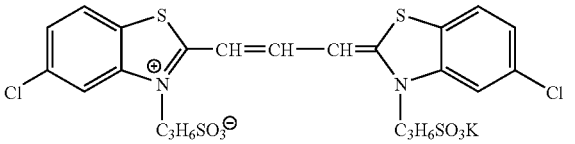
(67)
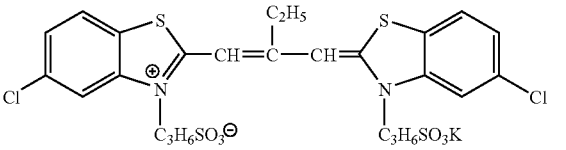
(68)
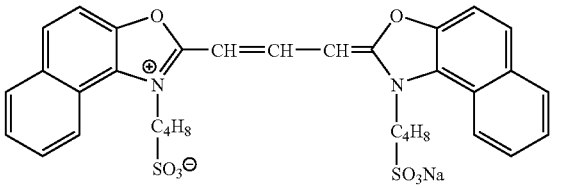
(69)
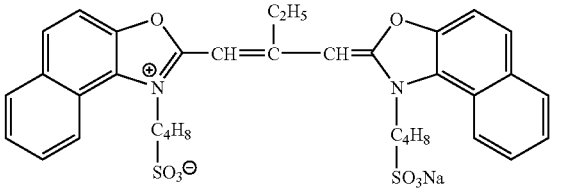
(70)
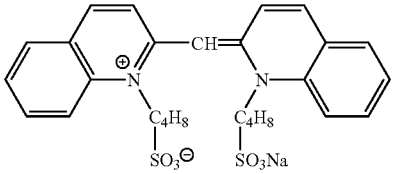

-continued (71)

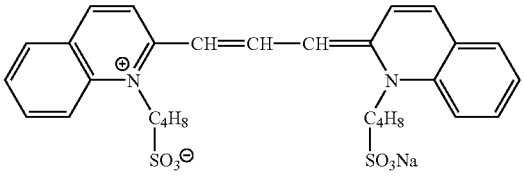

(72)

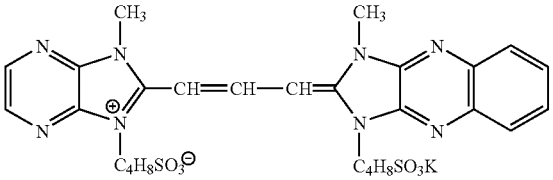

(73)

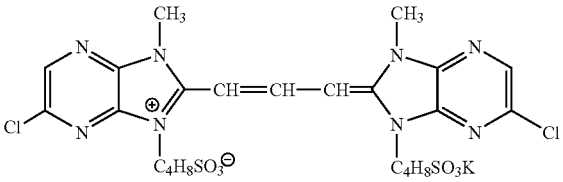

(74)

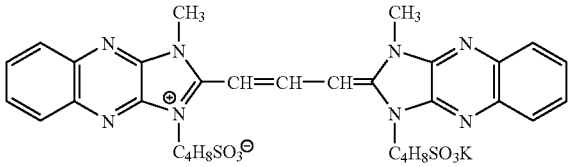

(75)-(78)

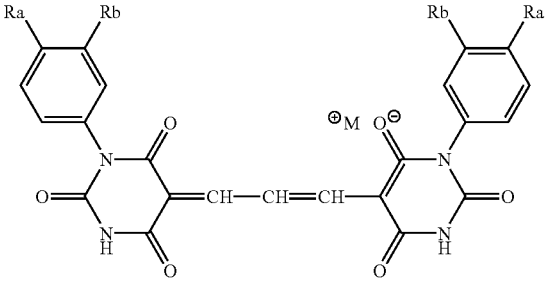

(75) Ra: —H, Rb: —H, M: H

(76) Ra: —H, Rb: —H, M: $(C_2H_5)_3HN$

(77) Ra: —OH, Rb: —H, M: $(C_2H_5)_3HN$

(78) Ra: —H, Rb: —OH, M: $(C_2H_5)_3HN$ (79)

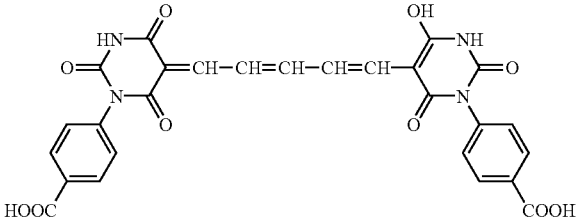

-continued (80)

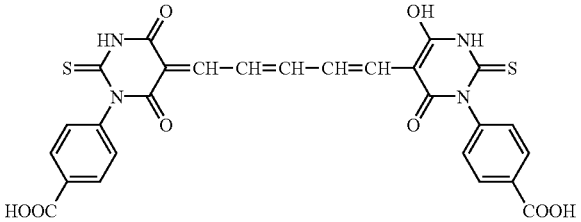

(81)

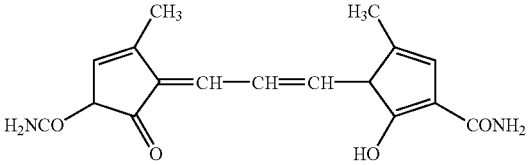

(82)

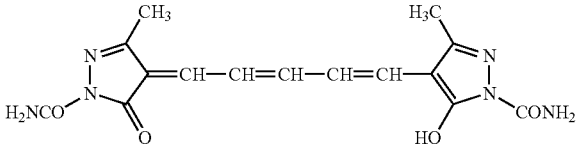

Polymethine dyes can be synthesized by reference to the descriptions in F. M. Harmer, *Heterocyclic Compounds—Cyanine Dyes and Related Compounds*, John Wiley and Sons, New York, London (1964), and JP-A-6-313939.

In general a heat-developable photosensitive material has light-insensitive layers besides light-sensitive layers. It is ordinarily preferred that the antihalation dye relating to the invention is added to at least one of light-insensitive layers provided for the present heat-developable photosensitive material and cause the light-insensitive layer to function as a filter layer or an antihalation layer. According to their location, the light-insensitive layers are classified under four groups, (1) overcoat layer provided on the light-sensitive layer (on the side distant from a support), (2) interlayer provided between adjacent light-sensitive layers, (3) subbing layer provided between the lowermost light-sensitive layer and a support and (4) backing layer provided on the side opposite to light-sensitive layers. As the layer (1) or (2), the filter layer is provided for the photosensitive material. As the layer (3) or (4), on the other hand, the antihalation layer is provided for the photosensitive material.

For addition of dye to such light-insensitive layers can be adopted a method of adding a dye solution, a dye emulsion, a solid-particulate dye dispersion or a dye-impregnated polymer to a coating composition for each light-insensitive layer. As another method which may be adopted, there is a method of using a polymer mordant for addition of a dye to a light-insensitive layer. These addition methods are similar to ordinary methods for adding dyes to heat-developable photosensitive materials. The latices usable for forming dye-impregnated polymers are described in U.S. Pat. No. 4,199,363, West German Patent Laid-Open No. 2,541,230, EP-A-029104 and JP-B-53-41091. The method of forming emulsion by adding dye to polymer solution is described in WO 88/00723.

The amount of dye added is determined according to use of the dye. In general, the dye is used in an amount providing an optical density (absorbance) greater than 0.1 as measured at the intended wavelength. The optical density is preferably from 0.2 to 2. In order to attain such an optical density, the amount of dye used is ordinarily of the order of 0.001 to 1 $g/m^2$.

In the invention, the antihalation dye may be used in combination with its carrier for the purpose of preventing its migration in the film.

The dye carrier usable in the invention refers to a substance having the meaning similar to the so-called carrier in the catalyst industry, or the substance supporting catalyst. The carrier has property of firmly carrying dye aggregate in the presence of a solvent such as water, a binder such as gelatin and a surfactant. In other words, the dye carrier can hold dye with stability, and prevention of dye migration and improvement in storage stability of dye can be expected from the presence of carrier.

As a method of ascertaining whether dye is in a carried state or not, known methods can be utilized. For instance, a dye-added composition in which a carrier is present and a dye-containing composition from which a carrier is removed are prepared, both of the compositions are centrifuged under a condition causing sedimentation of the carrier, the supernatant solutions are collected, and the dye concentrations of these solutions are compared. When the dye concentration of the supernatant solution collected from the carrier-containing composition is lower than that from the carrier-free composition, the dye is regarded as being in a carried state.

Examples of such a carrier include polymers such as latices and inorganic fine grains. Of these carriers, inorganic fine grains are preferred. Examples of the inorganic fine grains include fine grains of metals, metal chalcogenides (such as oxide, sulfides and selenides) metal nitrides and minerals predominantly composed of these materials. In these inorganic fine grains, the materials having well-known semiconductive properties are included. From the viewpoint of transparency, (1) fine grains of light-insensitive silver halide and (2) fine grains of metal chalcogenide are preferred. The following are detailed descriptions of these carriers.

(1) Light-Insensitive Silver Halide

Fine-grained light-insensitive silver halides among inorganic fine grains are explained. The expression "substantially light-insensitive" as used herein means ASA sensitivity lower than 1, preferably lower than 0.1. It is preferable for the silver halide grains to be minute in size because the specific surface area becomes greater the more minute the grains are in size; as a result, the greater amount of dye can be adsorbed to the smaller amount of grains on a silver basis. Although the lower limit of the grain size depends mainly on constrains of production, it is difficult to allow very fine grains in size to exist with stability on a stand-alone basis and, unless the Ostwald ripening is inhibited by dyes adsorbed to the grain surface, the fine grains dissolve and increase in size by recrystallization.

The sizes of fine grains can be checked by observing the fine grains in a condition that they are put on a mesh under a transmission electron microscope. The preferable magnification of the electron microscope used is from $2\times10^4$ to $4\times10^4$ times. The size of the fine grains usable in the invention is preferably in the range of 0.005 to 0.3 μm, more preferably 0.005 to 0.1 μm, still more preferably 0.005 to 0.05 μm, most preferably 0.005 to 0.03 μm, in terms of the projected area diameter.

The fine grains of light-insensitive silver halide may be regular crystals, such as crystals having a cubic, octahedral or spherical shape, or twinned crystals represented by crystals having a tabular shape, or crystals the shape of which is a mixture of the shapes as recited above. In addition, a mixture of fine grains having various crystal shapes may be used in the invention.

The fine grains of light-insensitive silver halide can be prepared using known methods. The halide composition of the grains may be any combination of halides. Specifically, the silver halide may be any of silver chloride, silver bromide, silver iodide, silver chlorobromide, silver iodobromide, silver chloroiodobromide and silver chloroiodide. From the viewpoint of strong adsorption of dye, silver iodide is preferred.

The fine grains used in the invention may be silver halide grains having a uniform composition, such as pure silver iodide, pure silver bromide or pure silver chloride grains, or mixed-crystal, core-shell or epitaxial grains having a composition of silver iodobromide, silver iodochloride or silver chlorobromide. In the case of epitaxial grains, the epitaxial part is silver iodobromide or iodochloride having a high iodide content (preferably an iodide content from 1 to 10 mole %, more preferably an iodide content from 5 to 10 mole %), or silver chlorobromide having a high bromide content (preferably a bromide content of 10 to 99 mole %)

As the present fine-grained silver halide, fine grains of silver halide prepared according to a known method are used without undergoing any chemical sensitization or after adding thereto a desensitizer, such as rhodium or pinakryptol yellow. In addition, it is also possible to use them in a state that a large amount of sensitizing dye is adsorbed to the surfaces thereof. Emulsions of internal latent image type may be used as well. Further, combined use of these known desensitizing techniques enables the fine grains to have no sensitivity in a substantial sense. This is because the dye in an adsorbed state is stabilized, and come to have a low pKa value and resists addition of proton, compared with the dye present in a solution in a free state.

Although it is ordinarily preferred that the amount of dye adsorbed to the fine grain surface is in excess of saturated coverage, the dye may be added in a less amount so long as the Ostwald ripening of the fine grains can be suppressed and sufficient antihalation effect can be produced. Further, the optimal addition amount of dye varies depending on the halide composition of the fine grains. In general, however, the amount of dye added is chosen from the range of 0.001 to 0.5 mole, preferably 0.001 to 0.05 mole, per mole of silver in the fine grains. The present fine-grained silver halide may be contained in an amount required for the antihalation, preferably in an amount of 10 mg to 1 g, more preferably 25 mg to 800 mg, particularly preferably 50 mg to 500 mg, on a silver coverage basis per $m^2$ of photosensitive material, In preparing substantially light-insensitive fine-grained silver halide used in the invention, any of known methods can be adopted, but the method useful in particular is the silver halide fine-grain emulsion preparation method disclosed in JP-A-10-43570.

(2) Fine-Grained Metal Chalcogenide

Fine-grained metal chalcogenides (such as oxide, sulfide or selenide) among inorganic fine grains include fine-grained simple or compound chalcogenides (e.g., oxides, sulfides, selenides) having in their metal parts one or more of metals such as Si, Na, K, Ca, Ba, Al, Zn, Fe, Cu, Sn, Ti, In, W, Y, Sb, Mn, Ga, V, Nb, Tu, Ag, Bi, B, Mo, Ce, Cd, Mg, Be and Pb. Examples of the metal chalcogenides include themetal oxides, such as $SiO_2$, $TiO_2$, ZnO, $SnO_2$, $MnO_2$, $Fe_2O_3$, $ZnSiO_4$, $Al_2O_3$, $BeSiO_4$, $Al_2SiO_5$, $ZrSiO_4$, $CaWO_4$, $CaSiO_3$, $InO_2$, $SnSbO_2$, $Sb_2O_5$, $Nb_2O_5$, $Y_2O_3$, $CeO_2$ and $Sb_2O_3$.

When these metal oxides are dispersed in water and form sols, the grain surfaces thereof may be treated with e.g., alumina, yttrium or cerium for the purpose of enhancing their aqueous dispersion stability.

In addition, the following fine-grained semiconductors are also preferred as inorganic fine grains. Of such semiconductors, metal chalcogenides are preferable in particular.

Examples of fine-grained semiconductors usable herein include simple semiconductors, such as silicon and germanium, III–V compound semiconductors, the metal chalcogenides as recited above (such as oxides, sulfides and selenides), and compounds of a perovskite structure (such as strontium titanate, calcium titanate, sodium titanate and potassium niobate).

Preferable examples of metal chalcogenides include oxides of titanium, tin, zinc, iron, tungsten, zirconium, hafnium, strontium, indium, cerium, yttrium, lanthanum, vanadium, niobium and tantalum, sulfides of cadmium, zinc, lead, silver, antimony and bismuth, selenides of cadmium and lead, and telluride of cadmium. Examples of compound semiconductors usable herein include phosphides of zinc, gallium, indium and cadmium, gallium arsenic selenide, copper indium selenide and copper indium sulfide.

Examples of semiconductors preferably used in the invention include Si, $TiO_2$, $SnO_2$, $Fe_2O_3$, $WO_3$, ZnO, $Nb_2O_5$, CdS, ZnS, PbS, $Bi_2S_3$, CdSe, CdTe, GaP, InP, GaAs, $CuInS_2$ and $CuInSe_2$. Of these semiconductors, $TiO_2$, ZnO, $SnO_2$, $Fe_2O_3$, $WO_3$, $Nb_2O_5$, CdS, PbS, CdSe, InP, GaAs, $CuInS_2$ and $CuInSe_2$ are more preferred. In particular, $TiO_2$ and $Nb_2O_5$ are preferably used. $TiO_2$ is most preferably used.

The semiconductors used in the invention may be single-crystal or polycrystalline semiconductors. Single-crystal semiconductors are preferred from the viewpoint of conversion efficiency, while polycrystalline semiconductors are preferred from the viewpoints of production cost, availability of raw materials and energy payback time.

The grain sizes of fine-grained semiconductors are ordinarily of the order of nm to μm. More specifically, the average grain size of primary grains is preferably from 5 to 200 nm, more preferably from 8 to 100 nm, in terms of the average diameter determined from the circles having areas equivalent to projected areas of grains. In addition, the average grain size of fine semiconductor grains in a dispersed state (secondary grains) is preferably from 0.01 to 100 μm.

A mixture of two or more fine grains differing in grain size distribution may be used. In this case, the average size of finer grains is preferably 5 nm or below. For the purpose of improving a light capture rate by scattering incident light, semiconductor grains large in diameter, e.g., those having diameters of the order of 300 nm, may be mixed.

The methods for preparation of fine-grained semiconductors include the sol-gel methods as described in Sumio Sakka, *Sol-Gel Hou no Kagaku*, Agne-Shofu-sha (1998), and *Sol-Gel Hou niyoru Hakumaku Coating Gijutu*, Gijutsu Joho Kyokai (1995), and the gel-sol methods as described in Tadao Sugimoto, "Shin-Goseiho Gel-Sol Hou niyoru Tanbunsan Ryushi no Gosei to Size Keitai Seigyo" in *Materia*, vol. 35, No. 9, pp. 1012–1018 (1996). In addition, the method developed by Degussa AG wherein oxides are prepared by high-temperature hydrolysis of chlorides in oxyhydrogen flame is also suitable.

When the fine-grained semiconductor is titanium dioxide, all of the sol-gel method, the gel-sol method and the high-temperature hydrolysis of the chloride in oxyhydrogen flame are preferably adopted. In addition, the sulfuric acid process and the chlorine process described in Manabu Kiyono, *Sanka Titan Bussei to Oyo Gijutu*, Gihodo Shuppan (1997) can also be used. As other sol-gel methods, the method described in Barbe et al., *Journal of American Ceramic Society*, vol. 80, No. 12, pp. 3157–3171(1997), and the method described in Burnside et al., *Chemistry of Materials*, vol. 10, No. 9, pp. 2419–2425 are also preferably used.

(3) Others

The fine-grained metals among inorganic fine grains have no particular restriction on their kinds, but transition metals are preferable. Of the transition metals, the metals belonging to groups 1B, 2B, 5B, 6B, 7B, 8, 3A, and 4A on and after the fourth period are preferred. In particular, silver, gold, palladium, indium, lead, bismuth and titanium are preferable.

As the carriers other than fine-grained metals, metal nitrides and minerals can also be used in addition to the fine-grained semiconductors including the metal chalcogenides (such as oxides, sulfides and selenides).

Examples of usable minerals include clay minerals, such as bentonite, hectorite and montmorillonite, synthetic mica and synthetic smectite. The inorganic laminar compounds each have a layer structure made up of unit crystal lattice layers having a thickness of 10 to 15 angstroms, and they have much greater number of intra-lattice metal atom substitutions than other clay minerals. As a result, the lattice layers cause positive charge shortages and, in order to compensate for the shortages, cations such as $Na^+$, $Ca^{2+}$ or $Mg^{2+}$ are held between layers by adsorption. The cations present between layers are referred to as exchangeable cations and can be exchanged for various cations.

Examples of synthetic mica include Na tetrasilic mica $NaMg_{2.5}(Si_4O_{10})F_2$, Na or Li teniorite $(NaLi)Mg_2Li(Si_4O_{10})F_2$, and Na or Li hectorite $(NaLi)_{1/3}Mg_{2/3}Li_{1/3}(Si_4O_{10})F_2$. As to the size of synthetic mica, preferable thickness is from 1 to 50 nm and preferable plane size is from 1 to 20 μm. The thinner the thickness and the larger the surface size within a range that no deterioration in smoothness of the coating surface and the transparency is caused thereby, the more successful the diffusion control becomes. Therefore, the aspect ratio is at least 100, preferably at least 200, particularly preferably at least 500.

The fine-grained metals and metal oxide usable in the invention have no particular restrictions as to their preparation methods. They can be prepared by a sol-gel method or from a solution by utilizing reduction. In addition, they can also be prepared by being ground physically with a dispersing machine. Further, they can be prepared by peeling a film formed by evaporation away from a substrate and dispersing the film. For preparation by a sol-gel method, the methods described in Sumio Sakka, *Sol-Gel Hou no Oyo-Hikari, Densi, Kagaku, Seitai Kinouzairyo no Teion Gosei* and *Sol-Gel Hou no Kagaku—Kinousei Glass oyobi Ceramics no Teion Gosei*, Agne-Shoufu-sha, can be referred to.

The carriers used in the invention may be in a state that fine grains thereof carry a metal or another inorganic component on their surfaces. In addition, the carriers may undergo treatment for rendering their surfaces hydrophobic unless the treatment inhibits the adsorption of dye aggregates. As an example of the treatment for rendering inorganic fine grains hydrophobic, there is a method of using a coupling agent, such as a silane coupling agent or a titanate coupling agent. Examples of the silane coupling agent include γ-(2-aminoethyl)aminopropyltrimethoxysilane, γ-(2-aminoethyl)aminopropylmethyldimethoxysilane, γ-methacryloxypropyltrimethoxysilane, N-β-(N-vinylbenzylaminoethyl)-γ-aminopropyltrimethoxy silane hydrochloride, hexamethyldisilane, methyltrimethoxysilane, butyltrimethoxysilane, isobutyltrimethoxysilane, hexyltrimethoxysilane, octyltrimethoxysilane, decyltrimethoxysilane, dodecyltrimethoxysilane, phenyltrimethoxysilane, o-methylphenyltrimethoxysilane and p-methylphenyltrimethoxysilane. And examples of the titanate coupling agent include tetrabutyl titanate, tetraoctyl titanate, isopropyltriisostearoyl titanate, isopropyltridecylbenzenesulfonyl titanate, and bis(dioctylpyrophosphate)oxyacetate titanate.

The maximum absorption wavelength in the transmission absorption spectrum of the present heat-developable photosensitive material is from 600 nm to 750 nm, preferably from 600 nm to 720 nm, more preferably from 620 nm to 680 nm.

The present heat-developable photosensitive materials preferably has in its transmission absorption spectrum its absorbance peak whose half width is 100 nm or below, more preferably 80 nm or below, still more preferably 40 nm or below, particularly preferably 25 nm or below.

Further, the present heat-developable photosensitive material has preferably transmission density of 0.15 or below, more preferably 0.13 or below, still more preferably 0.10 or below, in the wavelength region from 400 nm to 600 nm before and after the heat-development processing.

Furthermore, it is preferred for the present heat-developable photosensitive material to have a light-insensitive layer containing the aggregate of an antihalation dye as defined above on one support surface opposite to the photosensitive layer-coated side. In such a case, it is preferred that (1) the transmission density of the support and the total layers on the side having the antihalation dye aggregate-containing light-insensitive layer in the wavelength region from 400 nm to 600 nm is not higher than 0.15 before and after the heat-development processing, and (2) the aforesaid transmission density at the wavelength of exposure light is not lower than 0.2 before the heat-development processing. More preferably, (1) be not higher than 0.13, and (2) is not lower than 0.2, still more preferably (1) is not higher than 0.10, (2) is not lower than 0.2. The formation of aggregates of antihalation dyes is described below in detail.

The methods conceivable as examples of a method for causing a carrier to carry a dye aggregate are the following:

(1) a method of forming aggregate and, at the same time, allowing a carrier to carry the aggregate on its surface,
(2) a method of forming aggregate first, and then causing a carrier to carry the aggregate on its surface, and
(3) a method of causing in advance a carrier to carry dye on the carrier surface and aggregating the dye in a carried state.

The method (1) is preferred because it has a low possibility for the presence of both carrier-carried dye aggregate and carrier-free dye aggregate or the presence of both aggregated and carrier-carried dye and unaggregated but carrier-carried dye.

In the invention, the dye aggregate is coated on a support in a condition that it is dispersed in a specified solvent, so that it is required to prepare a dispersion of carrier-carried dye aggregate.

Although some of dyes can form the aggregate only by dissolution or dispersion into water, the aggregate of dye is ordinarily formed by adding a polymer such as gelatin or a salt (e.g., potassium chloride, sodium chloride, barium chloride, calcium chloride, ammonium chloride) to a dye solution. The solvent therefor can be chosen appropriately depending on the solubility of the dye. Examples of the solvent usable include water, alcohols (such as methanol, ethanol, tert-butanol and benzyl alcohol), nitrites (such as acetonitrile, propionitrile and 3-methoxypropionitrile), nitromethane, halogenated hydrocarbons (such as dichloromethane, dichloroethane, chloroform and chlorobenzene), ethers (such as diethyl ether and tetrahydrofuran), dimethyl sulfoxide, amides (such as N,N-dimethylformamide and N,N-dimethylacetamide), N-methylpyrrolidone, 1,3-dimethylimidazolidinone, 3-methyloxazolidinone, esters (such as ethyl acetate and butylacetate), carbonic acid esters (such as diethyl carbonate, ethylene carbonate and propylene carbonate), ketones (such as acetone, 2-butanone and cyclohexanone), hydrocarbons (such as hexane, petroleum ether, benzene and toluene), and mixtures of the solvents as recited above.

In particular, gelatin addition to an aqueous dye solution or dye addition to an aqueous gelatin solution is preferable for the dye aggregation. In these cases, a carrier is added to and dispersed into a dye solution or a gelatin or salt solution in advance, whereby the dye aggregate can be carried on the carrier.

The dye aggregate can be also formed as a solid-particulate dispersion of dye. In order to bring dye to a solid-particulate state, known dispersing machines can be used. Examples of the dispersing machine usable for such an operation include a ball mill, a vibrating mill, a planetary ball mill, a sand mill, a colloidmill, a jet mill and a roller mill. In particular, vertical or horizontal medium dispersing machines (as disclosed in JP-A-52-92716 and WO 88/074794) are preferably used. In such a case, carrier is added to the dispersion and dispersed together with the dye; as a result, the carrier can carry the dye aggregate. As to a dye-carried state, two cases can be thought. In one case, fine grains of dye are carried through a so-called mechanochemical mechanism in the dispersing machine. In the other case, aggregate newly grow from grains of dye on the carrier via a solvent. The conditions therefor can be controlled by use of the following media.

The dispersion may be carried out in the presence of an appropriate medium (e.g., a solvent chosen from those recited above for the dye). Further, the use of a surfactant for dispersion is preferred, and the surfactant may promote solubilization of the dye into a solvent. As such a surfactant, anionic surfactants (disclosed in JP-A-52-92716 and WO 88/074794) can be preferably used. In addition, anionic polymers, nonionic surfactants or cationic surfactants maybe used, if desired.

The aggregate of dye may be fine-grained powders obtained by dissolving the dye in an appropriate solvent (e.g., the same as the above-recited solvents for the dye) and then adding thereto a poor solvent. In such a case, the surfactant as described above may be used. Further, carrier can be added in advance to the dye solution or a poor solvent as a dispersion, whereby the carrier can carry the aggregate.

By pH adjustment of the dye solution, the dye may be precipitated as microcrystals. In such a case, carrier is added in advance to the dye solution as a dispersion, whereby the carrier can carry aggregate. As the dispersion stability of carrier depends on the pH, however, there is a possibility that the dispersion stability is lost by pH adjustment. Therefore, it is preferable to carry out the pH adjustment in the presence of the surfactant as recited above or a polymer such as gelatin.

In the invention, two or more dyes may be used in a state of aggregate. In this case, two or more dyes may form one kind of aggregated state, or dyes in two or more aggregated states may be used together.

Further, uncarried dyes or aggregates thereof cause deterioration in properties, so that the method of once separating the carrier from the solution by filtration or the method of eliminating uncarried dyes by use of another adsorbent may be adopted.

With respect to the usage of dye and carrier, the amount of dye used is preferably from 0.01 to 100 mmol per unit surface area (1 $m^2$) of the carrier. The amount of dye adsorbed is preferably from 0.01 to 1 mmol per gram of the carrier. By adsorption of dye in such an amount, sufficient antihalation effect can be attained. On the other hand, the use of dye in a too small amount cannot produce sufficient antihalation effect, while the use of dye in a too large amount brings about a state that both dyes adsorbed and unadsorbed to carrier are present and produces the adverse effects as described above.

The constituents of the present heat-developable photosensitive material are described in detail below.

(Light-Insensitive Silver Source)

The light-insensitive silver source usable in the invention is substantially light-insensitive silver compound capable of forming metal silver image by reduction (such as inorganic or organic silver salt and silver complex which is ordinarily light-sensitive silver material). Organic or inorganic silver salt complex whose ligands have a stability constant from 4.0 to 10.0 is also included. Ordinarily, organic silver salt is preferred.

<Organic Silver Salt>

Although the organic silver salt usable in the invention is relatively stable to light, it can form silver image when heated at a temperature of 80° C. or higher in the presence of an exposed photocatalyst (e.g., latent image of light-sensitive silver halide) and a reducing agent. The organic silver salt may be any organic substance as far as it contains a source capable of reducing silver ion. There are descriptions of such light-insensitive organic silver salts in JP-A-10-62899, paragraphs [0048] and [0049], EP-A-0803764, from page 18, line 24, to page 19, line 37, EP-A-0962812, JP-A-11-349591, JP-A-2000-7683 and JP-A-2000-72711. The silver salt of organic acid, especially the silver salt of long-chain aliphatic carboxylic acid (containing 10 to 30, preferably 15 to 28, carbon atoms), is preferably used. Preferred examples of the silver salt of a fatty acid include silver behenate, silver arachidate, silver stearate, silver oleate, silver laurate, silver caproate, silver myristate, silver palmitate and mixtures of these silver salts of the silver salts of these fatty acids, those having a silver behenate content ratio of preferably at least 50 mole %, more preferably at least 80 mole %, and still more preferably at least 90 mole %, are used. In the case where the Tg of a binder used is 40° C. or higher, the content of silver behenate is preferably from 55 to 85 mole %.

The organic silver salt usable in the invention has no particular restriction on its crystal shape, and the crystal thereof may be in a needle, column, tabular or scale shape.

The organic silver salt in the crystalline shape of a scale is preferably used in the invention. In addition, organic silver salt grain in the shape of a short needle having an ratio of the major axis to the minor axis of at most 5, a rectangular solid or a cube, or in an irregular shape like a potato is also preferably used. These organic silver salt grains are notable for reduced fogging at the time of heat development, compared with long acicular grains having the ratio of the major axis to the minor axis of greater than 5. The organic silver salt in the crystalline shape of a scale used in the invention is described in detail in JP-A-11-349325.

The term "organic silver salt in the crystalline shape of a scale" as used in the invention is defined as follows. The silver salt of an organic acid is observed under an electron microscope. The crystalline shape of the silver salt of an organic acid is approximated at a rectangular solid, and the edge lengths of the rectangular solid are taken as a, band c in the increasing order (wherein c and b may be the same). By calculation using shorter lengths a and b, x defined as "b/a ratio" is determined.

In this way, x values of about 200 grains are determined. When these grains satisfy a relation of x(average)≧1.5, wherein x(average) means the average of the x values determined, they are referred to as grains in a scale shape. Further, the grains satisfying the relation of 30≧x(average)≧1.5 are preferred, and those satisfying the relation of 20≧x(average)≧2.0 are more preferred. The acicular grains are defined as grains satisfying the inequality 1.5>x(average)>1.

It is preferred that grain size distribution of the organic silver salt is monodisperse. The monodisperse means that each of the values obtained by dividing standard deviations of the lengths of the minor axis and the major axis respectively by the averages for lengths of the minor axis and the major axes respectively is, on a percentage basis, preferably 100% or below, more preferably 80% or below, still more preferably 50% or below. The crystalline shapes of organic silver salt can be determined by use of transmission electron microscope photographs of an organic silver salt dispersion. As another method for determining the monodispersity, there is a method of finding a standard deviation of the volume weighted average diameter of organic silver salt grain. The value obtained by dividing the standard deviation by the volume weighted average diameter (variation coefficient) is, on a percentage basis, preferably 100% or below, more preferably 80% or below, still more preferably 50% or below. The variation coefficient can be calculated, e.g., from the grain size value (volume weighted average diameter) obtained by irradiating an organic silver salt dispersed in a liquid with laser light and determining the autocorrelation function of change in fluctuations of light scattered from the salt with respect to time.

In producing and dispersing the organic silver salt used in the invention, known methods can be employed. Specifically, JP-A-10-62899, EP-A-0803763, EP-A-0962812, JP-A-11-349591, JP-A-2000-7683, JP-A-2000-72711, JP-A-2001-163889, JP-A-2001-163890, JP-A-2001-163827, JP-A-2001-33907, JP-A-2001-188313, JP-A-2001-83652, JP-A-2002-6442; JP-A-2002-31870 and JP-A-2002-107868 can be referred to.

The present organic silver salt can be used in a desired amount. Specifically, the amount of the organic silver salt used is preferably from 0.1 to 5 g/$m^2$, more preferably from 0.3 to 3 g/$m^2$, still more preferably from 0.5 to 2 g/$m^2$, on a silver basis.

(Reducing Agent)

It is appropriate for the present heat-developable photosensitive material to contain a thermal developer, which is a reducing agent for the organic silver salt. The reducing agent for organic silver salt may be any of substances (preferably any organic substances) capable of reducing silver ion to metallic silver.

Examples of such a reducing agent are described in JP-A-11-65021, paragraphs [0043] to [0045], and EP-A-0803764, from page 7, line 34 to page 19, line 12.

As the reducing agent used in the invention, reducing agents of so-called hindered phenol type having a substituent on the o-position of the phenolic hydroxyl group and reducing agents of bisphenol type are preferred. Of the reducing agents, compounds represented by the following formula (R) are more preferably used:

(R)

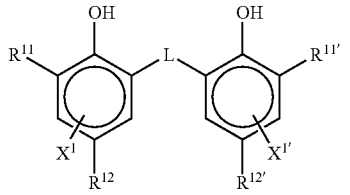

In formula (R), $R^{11}$ and $R^{11'}$ each independently represent an alkyl group containing 1 to 20 carbon atoms. $R^{12}$ and $R^{12'}$ each independently represent a hydrogen atom or a substituent capable of substituting on the benzene ring. L represents —S— or —$CHR^{13}$—. $R^{13}$ represents a hydrogen atom or an alkyl group containing 1 to 20 carbon atoms. $X^1$ and $X^{1'}$ each independently represent a hydrogen atom or a substituent capable of substituting on the benzene ring.

The formula (R) is described in more detail.

$R^{11}$ and $R^{11'}$ each independently represent a substituted or unsubstituted alkyl group containing 1 to 20 carbon atoms. The alkyl group has no particular restriction on its substituent, and preferred substituents therefor include an aryl group, a hydroxyl group, an alkoxy group, an aryloxy group, an alkylthio group, an arylthio group, an acylamino group, a sulfonamido group, a sulfonyl group, a phosphoryl group, an acyl group, a carbamoyl group, an ester group, an ureido group, an urethane group and a halogen atom.

$R^{12}$ and $R^{12'}$ each independently represent a hydrogen atom or a substituent capable of substituting on the benzene ring. $X^1$ and $X^{1'}$ also each independently represent a hydrogen atom or a substituent capable of substituting on the benzene ring. Suitable examples of the substituent capable of substituting on the benzene ring include an alkyl group, an aryl group, an alkoxy group and an acylamino group.

L represents —S— or —$CHR^{13}$—. $R^{13}$ represents a hydrogen atom or an alkyl group containing 1 to 20 carbon atoms, which may have a substituent. Examples of the unsubstituted alkyl group represented by $R^{13}$ include methyl, ethyl, propyl, butyl, heptyl, undecyl, isopropyl, 1-ethylpentyl and 2,4,4-trimethylpentyl groups. Examples of the substituent for the alkyl group include the same substituents as described for the alkyl group represented by $R^{11}$.

As $R^{11}$ and $R^{11'}$ each, a secondary or tertiary alkyl group containing 3 to 15 carbon atoms is preferred. Examples of such an alkyl group include an isopropyl group, an isobutyl group, a tert-butyl group, a tert-amyl group, a tert-octyl group, a cyclohexyl group, a cyclopentyl group, a 1-methylcyclohexyl group and a 1-methylcyclopropyl group. The group more preferable as $R^{11}$ and $R^{11'}$ each is a tertiary alkyl group containing 4 to 12 carbon atoms. Of the groups, tert-butyl, tert-amyl and 1-methylcyclohexyl groups are still more preferred. Particularly, a tert-butyl group is preferred.

As $R^{12}$ and $R^{12'}$ each, an alkyl group containing 1 to 20 carbon atoms is preferred. Examples of such an alkyl group include a methyl group, an ethyl group, a propyl group, a butyl group, an isopropyl group, a tert-butyl group, a t-amyl group, a cyclohexyl group, a 1-methylcyclohexyl group, a benzyl group, a methoxymethyl group and an ethoxyethyl group. Of the groups, methyl, ethyl, propyl, isopropyl and tert-butyl groups are more preferred.

As $X^1$ and $X^{1'}$ each, a hydrogen atom, a halogen atom and alkyl group are preferred, and a hydrogen atom is more preferred.

L is preferably —$CHR^{13}$—.

$R^{13}$ is preferably a hydrogen atom or an alkyl group containing 1 to 15 carbon atoms. Preferred examples of such an alkyl group include a methyl group, an ethyl group, a propyl group, an isopropyl group and a 2,4,4-trimethylpentyl group. A hydrogen atom, a methyl group, an ethyl group, a propyl group and an isopropyl group are particularly preferred.

When $R^{13}$ is a hydrogen atom, $R^{12}$ and $R^{12'}$ each represent preferably an alkyl group containing 2 to 5 carbon atoms, more preferably an ethyl group or a propyl group, particularly preferably an ethyl group.

When $R^{13}$ is a primary or secondary alkyl group containing 1 to 8 carbon atoms, $R^{12}$ and $R^{12'}$ each preferably represent a methyl group. As the primary or secondary alkyl group containing 1 to 8 carbon atoms for $R^{13}$, a methyl group, an ethyl group, a propyl group and an isopropyl group are more preferred. In particular, methyl, ethyl and propyl groups are preferred.

When $R^{11}$, $R^{11'}$, $R^{12}$ and $R^{12'}$ all are methyl groups, it is preferred that $R^{13}$ is a secondary alkyl group. In this case, an isopropyl group, an isobutyl group or a 1-ethylpentyl group is preferred as the secondary alkyl group of $R^{13}$. Of the groups, an isopropyl group is more preferred.

The heat developability and the tone of developed silver vary depending on the combination of $R^{11}$, $R^{11'}$, $R^{12}$, $R^{12'}$ and $R^{13}$ in the reducing agent described above. These characteristics can be adjusted by combined use of two or more reducing agents. Depending on the intended purpose, therefore, it is preferred to use two or more reducing agents in combination.

Examples of the compound represented by formula (R) and other reducing agents usable in the invention are illustrated below. However, these examples should not be construed as limiting the scope of the invention.

(R-1)

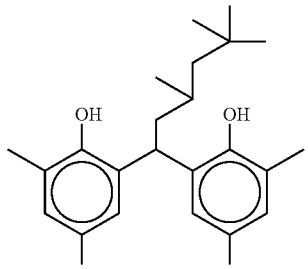

(R-2)

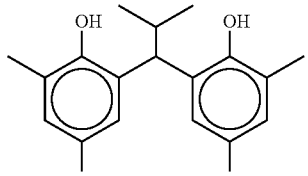

-continued
(R-3)
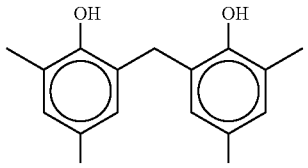
(R-4)
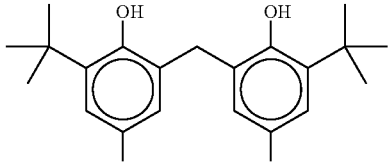
(R-5)
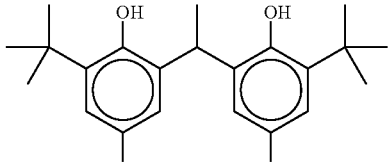
(R-6)
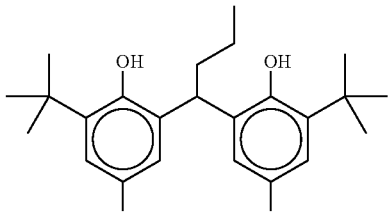
(R-7)
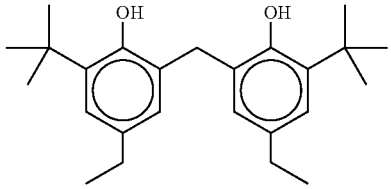
(R-8)
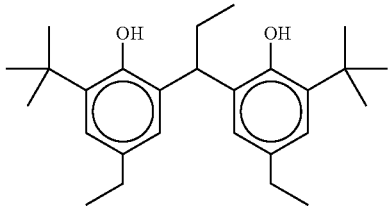
(R-9)
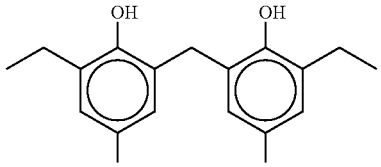
(R-10)
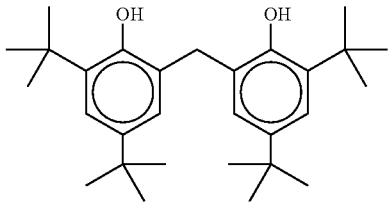
-continued
(R-11)
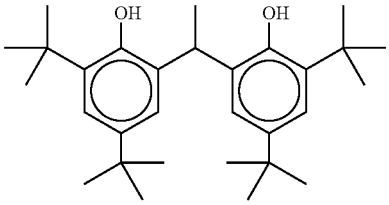
(R-12)
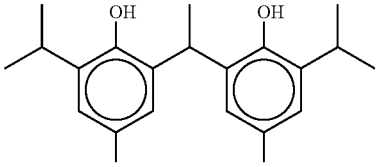
(R-13)
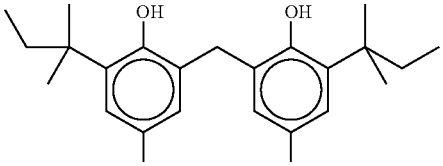
(R-14)
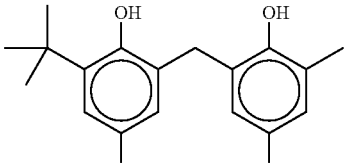
(R-15)
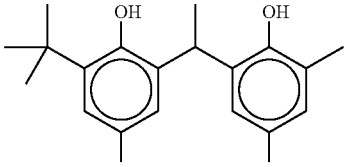
(R-16)
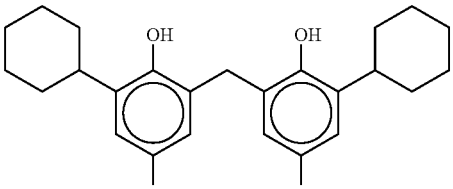
(R-17)
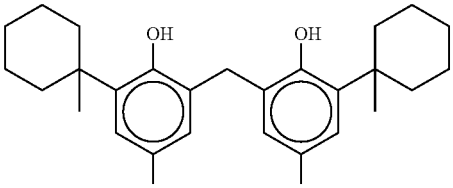
(R-18)
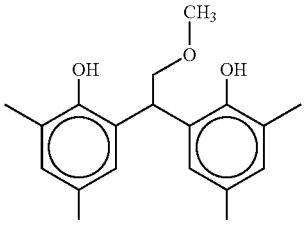

-continued
(R-19)
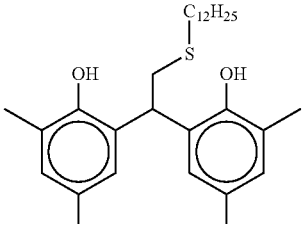
(R-20)
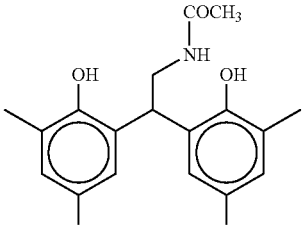
(R-21)
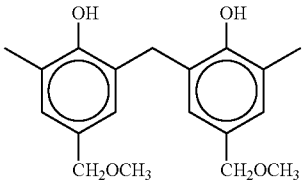
(R-22)
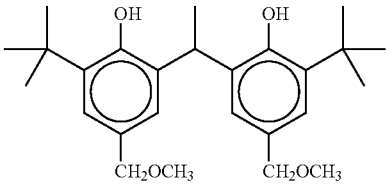
(R-23)
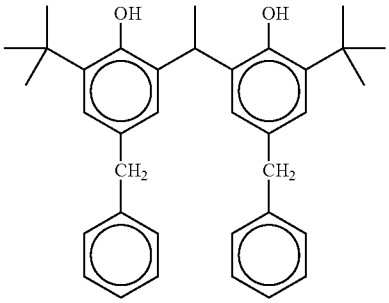
(R-24)
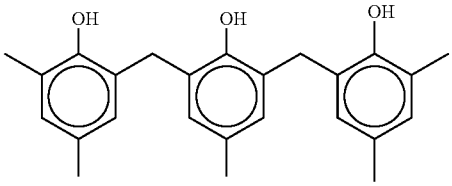
(R-25)
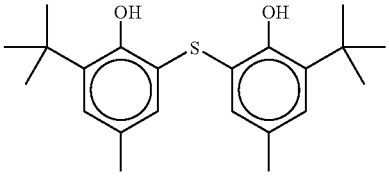
-continued
(R-26)
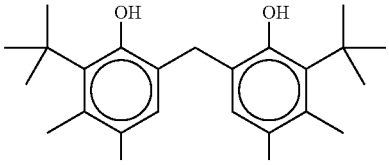
(R-27)
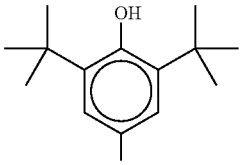
(R-28)
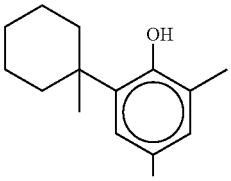
(R-29)
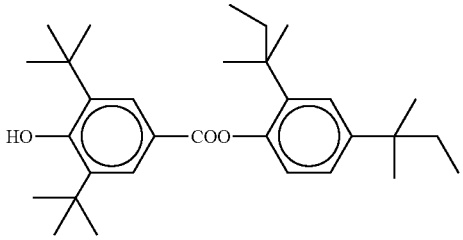
(R-30)
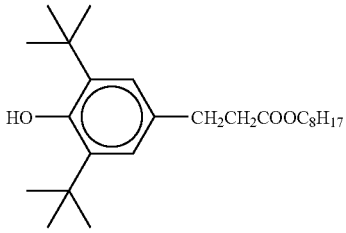
(R-31)
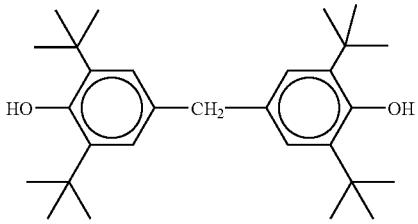
(R-32)
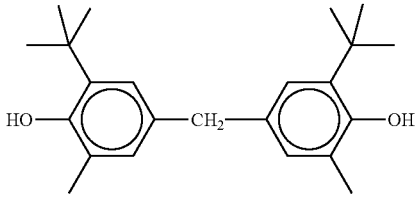

-continued (R-33)

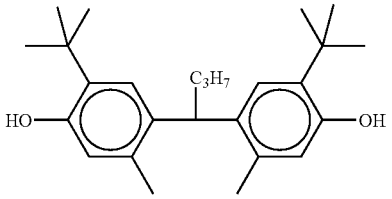

(R-34)

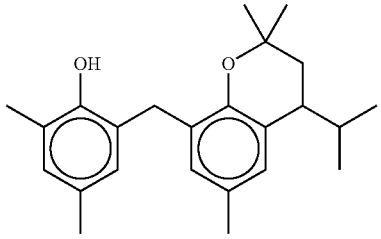

The amount of reducing agent added in the invention is preferably from 0.1 to 3.0 g/m$^2$, more preferably from 0.2 to 1.5 g/m$^2$, still more preferably from 0.3 to 1.0 g/m$^2$. The amount of reducing agent for every one mole of silver on the side having the image-forming layer is preferably from 5 to 50 mole %, more preferably from 8 to 30 mole %, still more preferably from 10 to 20 mole %. It is preferred for the reducing agent is incorporated in the image-forming layer.

The reducing agent may be admixed in a coating solution in any form, such as solution, emulsified dispersion and fine particulate solid dispersion, and incorporated in the present photosensitive material.

In a well-known emulsified dispersion method, the reducing agent is dissolved using oil, such as dibutyl phthalate, tricresyl phosphate, glyceryl triacetate or diethyl phthalate, and an auxiliary solvent, such as ethyl acetate or cyclohexanone, and mechanically made into an emulsified dispersion.

In a fine particulate solid dispersing method, on the other hand, the reducing agent powder is dispersed in an appropriate solvent, such as water, by means of a ball mill, a colloid mill, a vibrating ball mill, a sand mill, a jet mill, a roller mill or ultrasonic wave, there by preparing a solid dispersion. The dispersion may be performed in the presence of a protective colloid (e g., polyvinyl alcohol) or a surfactant (e.g., an anionic surfactant, such as sodium triisopropylnaphthalenesulfonate, which is a mixture of those differing in substitution positions of three isopropyl groups). In the mills recited above, zirconia beads are ordinarily used as dispersion media. In some cases, therefore, the dispersion is contaminated with zirconium eluted from the beads. The zirconium content in the dispersion is ordinarily within the range of 1 to 1,000 ppm, though it depends on dispersing conditions. As far as the zirconium content in the photosensitive material is not higher than 0.5 mg per gram of silver, zirconium produces no adverse effect in a practical sense.

In an aqueous dispersion, it is preferred to incorporate an antiseptic (e.g., sodium benzoisothiazolinone).

(Development Accelerator)

Compounds preferably used as development accelerator in the present heat-developable photosensitive material include the sulfonamidophenol compounds represented by formula (A) disclosed in JP-A-2000-267222 and JP-A-2000-330234, the hindered phenol compounds represented by formula (II) disclosed in JP-A-2001-92075, the hydrazine compounds represented by formula (I) disclosed in JP-A-10-62895 and JP-A-11-15116 and formula (1) disclosed in JP-A-2002-278017, and the phenol or naphthol compounds represented by formula (2) disclosed in JP-A-2001-264929. The development accelerator is used in a proportion of 0.1 to 20 mole %, preferably from 0.5 to 10 mole %, more preferably from 1 to 5 mole %, based on the reducing agents used. It can be introduced into the photosensitive material in accordance with the same method as used for the reducing agent. In particular, it is preferable to add it as a solid dispersion or an emulsified dispersion. In the case of adding the development accelerators as the emulsified dispersion, it is appropriate to prepare an emulsified dispersion by dispersing the development accelerator using both a high boiling solvent, which is a solid at room temperature, and an auxiliary solvent with a low boiling point, or to prepare a so-called oil-less emulsified dispersion by dispersing it without using the high boiling solvent.

(Hydrogen Bond-Forming Compound)

When the reducing agent used in the invention has an aromatic hydroxyl group (—OH), especially in the cases of a bisphenol as described above, a non-reducing compound having a group capable of forming a hydrogen bond with the hydroxyl group is preferably used in combination. The hydrogen bond-forming compounds usable in the invention are described in detail in European Patent No. 1096310.

The hydrogen bond-forming compound particularly preferably used in the invention is a compound represented by the following formula (D):

(D)

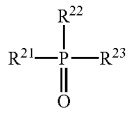

In formula (D), $R^{21}$ to $R^{23}$ each independently represent an alkyl group, an aryl group, an alkoxy group, an aryloxy group, an amino group or a heterocyclic group, each of which may be unsubstituted or may have a substituent.

Examples of the compound represented by formula (D) and other hydrogen bond-forming compounds usable in the invention are illustrated below. However, these examples should not be construed as limiting the scope of the invention in any way.

(D-1)

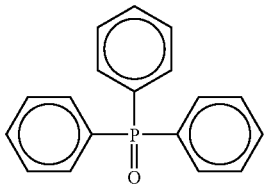

(D-2)

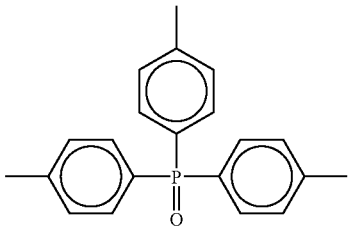

-continued
(D-3)
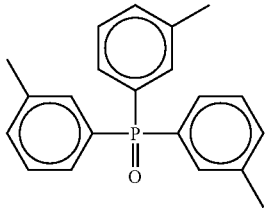
(D-4)
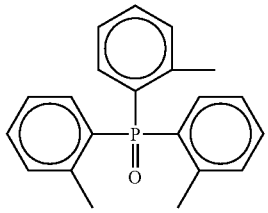
(D-5)
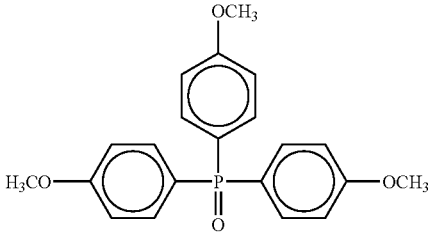
(D-6)
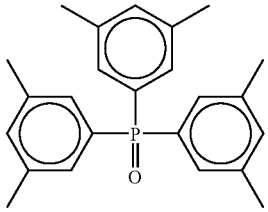
(D-7)
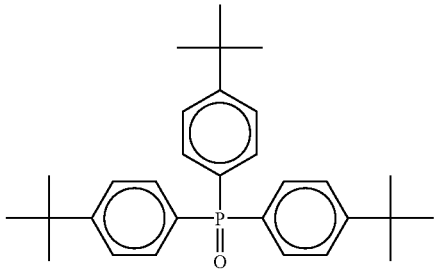
(D-8)
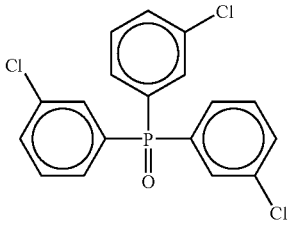
(D-9)
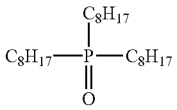
-continued
(D-10)
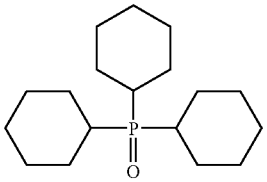
(D-11)
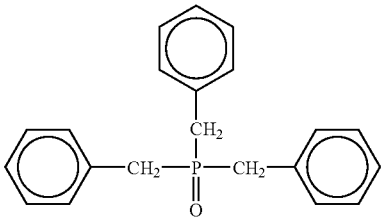
(D-12)
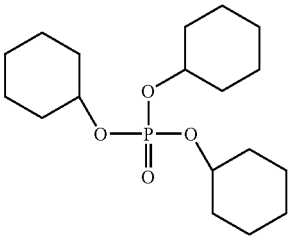
(D-13)
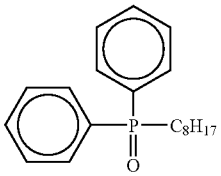
(D-14)
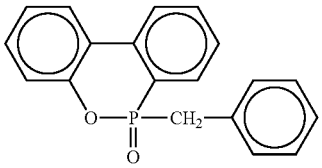
(D-15)
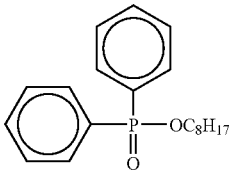
(D-16)
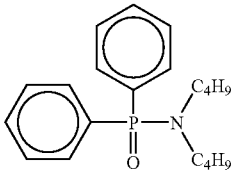
(D-17)
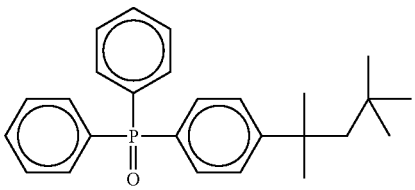

-continued (D-18)

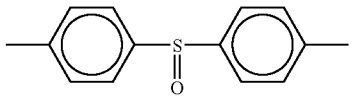

(D-19)

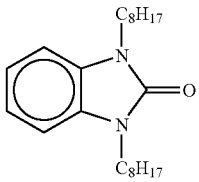

(D-20)

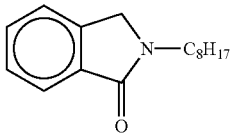

(D-21)

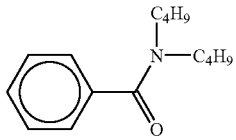

In addition to the compounds recited above, examples of the hydrogen bond-forming compound include those disclosed in European Patent No. 1096310, JP-A-2002-156727 and JP-A-2002-318431.

The compound represented by formula (D) in the invention, similar to the case of the reducing agent, can be added to a coating solution in the form of a solution, an emulsified dispersion or a fine particulate solid dispersion, and incorporated in a photosensitive material. The compound represented by formula (D) is preferably used in a proportion of from 1 to 200 mole %, more preferably from 10 to 150 mole %, still more preferably from 20 to 100 mole %, based on the reducing agent.

(Silver Halide)

Light-sensitive silver halide usable in the invention has no particular restriction as to its halide composition, and any of silver chloride, silver chlorobromide, silver bromide, silver iodobromide, silver iodochlorobromide and silver iodide can be used. Of these halides, silver bromide and silver iodobromide are preferred. The halide distribution inside the grains may be uniform throughout, or may vary stepwise or continuously. Further, silver halide grains having a core/shell structure can be preferably used. As to the structure thereof, it is preferable to use core/shell grains of a two- to five-layered stricture, more preferably core-shell grains of two- to four-layered structure. In addition, it is preferred to adopt techniques for localizing silver bromide or silver iodide on the grain surface of silver chloride, silver bromide or silver chlorobromide.

Methods for forming the light-sensitive silver halide are well known in the field of art. For instance, the methods disclosed in "Research Disclosure", No. 17029 (June, 1978) and U.S. Pat. No. 3,700,458 can be used. More specifically, the light-sensitive silver halide is prepared by adding a silver-providing compound and a halogen-providing compound to a gelatin or other polymer solution, and then mixed with an organic silver salt. In addition, it is also preferred to use the method disclosed in JP-A-11-119374, paragraphs [0217] to [0224], and the methods disclosed in JP-A-11-352627 and JP-A-2000-347335.

For the purpose of reducing white turbidity after the image formation, it is preferred that the grain size of light-sensitive silver halide is small. Specifically, the grain size is preferably 0.20 μm or below, more preferably from 0.01 μm to 0.15 μm, still more preferably from 0.02 μm to 0.12 μm. The term "grain size" used herein means a diameter of the circular image whose area is equivalent to a projected area of silver halide grain (a projected area of the principal surface in the case of tabular grain).

Examples of a shape of silver halide grains include cubic, octahedral, tabular, spherical, columnar and potato-like shapes. In the invention, cubic grains are particularly preferred. Also, silver halide grains having rounded corners are preferably used.

The silver halide grain preferably used in the invention is silver halide grain on the outermost surface of which a hexacyano-metal complex is present. Examples of the hexacyano-metal complex include $[Fe(CN)_6]^{4-}$, $[Fe(CN)_6]^{3-}$, $[Ru(CN)_6]^{4-}$, $[Os(CN)_6]^{4-}$, $[Co(CN)_6]^{3-}$, $[Rh(CN)_6]^{3-}$, $[Ir(CN)_6]^{3-}$, $[Cr(CN)_6]^{3-}$ and $[Re(CN)_6]^{3-}$. In the invention, the hexacyano-iron complex is preferably used.

The amount of the hexacyano-metal complex added is preferably from $1\times10^{-5}$ mole to $1\times10^{-2}$ mole, more preferably from $1\times10^{-4}$ mole to $1\times10^{-3}$ mole, per mole of silver.

The present light-sensitive silver halide grain can contain metal belonging to group VIII to group X of the periodictable (listing elements of group I to group XVIII) or a complex thereof. The metal of group VIII to group X of the periodic table or the central metal of the metal complex includes preferably rhodium, ruthenium and iridium. The metal complexes may be used alone, or as a combination of two or more complexes of metals of the same kind or different kinds. The suitable content of the metal or metal complex is from $1\times10^{-9}$ to $1\times10^{-3}$ mole per mole of silver. The heavy metal, the complex thereof and their addition methods are described in JP-A-7-225449, JP-A-11-65021, paragraphs [00189] to [0024], and JP-A-11-119374, paragraphs [0227] to [0240].

Further, metal complex which can be present in the present silver halide grain (e.g., $[Fe(CN)_6]^{-4}$), desalting methods and chemical sensitization methods of silver halide emulsion are described in JP-A-11-84574, paragraphs [0046] to [0050], JP-A-11-65021, paragraphs [0025] to [0031], and JP-A-11-119374, paragraphs [0242] to [0250].

The light-sensitive silver halide emulsion used in the invention can contain various gelatins. In order that a dispersion of a light-sensitive silver halide emulsion in a coating solution containing an organic silver salt is kept in a good condition, it is preferred to use gelatin having a low molecular weight of from 500 to 60,000. Such low-molecular-weight gelatin may be used at the time of forming grain or dispersing after the desalting step. Preferably, it is used at the time of dispersing after the desalting step.

Sensitizing dyes capable of spectrally sensitizing silver halide grains in the desired wavelength region when they are adsorbed to the grains, and having spectral sensitivities suitable for the spectral characteristic of an exposure light source used can be advantageously selected as sensitizing dyes applicable to the invention.

The case of carrying the present dyes on fine grains of light-insensitive silver halide is discriminated in respect of the aforesaid sensitivity. Therefore, even if the dyes similar to the sensitizing dyes described herein are used, it is apparent that the light-insensitive silver halide has no contribution to image formation so long as it is in a state that it carries the present dyes.

Such sensitizing dyes and methods of adding them can be found in JP-A-11-65021, paragraphs [0103] to [0109], the compounds represented by formula (II) in JP-A-10-186572, the dyes represented by formula (I) and paragraph [0106] in JP-A-11-119374, U.S. Pat. No. 5,510,236, the dyes described in Example 5 of U.S. Pat. No. 3,871,887, JP-A-2-96131, the dyes disclosed in JP-A-59-48753, EP-A-0803764, page 19, line 38, to page 20, line 35, and JP-A-2001-272747, JP-A-2001-290238 and JP-A-2002-23306. The sensitizing dyes may be used alone or as a combination of two or more thereof.

In the invention, the sensitizing dye can be added in an amount commensurate with the desired sensitivity and fog performances. Specifically, the addition amount thereof is preferably from $10^{-6}$ to 1 mole, more preferably from $10^{-4}$ to 10-1 mole, per mole of the silver halide in the light-sensitive layer.

For the purpose of enhancing the spectral sensitization efficiency, supersensitizers can be used. Examples of the supersensitizer usable in the invention include the compounds disclosed in EP-A-587338, U.S. Pat. Nos. 3,877,943 and 4,873,184, JP-A-5-341432, JP-A-11-109547 and JP-A-10-111543.

It is preferable for the present light-sensitive silver halide grain to be chemically sensitized in accordance with a sulfur sensitization method, a selenium sensitization method or a tellurium sensitization method. The compounds preferably used in the sulfur, selenium and tellurium sensitization methods include known compounds, such as the compounds disclosed in JP-A-7-128768. In the invention, tellurium sensitization is preferred in particular. For tellurium sensitization, the compounds described in the references cited in JP-A-11-65021, paragraph [0030], and the compounds represented by formulae (II), (III) and (IV) in JP-A-5-313284 are preferably used.

In the invention, chemical sensitization can be performed at any time within a period between the completion of grain formation and the start of coating, specifically after desalting, (1) before spectral sensitization, (2) simultaneously with spectral sensitization, (3) after spectral sensitization, or (4) immediately before coating. In particular, it is preferable to perform the chemical sensitization after spectral sensitization.

The amount of sulfur, selenium and tellurium sensitizers used in the invention may vary depending on the silver halide grain used and chemical ripening conditions. Specifically, it is used in the order of $10^{-8}$ to $10^{-2}$ mole, preferably $10^{-7}$ to $10^{-3}$ mole, per mole of silver halide. The invention has no particular restrictions as to conditions for chemical sensitization, but ordinarily the pH is from 5 to 8, the pAg is from 6 to 11 and the temperature is from 40 to 95° C.

To the silver halide emulsion used in the invention, a thiosulfonic acid compound may be added according to the method disclosed in EP-A-293917.

In the present photosensitive material, only one kind of light-sensitive silver halide emulsion may be used, or two or more of light-sensitive silver halide emulsions (differing in average grain size, halide composition, crystal habit or condition for chemical sensitization) may be used in combination. The use of plural light-sensitive silver halide emulsions differing in sensitivity enables gradation control. The techniques concerning the above are disclosed, e.g., in JP-A-57-119341, JP-A-53-106125, JP-A-47-3929, JP-A-48-55730, JP-A-46-5187, JP-A-50-73627 and JP-A-57-150841. As to the sensitivity difference, it is preferred that the sensitivities of emulsions are different from each other by at least 0.2 in terms of logarithmic exposure amount (log E).

The amount of light-sensitive silver halide added is preferably from 0.03 to 0.6 g/m$^2$, more preferably from 0.05 to 0.4 g/m$^2$, most preferably from 0.07 to 0.3 g/m$^2$, expressed in the amount of silver coated per m$^2$ of photosensitive material. A ratio of light-sensitive silver halide to an organic silver salt is preferably from 0.01:1 to 0.5:1 by mole, more preferably from 0.02:1 to 0.3:1 by more, still more preferably from 0.03:1 to 0.2:1 by mole.

With respect to the method and condition for mixing light-sensitive silver halide and an organic silver salt prepared separately, there are known the method of mixing the silver halide grain and the organic silver salt after the preparation by means of a high-speed stirrer, a bail mill, a sand mill, a colloid mill, a vibration mill or a homogenizer, or the method of preparing an organic silver salt wherein light-sensitive silver halide after the preparation is admixed at any timing during the preparation of organic silver salt. However, no particular restriction is imposed thereon so far as the present effects can be sufficiently produced. For controlling photographic characteristics, it is preferred to mix aqueous dispersions of two or more organic silver salts with aqueous dispersions of two or more light-sensitive silver salts.

The suitable timing at which the present silver halide is added to a coating solution for an image-forming layer is from 180 minutes before to just before the start of coating, preferably from 60 minutes to 10 seconds before the start of coating. There are no restrictions on the method and condition for mixing the present silver halide with the coating solution so far as the effects of the invention can be sufficiently achieved. Specific examples of the mixing method include a mixing method using a tank controlled so that the average stay time calculated from the rate of liquid flow added to the tank and the volume of the liquid sent into a coater becomes the desired value, and a method of using a static mixer as described in N. Harnby, M. F. Edwards & A. W. Nienow, "Ekitai Kongou Gijutsu" (translated by Koji Takahashi), chapter 8, Nikkan Kogyo Shinbun-sha (1989).

(Binder)

As the binder for the present organic silver salt-containing layer, any polymer may be used. Examples of the binder used preferably include transparent or translucent, ordinarily colorless, natural resins, polymers and copolymers, synthetic resins, polymers and copolymers, and other film-forming media, for example, gelatin, rubber, polyvinyl alcohol, hydroxyethyl cellulose, cellulose acetate, cellulose acetate butyrate, polyvinylpyrrolidone, casein, starch, polyacrylic acid, polymethyl methacrylate, polyvinyl chloride, polymethacrylic acid, styrene-maleic anhydride copolymer, styrene-acrylonitrile copolymer, styrene-butadiene copolymer, polyvinyl acetal (such as polyvinyl formal or polyvinyl butyral), polyester, polyurethane, phenoxy resin, polyvinylidene chloride, polyepoxide, polycarbonate, polyvinyl acetate, polyolefin, cellulose ester and polyamide. The binder may form a coating film through the use of water, an organic solvent or an emulsion.

The glass transition temperature of binder used in the organic silver salt-containing layer is preferably from 10° C. to 80° C. (hereinafter, the binder having its glass transition temperature in such a temperature range is also referred to as a high Tg binder sometimes), more preferably from 15° C. to 70° C., still more preferably from 20° C. to 65° C.

In the invention, a polymer dispersible in a water-based solvent is preferable in particular. Examples of the polymer in a dispersed state include latex in which fine particles of a water-insoluble, hydrophobic polymer are dispersed, and a dispersion in which a polymer molecule is dispersed in a molecular state or in the form of micelle. Particles dispersed in a latex form are preferable. The average diameter of dispersed particles is from 1 to 50,000 nm, preferably from 5 to 1,000 nm, more preferably from 10 to 500 nm, still more preferably from 50 to 200 nm. The diameter distribution of dispersed particles is not particularly restricted, and both broad particle diameter distribution and monodisperse particle diameter distribution may be used. A mixture of two or more polymers each having monodisperse particle diameter distribution is also advantageous from the viewpoint of controlling physical properties of the coating solution.

Preferred examples of the polymer dispersible in a water-based solvent include hydrophobic polymer, for example, acrylic polymer, polyester, rubber (e.g., SBR resin), polyurethane, polyvinyl chloride, polyvinyl acetate, polyvinylidene chloride and polyolefin. The polymer may be a linear, branched or cross-linked polymer, and it may be a polymer obtained by polymerization of single-sort monomer, namely a so-called homopolymer, or a copolymer obtained by polymerization of two or more sorts of monomers. In the case of copolymer, both random and block copolymers are usable. The number average molecular weight of the polymer is preferably from 5,000 to 1,000,000, more preferably from 10,000 to 200,000. When the molecular weight is too low, the mechanical strength of the emulsion layer becomes insufficient, while too high molecular weight is undesirable because of poor film formability. In particular, cross-linking polymer latex is preferably used.

(Examples of Latex)

Preferred examples of the polymer latex are recited below. In the following examples, each latex is represented by monomer as starting material, each figure in parentheses is expressed in weight %, and each molecular weight is number average molecular weight. When polyfunctional monomer is used, the concept of molecular weight cannot be applied because a cross-linked structure is formed. Therefore, such a latex is described as cross-linking and its molecular weight description is omitted. Tg stands for a glass transition temperature.

P-1; -MMA(70)-EA(27)-MAA(3)- latex (molecular weight: 37,000, Tg: 61° C.)

P-2; -MMA(70)-2EHA(20)-St(5)-AA(5)- latex (molecular weight: 40,000, Tg: 59° C.)

P-3; -St(50)-Bu(47)-MAA(3)- latex (cross-linking, Tg: −17° C.)

P-4; -St(68)-Bu(29)-AA(3)- latex (cross-linking, Tg: 17° C.)

P-5; -St(71)-Bu(26)-AA(3)- latex (cross-linking, Tg: 24° C.)

P-6; -St(70)-Bu(27)-IA(3)- latex (cross-linking)

P-7; -St(75)-Bu(24)-AA(1)- latex (cross-linking, Tg: 29° C.)

P-8; -St(60)-Bu(35)-DVB(3)-MAA(2) latex (cross-linking)

P-9;-St(70)-Bu(25)-DVB(2)-AA(3)- latex (cross-linking)

P-10; -VC(50)-MMA(20)-EA(20)-AN(5)-AA(5)- latex (molecular weight: 80,000)

P-11; -VDC(85)-MMA(5)-EA(5)-MAA(5)- latex (molecular weight: 67,000)

P-12; -Et (90)-MAA(10)- latex (molecular weight:12,000)

P-13; -St(70)-2EHA(27)-AA(3)- latex (molecular weight: 130,000, Tg: 43° C.)

P-14; -MMA(63)-EA(35)-AA(2)- latex (molecular weight: 33,000, Tg: 47° C.)

P-15; -St(70.5)-Bu(26.5)-AA(3)- latex (cross-linking, Tg: 23° C.)

P-16; -St(69.5)-Bu(27.5)-AA(3)- latex (cross-linking, Tg: 20.5° C.)

The abbreviations in the above formulae stand for the following monomers respectively: MMA; methyl methacrylate, EA; ethyl acrylate, MAA; methacrylic acid, 2EHA; 2-ethylhexyl acrylate, St; styrene, Bu; butadiene, AA; acrylic acid, DVB; divinylbenzene, VC; vinyl chloride, AN; acrylonitrile, VDC; vinylidene chloride, Et; ethylene, IA; itaconic acid.

The polymer latices recited above are also commercially available, and the following products can be used. Examples of acrylic polymer products include Sebian A-4635, 4718 and 4601 (produced by DAICEL CHEMICAL INDUSTRIES, LTD), and Nipol Lx811, 814, 821, 820 and 857 (produced by ZEON CORPORATION). Examples of polyester products include FINETEX ES650, 611, 675 and 850 (produced by Dainippon Ink & Chemicals, Inc.), and WD-size and WMS (produced by EASTMAN CHEMICAL). Examples of polyurethane products include HYDRAN AP10, 20, 30 and 40 (produced by Dainippon Ink & Chemicals, Inc.). Examples of rubber products include LACSTAR 7310K, 3307B, 4700H AND 7132C (produced by Dainippon Ink & Chemicals, Inc.), and Nipol Lx416, 410, 438C and 2507 (produced by ZEON CORPORATION). Examples of polyvinyl chloride products include G351 and G576 (produced by ZEON CORPORATION). Examples of polyvinylidene chloride products include L502 and L513 (produced by Asahi Kasei Corporation). Examples of polyolefin products include Chemipearl S120 and SA100 (produced by Mitsui Chemicals, Inc.).

The polymer latices may be used alone, or two or more thereof may be blended, if desired.

(Preferred Latex)

As the polymer latex used in the invention, styrene-butadiene copolymer latex is preferred in particular. The ratio between styrene unit and butadiene unit in the copolymer is preferably from 40:60 to 95:5 by weight. Also, it is preferred that the total amount of styrene unit and butadiene unit is from 60 to 99 weight % of the copolymer. Further, the polymer latex preferably contains acrylic acid unit or methacrylic acid unit in an amount of 1 to 6 weight %, more preferably 2 to 5 weight %, based on the sum total of styrene and butadiene units. The incorporation of acrylic acid unit in the polymer latex is preferred.

Examples of styrene-butadiene-acid copolymer latex preferably used in the invention include the foregoing P-3 to P-8 and P-15, and LACSTAR-3307B, LACSTAR-7132C and Nipol Lx416 as the commercial products.

To the organic silver salt-containing layer of the photosensitive material may be added a hydrophilic polymer, such as gelatin, polyvinyl alcohol, methyl cellulose, hydroxypropyl cellulose or carboxymethyl cellulose. The amount of hydrophilic polymer added is preferably not greater than 30 weight %, more preferably not greater than 20 mass %, of the total binder in the organic silver salt-containing layer.

It is preferable that the organic silver salt-containing layer (or the image-forming layer) is a layer formed using polymer latex. The ratio of the total binder to the organic silver salt in the organic silver salt-containing layer is preferably from 1/10 to 10/1, more preferably from 1/3 to 5/1, still more preferably from 1/1 to 1/3, by weight.

Ordinarily, the organic silver salt-containing layer is also a light-sensitive layer (an emulsion layer) containing light-sensitive silver halide as light-sensitive silver salt. In such a case, the ratio of the total binder to the silver halide is preferably from 400/1 to 5/1, more preferably from 200/1 to 10/1, by weight.

The amount of total binder contained in the image-forming layer is preferably from 0.2 to 30 g/m$^2$, more preferably from 1 to 15 g/m$^2$, still more preferably from 2 to 10 g/m$^2$. To the image-forming layer maybe added a cross-linking agent for crosslinking and a surfactant for improving coating property.

(Preferable Solvent for Coating Composition)

The solvent (herein, a solvent and a dispersing medium are both referred to as a solvent for simplicity's sake) suitably used in a coating solution for the organic silver salt-containing layer of the present photosensitive material is a water-based solvent containing at least 30 weight % water. As a solvent component other than water, a water-miscible organic solvent, such as methyl alcohol, ethyl alcohol, isopropyl alcohol, methyl cellosolve, ethyl cellosolve, dimethylformamide and ethyl acetate, maybe appropriately used. The water content in the solvent for the coating solution is preferably at least 50 weight %, more preferably at least 70 weight %. Preferred examples of the solvent composition include water=100, water/methyl alcohol=90/10, water/methyl alcohol=70/30. water/methyl alcohol/dimethylformamide=80/15/5, water/methyl alcohol/ethyl cellosolve=85/10/5, and water/methyl alcohol/isopropyl alcohol=85/10/5 (wherein all the figures are by weight %)

(Antifoggant)

The compounds disclosed in JP-A-10-62899, paragraph [0070], the compounds disclosed in EP-A-0803764, page 20, line 57, to page 21, line 7, the compounds disclosed in JP-A-9-281637 and JP-A-9-329864, the compounds disclosed in U.S. Pat. No. 6,083,681 and European Patent No. 1048975 can be used as the antifoggant, stabilizer and precursor of stabilizer in the invention. In addition, the antifoggant preferably used in the invention is an organic halogen compound. Examples of the organic halogen compound include the compounds disclosed in JP-A-11-65021, paragraphs [0111] and [0112]. In particular, the organic halogen compounds represented by formula (P) in JP-A-2000-284399, the organic polyhalogen compounds represented by formula (II) in JP-A-10-339934, and the organic polyhalogen compounds disclosed in JP-A-2001-31644 and JP-A-2001-33911 are preferred.

(Polyhalogen Compound)

The polyhalogen compound preferred in the invention includes a compound represented by the following formula (H):

$$Q—(Y)_n—C(Z_1)(Z_2)X \quad (H)$$

In formula (H), Q represents an alkyl group, an aryl group or a heterocyclic group, Y represents a divalent connecting group, n represents 0 or 1, $Z_1$ and $Z_2$ each represent a halogen atom, and X represents a hydrogen atom or an electron attractive group.

Preferably, Q in formula (H) represents a phenyl group substituted with an electron attractive group whose Hammett's substituent constant σp takes on a positive value. For details of the Hammett's substituent constant, *Journal of Medicinal Chemistry*, vol. 15, No. 11, pages 1207–1216 (1973) can be referred to.

X is preferably an electron attractive group, more preferably a halogen atom, an aliphatic sulfonyl group, an arylsulfonyl group, a heterocyclic sulfonyl group, analiphatic acyl group, an arylacyl group, a heterocyclic acyl group, an aliphatic oxycarbonyl group, an aryloxycarbonyl group, a heterocyclic oxycarbonyl group, a carbamoyl group or a sulfamoyl group, particularly preferably a halogen atom. Of the halogen atoms, chlorine, bromine and iodine atoms are preferred, chlorine and bromine atoms are more preferred, and a bromine atom is particularly preferred.

Y is preferably —C(=O)—, —SO— or —$SO_2$—, more preferably —C(=O)— or —$SO_2$—, particularly preferably —$SO_2$—.

n is 0 or 1, preferably 1.

Examples of the compound represented by formula (H) used in the invention are illustrated below.

(H-1)

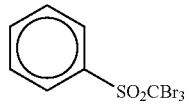

(H-2)

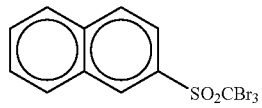

(H-3)

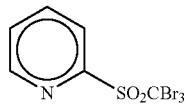

(H-4)

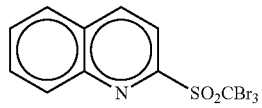

(H-5)

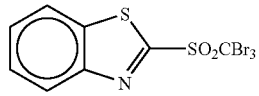

(H-6)

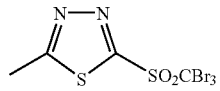

(H-7)

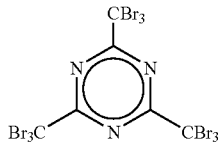

(H-8)

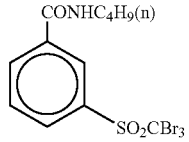

(H-9)

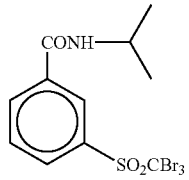

-continued (H-10)

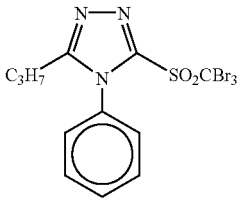

(H-11)

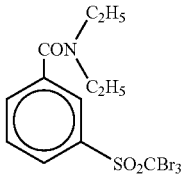

(H-12)

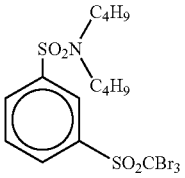

(H-13)

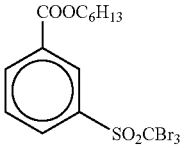

(H-14)

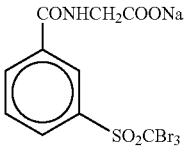

(H-15)

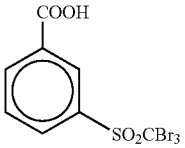

(H-16)

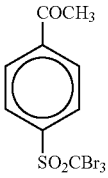

(H-17)

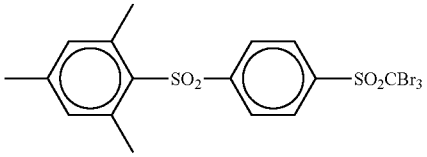

(H-18)

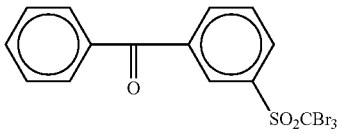

-continued (H-19)

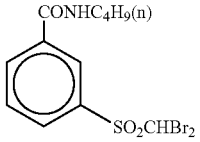

(H-20)

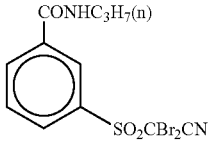

(H-21)

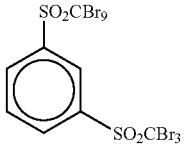

(H-22)

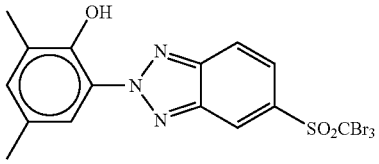

(H-23)

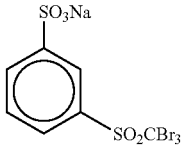

(H-24)

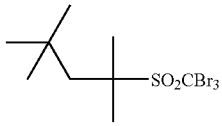

The compound represented by formula (H) in the invention is used preferably in an amount of $10^{-4}$ to 1 mole, more preferably $10^{-3}$ to 0.5 mole, still more preferably $1\times10^{-2}$ to 0.2 mole, per mole of the light-insensitive silver salt in the image-forming layer.

As a method of incorporating the antifoggant into the photosensitive material, the methods as described above for the reducing agent can be adopted. Specifically, the method of adding in the form of a fine particulate solid dispersion is also preferable for the organic polyhalogen compound.

(Other Antifoggants)

Examples of other antifoggants include the mercury (II) salts disclosed in JF-A-11-65021, paragraph [0113], the benzoic acids disclosed in JP-A-11-65021, paragraph [0114], the salicylic acid derivatives disclosed in JP-A-2000-206642, the formaldehyde scavenger compounds represented by formula (S) in JP-A-2000-221634, the triazine compounds relating to claim 9 of JP-A-11-352624, the compounds represented by formula (III) in JP-A-6-11791 and 4-hydroxy-6-methyl-1,3,3a,7-tetraazaindene.

The present heat-developable photosensitive material may contain an azolium salt for the purpose of fog prevention. Examples of the azolium salt include the compounds of formula (XI) disclosed in JP-A-59-193447, the compounds disclosed in JP-B-55-12581, and the compounds of formula (II) disclosed in JP-A-60-153039.

In the present photosensitive material, a mercapto compound, disulfide compound and thione compound can be contained for the purposes of controlling the development through retardation or acceleration, enhancing the efficiency of spectral sensitization and improving the preservability before and after the development. The compounds include the compounds disclosed in JP-A-10-62899, paragraphs [0067] to [0069], the compounds represented by formula (I) in JP-A-10-186572 and their examples recited in paragraphs [0033] to [0052], and the compounds disclosed in EP-A-0803764, page 20, lines 36–56. In particular, the mercapto-substituted aromatic heterocyclic compounds as disclosed in JP-A-9-297367, JP-A-9-304875 and JP-A-2001-100358 are preferable.

(Toning Agent)

Addition of toning agent is preferable for the present heat-developable photosensitive materials. Descriptions of the toning agent can be found in JP-A-10-62899, paragraphs [0054] and [0055], EP-A-0803764, page 21, lines 23–48, JP-A-2000-356317 and JP-A-2000-187298. Of the toning agents, phthalazinones, combinations of phthalazinones and phthalic acids, phthalazines and combinations of phthalazines and phthalic acids are preferably used, and combinations of phthalazines and phthalic acids are more preferably used. In particular, the combination of 6-isopropylphthalazine and phthalic acid or 4-methylphthalic acid is preferred.

(Other Additives)

The plasticizers and the lubricants described in JP-A-11-65021, paragraph [0117], can be used in the present light-sensitive layer. The ultra-high contrast-providing agent for formation of ultra-high contrast images and the addition method and amount thereof, which can be applied to the present light-sensitive layer, are described in JP-A-11-65021, paragraph [0118], JP-A-11-223898, paragraphs [0136] to [0193], and further include the compounds represented by formula (H), formulae (1) to (3), formulae (A) and (B) respectively in JP-A-2000-284399 and the compounds represented by formulae (III) to (V) respectively (specifically, Compounds of [Ka-21] to [Ka-24]) in JP-A-2000-347345. The ultra-high contrast accelerators which can be used in the present light-sensitive layer include those described in JP-A-11-65021, paragraph [0102], and JP-A-11-223898, paragraphs [0194] and [0195].

In order that formic acid or a salt thereof serves as a strong fogging substance, it is preferably used in an amount of 5 millimoles or below, more preferably 1 millimole or below, per mole of silver on the side where the image-forming layer containing light-sensitive silver halides is present, When the ultra-high contrast-providing agent is used in the present heat-developable photosensitive material, it is preferable to use an acid formed by hydration of diphosphorus pentoxide or a salt thereof in combination therewith. Examples of the acid formed by hydration of diphosphorus pentoxide and salt thereof include metaphosphoric acid (metaphosphate), pyrophosphoric acid (pyrophosphate), orthophosphoric acid (orthophosophate), triphosphoric acid (triphosphate), tetraphosphoric acid (tetraphosphate), and hexametaphosphoric acid (hexametaphosphate). Of the acid formed by hydration of diphosphorus pentoxide and salt thereof, orthophosphoric acid (orthophosphate) and hexametaphosphoric acid (hexametaphosphate) are particularly preferably used. Specific examples of the salt include sodium orthophosphate, sodium dihydrogen orthophosphate, sodium hexametaphosphate and ammonium hexametaphosphate.

The amount of the acid formed by hydration of diphosphorus pentoxide and salt thereof (coverage per $m^2$ of the photosensitive material) may be appropriately determined considering characteristics such as sensitivity and fog. Specifically, the amount is preferably from 0.1 to 500 $mg/m^2$, more preferably from 0.5 to 100 $mg/m^2$.

(Layer Structure)

The present heat-developable photosensitive material can have a surface protective layer for the purpose of preventing adhesion of the image-forming layer. The surface protective layer may be a single layer or a multiple layer. Detailed descriptions of the protective layer can be found in JP-A-11-65021, paragraphs [0119] and [0120], and JP-A-2000-171936.

As a binder of the present surface protective layer, gelatin is preferable. In addition, it is also preferred to use polyvinyl alcohol (PVA) alone or in combination with gelatin. As to the gelatin used, inert gelatin (e.g. Nitta Gelatin 750) and phthalated gelatin (e.g., Nitta Gelatin 801) are usable. Examples of PVA usable include those disclosed in JP-A-2000-171936, paragraphs [0009] to [0020], preferably PVA-105 as a completely saponified product, PVA-205 and PVA-335 as partially saponified products, and MP-203 as a modified polyvinyl alcohol product (which all are trade names and available from Kuraray Co., Ltd.) The polyvinyl alcohol coverage (per $m^2$ of a support) for each of the protective layer is preferably from 0.3 to 4.0 $g/m^2$, more preferably from 0.3 to 2.0 $g/m^2$.

In the case where the present heat-developable light-sensitive layer is used for printing purpose wherein dimensional stability becomes significant in particular, it is preferable to use polymer latex in the surface protective layer or a backing layer. Descriptions of the polymer latex can be found, e.g., in *Gousei Jushi Emulsion*, compiled by Taira Okuda & Hiroshi Inagaki, Koubunshi Kankoukai (1978), *Gousei Latex no Ouyou*, compiled by Takaaki Sugimura, Yasuo Kataoka, Souichi Suzuki & Keishi Kasahara, Koubunshi Kankoukai (1993), and Gousei Latex no Kagaku, compiled by Souichi Muroi, Koubunshi Kankoukai (1970). Examples of usable polymer latex include latex of methyl methacrylate (33.5 weight %)/ethyl acrylate (50 weight %)/methacrylic acid (16.5 weight %) copolymer, latex of methyl methacrylate (47.5 weight %)/butadiene (47.5 weight %)/itaconic acid (5 weight %) copolymer, latex of ethyl acrylate/methacrylic acid copolymer, latex of methyl methacrylate (58.9 weight %)/2-ethylhexyl acrylate (25.4 weight %)/styrene (8.6 weight %)/2-hydroxyethyl methacrylate (5.1 weight %)/acrylic acid (2.0 weight %) copolymer, and latex of methyl methacrylate (64.0 weight %)/styrene (9.0 weight %)/butyl acrylate (20.0 weight %)/2-hydroxyethyl methacrylate (5.0 weight %)/acrylic acid (2.0 weight %) copolymer. Further, to the binder of the surface protective layer may be applied the arts disclosed in JP-A-2000-267226, paragraphs [0021] to [0025], and the arts disclosed in JP-A-2000-19678, paragraphs [0023] to [0041]. In the surface protective layer, the content of polymer latex is preferably 10 to 90 weight %, particularly preferably 20 to 80 weight %, based on the total binder.

The coverage (per $m^2$ of a support) of the total binder (including water-soluble binder and latex polymer) for each of the surface protective layer is preferably from 0.3 to 5.0 $g/m^2$, more preferably from 0.3 to 2.0 $g/m^2$.

The preparation temperature of the coating solution for the present image-forming layer is preferably from 30° C. to 65° C., more preferably from 35° C. to 60° C., still more preferably 35° C. to 55° C. It is also preferred that the temperature of the coating solution for the image-forming layer just after the addition of polymer latex is kept at a temperature of from 30° C. to 65° C.

The present image-forming layer is provided on a support, and constituted of one or more layers. When it has one constituent layer, the present image-forming layer contains an organic silver salt, light-sensitive silver halide, a reducing agent and a binder, and additional ingredients including a toning agent, a coating aid and other auxiliary agents, if desired. When the image-forming layer has two or more constituent layers, the first image-forming layer (ordinarily the layer adjacent to a support) contains an organic silver salt and light-sensitive silver halide, and the second image-forming layer or both first and second image-forming layers contain other ingredients. In the case of a multicolor, light-sensitive heat-developable photographic material, the photographic material may have a combination of the two layers for each color or, as disclosed in U.S. Pat. No. 4,708,928, may contain all the ingredients in a single layer. In the case of a multi-dye, multicolor, light-sensitive, heat-developable photographic material, as described in U.S. Pat. No. 4,469,681, each adjacent pair of emulsion layers are kept distinctively by providing a functional or non-functional barrier layer between the light-sensitive layers.

In the present light-sensitive layer, various kinds of dyes and pigments (such as C.I. Pigment Blue 60, C.I. Pigment Blue 64, C.I. Pigment Blue 15:6) can be used from the viewpoints of improvement of tone, prevention of interference pattern formation upon exposure to laser light and prevention of irradiation. Detailed descriptions thereof can be found in WO 98/36322, JP-A-10-268465 and JP-A-11-338098.

In the present heat-developable photosensitive material, an anti-halation layer may be positioned at a location distant from a light source relative to the light-sensitive layer.

The heat-developable photosensitive material ordinarily has a light-insensitive layer in addition to the light-sensitive layer. According to its location, the light-insensitive layer is classified under four groups, namely (1) a protective layer provided on a light-sensitive layer (distant from a support), (2) an interlayer provided between adjacent light-sensitive layers or between a light-sensitive layer and a protective layer, (3) an undercoat layer provided between a support and a light-sensitive layer and (4) a backing layer provided on the side opposite to the light-sensitive layer. A filter layer is provided in the photosensitive material as a layer classified as the group (1) or (2), and an anti-halation layer is provided in the photosensitive material as a layer classified as the group (3) or (4).

Descriptions of the anti-halation layer can be found in JP-A-11-65021, paragraphs [0123] and [0124], JP-A-11-223898, JP-A-9-230531, JP-A-10-36695, JP-A-10-104779, JP-A-11-231457, JP-A-11-352625 and Jp-A-11-352626.

The anti-halation layer contains anti-halation dye showing absorption at wavelength of light for exposure. When the exposure light has its wavelength peak in the infrared region, an infrared absorbing dye is used as the anti-halation dye. In this case, it is preferable that the dye used has no absorption in the visible region. The composition containing a light-insensitive carrier in a state that it carries the present dye or aggregate thereof is preferably used.

In particular, when the prevention of halation is performed with dye showing absorption in the visible region, the composition containing a light-insensitive carrier in a state that it carries the present dye or aggregate thereof is preferably used.

As it is preferred that the dye used leave substantially no color after the image formation, an expedient of decolouring the dye by the heat of heat development may be adopted. In particular, it is preferable to add a thermally decoloring dye and a base precursor to a light-insensitive layer and make the light-insensitive layer function as anti-halation layer. These arts are described in JP-A-11-231457.

The amount of decolouring dye added is determined depending on usage of the dye. Ordinarily, the decolouring dye is used preferably in an amount for providing an optical density (absorbance) higher than 0.1, measured at the intended wavelength. The optical density is preferably from 0.15 to 2, and more preferably from 0.2 to 1. In order to attain such an optical density, the amount of dye used is ordinarily approximately from 0.001 to 1 g/m$^2$.

By decolouring the dye appropriately, the optical density after the heat development can be lowered to 0.1 or below. Two or more decolouring dyes may be used together in a thermal decolouration type recording material or a heat-developable photosensitive material. Also, two or more base precursors may be used together.

In the thermal decolouration using such a decolouring dye and a base precursor, it is preferred to use a substance capable of lowering a melting point by 3° C. (deg) or more when mixed with the base precursor as disclosed in JP-A-11-352626 (e.g., diphenylsulfone, 4-chlorophenyl(phenyl) sulfone), or 2-naphthylbenzoate from the viewpoint of thermal decolouration capability.

For the purpose of improving the tone of silver and change of the image with a lapse of time, a coloring agent having its absorption maximum in the wavelength region of 300 to 450 nm can be added in the invention. Such coloring agents are disclosed in JP-A-62-210458, JP-A-63-104046, JP-A-63-103235, JP-A-63-208846, JP-A-63-306436, JP-A-63-314535, JP-A-01-61745 and JP-A-2001-100363.

The coloring agent is ordinarily added in an amount of 0.1 mg/m$^2$ to 1 g/m$^2$, and a layer to which it is added is preferably a backing layer provided on the side opposite to light-sensitive layer.

The heat-developable photosensitive material according to the invention is preferably a so-called single-sided photosensitive material, namely a photosensitive material having on one side of a support a light-sensitive layer containing at least a silver halide emulsion and on the other side a backing layer.

In the invention, addition of a matting agent is preferable for the purpose of improving suitability for conveyance. Descriptions of the matting agent can be found in JP-A-11-65021, paragraphs [0126] and [0127]. The amount of matting agent added is preferably from 1 to 400 mg, more preferably from 5 to 300 mg, per m$^2$ of photosensitive material.

The shape of matting agent used in the invention may be a regular or irregular shape, but preferably a regular shape, especially a spherical shape. The average diameter of particles is preferably from 0.5 to 10 μm, more preferably from 1.0 to 8.0 μm, still more preferably from 2.0 to 6.0 μm. The variation coefficient of particle size distribution is preferably 50% or below, more preferably 40% or below, still more preferably 30% or below. The term "variation coefficient" used herein means a value represented by (standard deviation of particle diameter)/(average value of particle diameter)×100. Further, it is preferred to use two matting agents having small variation coefficients and average diameter ratio of at least 3.

The emulsion layer surface may have any matting degree so far as it causes no stardust defect, but it has preferably Bekk smoothness of 30 to 2,000 seconds, especially 40 to 1,500 seconds. The Bekk smoothness can be easily determined in conformance with Japanese Industrial Standards (JIS) P8119, entitled "Paper and Paper Board Smoothness Testing Method by Bekk Smoothness Tester",and TAPPI Standard Method T479.

The matting degree of the back layer surface in the invention is preferably from 1,200 to 10 seconds, more preferably from 800 to 20 seconds, still more preferably from 500 to 40 seconds, in terms of Bekk smoothness.

In the invention, it is preferred that the matting agent is contained in the outermost surface layer, a layer functioning as the outermost surface layer, or a layer near the outer surface. It is also preferred to add the matting agent to a layer functioning as the so-called protective layer.

Back layers applicable to the invention are described in JP-A-11-65021, paragraphs [0128] to [0130].

In the present heat-developable photosensitive material, a pH on the surface before heat-development processing is preferably 7.0 or below, more preferably 6.6 or below. The pH on the surface has no particular lower limit, but it is of the order of 3. The most preferable pH range on the surface is from 4 to 6.2. For adjustment of the pH on the surface, an organic acid such as a phthalic acid derivative, a nonvolatile inorganic acid such as sulfuric acid, or a volatile base such as ammonia is used preferably from the viewpoint of decreasing the pH on the surface. In particular, ammonia is preferable for attaining a low pH value on the surface because it is easy to volatilize and to remove at the coating step or before heat development.

In addition, the combined use of ammonia with a nonvolatile base, such as sodium hydroxide, potassium hydroxide or lithium hydroxide, is also preferred. As a method of measuring the pH on the surface, the method described in JP-A-11-87297, paragraph [0123] can be adopted.

A hardener may be used in each of the present constituent layers, such as the light-sensitive layer, the protective layer and the back layer. There are many hardening methods as described in T. H. James, *THE THEORY OF THE PHOTOGRAPHIC PROCESS FOURTH EDITION*, pages 77–87, Macmillan Publishing Co., Inc., and a wide variety of hardeners can be used. Preferable examples thereof include chrome alum, sodium salt of 2,4-dichloro-6-hydroxy-s-triazine, N,N-ethylenebis(vinylsulfonacetamide), N,N-propylenebis(vinylsulfonacetamide), the polyvalent metal ions as described in the book cited above, page 78, the polyisocyanates as disclosed in U.S. Pat. No. 4,281,060 and JP-A-6-208193, the epoxy compounds as disclosed in U.S. Pat. No. 4,791,042, and the vinylsulfone compounds as disclosed in JP-A-62-89048.

Such a hardener is added as a solution, and the suitable timing at which the solution is added to a coating solution for a protective layer is from 180 minutes before to just before the start of coating, preferably from 60 minutes to 10 seconds before the start of coating. There are no restrictions on the method and the condition for mixing the hardener in the coating solution so far as the effects of the invention can be sufficiently produced. As specific mixing methods, there are known the mixing method using a tank controlled so that the average stay time calculated from the rate of liquid flow added to the tank and the volume of the liquid sent into a coater becomes the desired value, and the method of using a static mixer as described in N. Harnby, M. F. Edwards & A. W. Nienow, "Ekitai Kongou Gijutsu", Chapter 8 (translated by Koji Takahashi), Nikkan Kogyo Shinbun-sha (1989).

Surfactants usable in the invention include those disclosed in JP-A-11-65021, paragraph [0132], solvents usable in the invention include those disclosed in ibid., paragraph [0133], supports usable in the invention include those disclosed in ibid., paragraph [0134], anti-static or conductive layers applicable to the invention include those disclosed in ibid., paragraph [0135], color image formation methods applicable to the invention include those disclosed in ibid., paragraph [0136], and lubricants usable in the invention include those disclosed in JP-A-11-84573, paragraphs [0061] to [0064], and JP-A-2001-83679, paragraphs [0049] to [0062].

It is preferred for the present photosensitive material to have a conductive layer containing a metal oxide. As a conductive material contained in the conductive layer, metal oxides in which oxygen defects or foreign metal atoms are introduced and thereby increased in conductivity are preferably used. Preferable metal oxides include ZnO, $TiO_2$ and $Sno_2$. The addition of Al and In to ZnO, that of Sb, Nb, P and halogen elements to $SnO_2$, and that of N band Ta to $TiO_2$ are preferred. In particular, $SnO_2$ to which Sb is added is preferably used .

The amount of foreign atom added is preferably from 0.01 to 30 mole %, more preferably from 0.1 to 10 mole %. The metal oxide used may have any of spherical, acicular and tabular shapes. From the viewpoint of effectiveness of imparting conductivity, however, acicular grain having major axis/minor axis ratio of at least 2.0, preferably 3.0 to 50, is advantageously used.

The amount of metal oxide used is preferably from 1 to 1,000 $mg/m^2$, more preferably from 10 to 500 $mg/m^2$, still more preferably from 20 to 200 $mg/m^2$. The conductive layer may be arranged on the emulsion layer side or the back layer side, but preferably it is disposed between a support and a back layer. Specific examples of the conductive layer usable in the invention are described in JP-A-7-295146 and JP-A-11-223901.

In the invention, it is preferable to use a fluorine-containing surfactant. Examples of the fluorine-containing surfactant usable include the compounds disclosed in JP-A-10-197985, JP-A-2000-19680 and JP-A-2000-214554. The fluorine-containing polymer surfactants disclosed in JP-A-9-281636 are also used preferably. In particular, the fluorine-containing surfactants disclosed in JP-A-2002-82411 are preferred in the invention.

The transparent support preferable for the invention is polyester, especially polyethylene terephthalate, which has undgergone heat treatment in a temperature range of 130 to 185° C. for the purposes of lessening internal strains remaining in the film upon biaxial stretch and eliminating the distortion caused by thermal shrinkage during the heat development. In the case of a heat-developable photosensitive material for medical use, the transparent support may be colored with a blue dye (e.g., Dye-1 used in Example of JP-A-8-240877), or it may be colorless. To the support are preferably applied undercoat arts using the water-soluble polyester disclosed in JP-A-11-84574, the styrene-butadiene copolymer disclosed in JP-A-10-186565 and the vinylidene chloride copolymers disclosed in JP-A-2000-39684 and JP-A-2001-83679, paragraphs [0063] to [0080], respectively. To the anti-static layer and the undercoat layer can be applied the arts disclosed in JP-A-56-143430, JP-A-56-143431, JP-A-58-62646, JP-A-56-120519, JP-A-11-84573, paragraphs [0040] to [0051], U.S. Pat. No. 5,575,957, and JP-A-11-223898, paragraphs [0078] to [0084].

The heat-developable photosensitive material is preferably a mono-sheet type (or a type which forms images in the heat-developable photosensitive material without using another sheet such as an image-receiving material)

To the heat-developable photosensitive material may further be added an antioxidant, a stabilizer, a plasticizer, an ultraviolet absorbent and a coating aid. These additives are added to either of light-sensitive and light-insensitive layers. For details of these additives WO 98/36322, EP-A-803764, JP-A-10-186567 and JP-A-10-18568 can be referred to.

In preparing the heat-developable photosensitive material, any coating method may be adopted. More specifically, a wide variety of coating operations including extrusion coating, slide coating, curtain coating, dip coating, knife coating, flow coating and the extrusion coating using a hopper as disclosed in U.S. Pat. No. 2,681,294 can be applied. Moreover, the extrusion coating and the slide coating techniques described in Stephen F. Kistler & Petert M. Schweizer, *LIQUID FILM COATING*, pages 399–536, CHAPMAN & HALL CO. (1997) are preferably applied. In particular, the slide coating techniques are preferably used. Examples of the shape of a slide coater usable in the slide coating operation are illustrated in the book cited above, FIG. 11b.1 on page 427. Further, if desired, simultaneous coating of two or more layers may be performed in accordance with the methods as described in the book cited above, pages 399–536, U.S. Pat. No. 2,761,791 and British Pat. No. 831,095.

The coating solution for the present organic silver salt-containing layer is preferably the so-called thixotropic fluid. For the art of forming such a fluid JP-A-11-52509 can be referred to. The coating solution for the organic silver salt-containing layer has preferably a viscosity of 400 to 100,000 mPa·s, more preferably 500 to 20,000 mPa·s, at a shear rate of 0.1 $S^{-1}$. The viscosity of the coating solution at a shear rate of 1,000 $S^{-1}$ is preferably from 1 to 200 mPa·s, more preferably from 5 to 80 mpa·s.

To the present heat-developable photosensitive material can be also applied the arts disclosed in EP-A-803764, EP-A-883022, WO 98/36322, JP-A-56-62648, JP-A-58-62644, JP-A-9-43766, JP-A-9-281637, JP-A-9-297367, JP-A-9-304869, JP-A-9-311405, JP-A-9-329865, JP-A-10-10669, JP-A-10-62899, JP-A-10-69023, JP-A-10-186568, JP-A-10-90823, JP-A-10-171063, JP-A-10-186565, JP-A-10-186567, JP-A-10-186569 to JP-A-10-186572, JP-A-10-197974, JP-A-10-197982, JP-A-10-197983, JP-A-10-197985 to JP-A-10-197987, JP-A-10-207001, JP-A-10-207004, JP-A-10-221807, JP-A-10-282601, JP-A-10-288823, JP-A-10-288824, JP-A-10-307365, JP-A-10-312038, JP-A-10-339934, JP-A-11-7100, JP-A-11-15105, JP-A-11-24200, JP-A-11-24201, JP-A-11-30832, JP-A-11-84574, JP-A-11-65021, JP-A-11-109547, JP-A-11-125880, JP-A-11-129629, JP-A-11-133536 to JP-A-11-133539, JP-A-11-133542, JP-A-11-133543, JP-A-11-223898, JP-A-11-352627, JP-A-11-305377, JP-A-11-305378, JP-A-11-305384, JP-A-11-305380, JP-A-11-316435, JP-A-11-327076, JP-A-11-338096, JP-A-11-338098, JP-A-11-338099, JP-A-11-343420, JP-A-2000-187298, JP-A-2000-10229, JP-A-2000-47345, JP-A-2000-206642, JP-A-2000-98530, JP-A-2000-98531, JP-A-2000-112059, JP-A-2000-112060, JP-A-2000-112104, JP-A-2000-112064 and JP-A-2000-171936.

(Wrapping Material)

For the purpose of controlling changes caused in photographic properties when the present photosensitive material is stored in a condition of raw film, or improving the resistance of the present photosensitive material to curl and core set, it is preferred to wrap the raw film in a wrapping material having a low oxygen-permeability and/or a low moisture-permeability.

The oxygen-permeability of the wrapping material is preferably at most $5.78\times10^{-4}$ ml/atm·$m^2$·s (50 ml/atm·$m^2$·day), more preferably at most $1.16\times10^{-4}$ ml/atm·$m^2$·s (10 ml/atm·$m^2$·day), still more preferably at most $5.78\times10^{-5}$ ml/atm·$m^2$·s (1.0 ml/atm·$m^2$·day), measured at 25° C. The moisture-permeability is preferably at most $1.16\times10^{-4}$ g/atm·$m^2$·s (10 g/atm·$m^2$·day), more preferably at most $5.78\times10^{-5}$ g/atm·$m^2$·s (5 g/atm·$m^2$·day), still more preferably at most 1 g/atm·$m^2$ day.

Examples of the wrapping material having such low oxygen- and/or moisture-permeability include the wrapping materials disclosed in JP-A-8-254793 and JP-A-2000-206653.

(Heat Development)

The present heat-developable photosensitive material may be developed by any method, but it is ordinarily developed by temperature rise after the imagewise exposure. The temperature for development is preferably from 80° C. to 250° C., more preferably from 100° C. to 140° C. still more preferably from 110° C. to 130° C. The development time is preferably from 1 to 60 seconds, more preferably from 3 to 30 seconds, still more preferably from 5 to 25 seconds, particularly preferably from 7 to 15 seconds.

The heat development may be performed in a way of using a drum heater or a plate heater, but the way of using a plate heater is preferred in the invention. To the heat development using a plate heater, it is preferable to apply the method disclosed in JP-A-11-133572. More specifically, the method uses a heat-development apparatus that enables conversion of latent images formed in the heat-developable photosensitive material into visible images by bringing the photosensitive materials into contact with a heating means installed in the heat-development section. The apparatus is characterized in that the heating means installed therein is a plate heater, a plurality of pressing rollers are opposed along one surface of the plate heater and the heat-developable photosensitive material is made to pass between the plate heater and the pressing rollers, thereby effecting the heat development. It is preferable that the plate heater is two- to six-segmented and the temperature of each end segment is reduced by the order of 1 to 10° C. For instance, a case can be used where a quartet of plate heaters capable of independent temperature control is used and these plate heaters are adjusted to temperatures of 112° C., 119° C., 121° C. and 120° C., respectively. Such a way of heating is described in JP-A-54-30032, and can remove the moisture and the organic solvent contained in the heat-developable photosensitive material into the outside of the photosensitive material and moreover control a support shape change caused by an abrupt heating of the heat-developable photosensitive material.

The present photosensitive material may be exposed in accordance with any method. As an exposure light source, however, laser light is preferred. Preferred examples of laser light applied to the invention include gas laser ($Ar^+$, He—Ne), YAG laser, dye laser and semiconductor laser. In addition, combination of semiconductor laser and a second harmonic generating device can also be used. Of the laser devices, gas or semiconductor laser devices emitting red to infrared light are preferred.

As a medical laser imager provided with an exposure section and a heat development section, Fuji Medical Dry Laser Imager PM-UP L can be used. The model FM-DP L is described in *Fuji Medical Review*, No.8, pp. 39–55. The arts disclosed therein are applied to a laser imager used for the present heat-developable photosensitive material. Further, the present heat-developable photosensitive material can also be utilized as a heat-developable photosensitive material for the laser imager in "AD Network" which Fuji Medical System offers as a network system compliant with the DICOM standard.

The present heat-developable photosensitive material forms black-and-white images based on silver images, and preferably used as a heat-developable photosensitive material for medical diagnosis, industrial photography, graphic art and COM purpose.

In particular, the present heat-developable photosensitive material is preferably used as heat-developable photosensitive material for medical diagnosis.

Now, the invention is described in more detail by reference to the following examples, but these examples should not be construed as limiting the scope of the invention in any way.

EXAMPLE 1

(Preparation of Supports A1 to A6 Provided with Backing)

<Preparation of Dye Dispersion 101>

An aqueous slurry of Dye 83 illustrated by the following structural formula was prepared by thoroughly mixing 9 g of Dye 83 and 2,241 ml of distilled water by means of a high-speed stirrer (Multi Disperser PB95, round blade type, made by SMT Co., Ltd. ). Thereto, 2,250 g of a 10% aqueous gelatin solution was added with stirring, and then the stirring was further continued in the dark while keeping the solution temperature at 60° C. until variations in spectral absorption of the dye ceased. The gelatin dispersion of Dye 83 thus obtained was passed through a polypropylene filter with an effective pore diameter of 3 microns, and stored at a temperature of 10° C. or below in the dark. The jellied solid matter (Dye Dispersion 101) thus obtained was put to practical use.

Dye 83

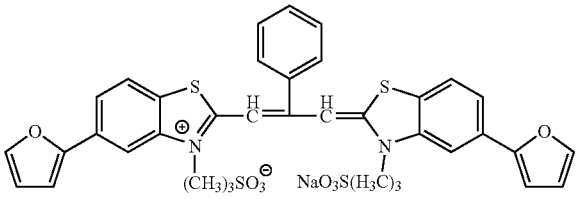

<Preparation of Fine-Grain Dye Dispersion 102>

Distilled water was admixed with 4 g Dye 83, 20 g of a surfactant (Cellogen 6A, trade name, a product of Dai-Ichi Kogyo Seiyaku Co., Ltd.) and 0.4 g of an anti-foaming agent (Surfynol 104E, trade name, a product of Nissin Chemical Industry Co., Ltd.) to make the total amount of the resulting admixture 400 g. The admixture obtained was subjected to beads dispersion by use of a vertical sand mill (volume: ¼ gallon, made by AIMEX Co., Ltd.). The dispersion was continued until the average grain size of the dye reached to 0.2 μm or below, and then filtration (average pore diameter: 1 μm) was carried out for elimination of dust. The thus obtained dispersion (Fine-Grain Dye Dispersion 102) was put to practical use.

<Preparation of Dye Dispersion 103>

Dye 83 in an amount of 9 g was dissolved in 241 ml of methanol. All the methanol solution obtained was added dropwise to 2,000 ml of water with stirring. To the aqueous slurry of Dye 83 thus obtained, 2,250 g of a 10% aqueous gelatin solution was added with stirring. Then, the admixture was further stirred at 60° C. in the dark until variations in spectral absorption of dye ceased, The thus obtained gelatin dispersion of Dye 83 was passed through a polypropylene filter having an effective pore diameter of 3μ, and stored at a temperature of 10° C. or below in the dark. The jellied solid matter thus formed (Dye Dispersion 103) was put to practical use.

<Preparation of Dye Dispersion 104>

An aqueous slurry of Dye 83 was prepared by thoroughly mixing 1 g of Dye 83, 200 ml of an aqueous dispersion of titanium oxide (solid concentration: 5%, average grain size: 30 nm), 0.1 g of gelatin (containing 30 ppm of calcium ion) and 2,041 ml of distilled water by means of a high-speed stirrer (Multi Disperser PB95, round blade type, made by SMT Co., Ltd.).

For comparison, another aqueous slurry was also prepared in the same manner as described above, except that the aqueous dispersion of titanium oxide was replaced by distilled water. These two types of slurry were put in separate test tubes, and solid matters were separated therefrom by use of a centrifuge. As a result, the supernatant of the titanium oxide-free slurry was left colored, while the supernatant of the titaniumoxide-added slurry became colorless and a colored solid precipitate was visually recognized. Thus the dye was judged as being carried by titanium oxide.

The centrifuge used was Himac CR22, made by Hitachi Ltd., and the centrifugation was performed for 120 minutes under 20,000 r.p.m. (equivalent to 48,000 G).

Next 2,250 g of a 10% aqueous gelatin solution was added to the aqueous slurry of Dye 83 with stirring, and the stirring for mixing them was further continued for 30 minutes at 40° C. The thus obtained gelatin dispersion of Dye 83 was passed through a polypropylene filter having an effective pore diameter of 3μ, thereby obtaining Dye Dispersion 104. The dispersion was stored at a temperature of 10° C. or below in the dark to be made into a jellied solid matter, and put to practical use.

<Preparation of Dye-Carried Fine-Grain Emulsions 105 and 106>

(1) Preparation of Fine-Grain Emulsion 105:

A mixing container used in this example was an airtight cylindrical container having an inner volume of 8 ml. And stirring blades capable of rotating at a high speed in directions opposite to each other were installed at the inside top and bottom of the container, respectively.

A solution having the following composition was fed into the mixing container, and vigorously stirred with the blades rotating at the intended number of revolutions to quickly prepare a homogeneous mixture. In this manner, a fine-grain silver halide emulsion was made.

More specifically, the number of revolutions inside the container was set at 2,000 r.p.m., and a 0.1N aqueous solution of silver nitrate and a 0.1N aqueous solution of sodium chloride were added to the container at feeding speeds of 125 ml/min and 150 ml/min, respectively, thereby making an emulsion. In the aqueous solution of sodium chloride, low molecular weight gelatin having an average molecular weight of 30,000 or below was contained as protective colloid in a proportion of 25 g per 1,000 ml of the aqueous solution.

After staying for about 2 seconds in the mixing container, the emulsion was discharged immediately from the container and added to the methanol solution of Dye 83. The methanol solution of Dye 83 had a concentration of 0.0017 mole/l and a volume of 3,000 ml. The emulsion was added to the methanol solution over a period of 10 minutes.

As a result of adsorption of the dye to the fine-grain surface of silver halide and coagulation of gelatin in the methanol solution, the emulsion caused sedimentation. After the emulsion was allowed to stand until the sedimentation was completed, the supernatant was decanted to remove excessive water-soluble salts and the resulting emulsion was concentrated.

The concentrated emulsion was dispersed again into water. Thus, a fine-grain silver halide Emulsion 105 containing 45 g of silver per 1,000 g of the emulsion was obtained. The average particle size of these fine grains was 0.021 μm.

(2) Preparation of Fine-Grain Emulsion 106:

A fine-grain Emulsion 106 was prepared in the same manner as the fine-grain Emulsion 105.

However, an aqueous solution of potassium bromide-potassium iodide mixture was used in place of the aqueous solution of sodium chloride and the mixing proportion between the bromide and the iodide was adjusted so that the halide composition of fine grains prepared was iodobromide having a bromide/iodide ratio of 95/5 by mole. In addition, the methanol solution of Dye 83 to which the emulsion made in the mixing container was added was the same methanol solution of Dye 83 as used in the preparation of fine grain Emulsion 105. The particle size of fine grains was 0.160 μm.

<Production of PET Support>

PET having intrinsic viscosity (IV) of 0.66 (as measured in a 6:4 (weight ratio) mixture of phenol and tetrachloroethane at 25° C.) was produced using terephthalic acid and ethylene glycol in a usual manner. The PET obtained was shaped into pellets, dried at 130° C. for 4 hours, and then molten at 300° C. Then, it was extruded from a T die and quenched, thereby forming a unstretched film having such a thickness as to provide a thickness of 175 μm after thermal setting.

The film was stretched to 3.3 times its original length by means of rollers differing in peripheral speed, and then stretched on a tenter to 4.5 times its original width. The temperatures during these stretching operations were 110° C. and 130° C., respectively. Thereafter, the film was thermally set at 240° C. for 20 seconds and further, under the same temperature, subjected to 4% relaxation in a lateral direction. Then, the part corresponding to the tenter's chuck was slit off, and the both sides underwent knurl processing. The thus processed film was wound under a tension of 4 kg/cm$^2$ to form a roll of 175 μm-thick film.

<Surface Corona Processing>

By means of a solid-state corona processor, Model 6 KVA, made by Pillar Technologies, both surfaces of the support was processed at a rate of 20 m/min at room temperature. From the readout numbers of current and voltage under the operation, the processing the support underwent was calculated to be 0.375 kV·A·min/m$^2$. The processing frequency and the gap clearance between the electrode and the dielectric roll under the operation were 9.6 kHz and 1.6 mm., respectively.

<Production of Support with Undercoat Layer>

(1) Preparation of Coating Composition for Undercoat Layer:

Formula (i) (for undercoat layer on photosensitive layer side):

| | |
|---|---|
| Pesresin A-515GB produced by TAKAMATSU OIL & FAT CO., LTD. (30 wt % solution) | 234 g |
| Polyethylene glycol monononyl phenyl ether (average number of ethylene oxide units = 8.5, 10 wt % solution) | 21.5 g |
| MP-1000, produced by Soken Chemical & Engineering Co., Ltd. (particulate polymer with an average particle size of 0.4 μm) | 0.91 g |
| Distilled water | 744 ml |
| Formula (ii) (for first layer on back side): | |
| Styrene-butadiene copolymer latex (solid content = 40 wt %, styrene/butadiene = 68/32 by weight) | 158 g |
| Sodium salt of 2,4-dichloro-6-hydroxy-s-triazine (8 wt % aqueous solution) | 20 g |
| Sodium laurylbenzenesulfonate (1 wt % aqueous solution) | 10 ml |
| Distilled water | 854 ml |
| Formula (iii) (for second layer on back side): | |
| $SnO_2$/SbO (9/1 by weight, average grain size 0.038 μm, 17 wt % dispersion) | 84 g |
| Gelatin (10 wt % aqueous solution) | 89.2 g |
| Metolose TC-5 produced by Shin-Etsu Chemical Co., Ltd. (2 wt % aqueous solution) | 8.6 g |
| MP-1000 produced by Soken Chemical & Engineering Co., Ltd. | 0.01 g |
| 1 wt % Aqueous solution of sodium dodecyl-benzenesulfonate | 10 ml |
| NaOH (1 wt %) | 6 ml |
| Proxel (produced by Imperial Chemical Industries PLC) | 1 ml |
| Distilled water | 805 ml |

(2) Production of Support with Undercoat Layer:

After the corona discharge processing described above, the biaxially stretched 175 μm-thick polyethylene terephthalate support was coated on one side (photosensitive layer side) with the undercoating composition of formula (i) at a wet coverage of 6.6 ml/m$^2$ (per side) by means of a wire bar, and dried at 180° C. for 5 minutes. Subsequently thereto, the support was coated on the other side (back side) with the undercoating composition of formula (ii) at a wet coverage of 5.7 ml/m$^2$ by means of a wire bar, and dried at 180° C. for 5 minutes, and further thereon with the undercoating composition of formula (iii) at a wet coverage of 7.7 ml/m$^2$ by means of a wire bar, and dried at 180° C. for 6 minutes. Thus, the support provided with the undercoat layers was produced.

<Preparation of Coating Composition-1 for Anti-Halation Layer>

A vessel was kept at 40° C., and therein were admixed the following ingredients to prepare a coating composition-1 for the back side.

| | |
|---|---|
| 1. Gelatin (Ca ion content: 30 ppm) | 54 g |
| 2. Dye dispersion set forth in Table 1 (dye solid basis) | 0.8 g |
| 3. Benzisothiazolinone | 31 mg |

-continued

| | |
|---|---|
| 4. Fine particles of polymethyl methacrylate (average particle size: 8 μm, standard deviation of particle sizes: 0.4) | 1.65 g |
| 5. Sodium polystyrenesulfonate | 0.36 g |
| 6. Copolymer of acrylic acid and ethyl acrylate (copolymerization ratio = 5/95 by weight) | 8.2 g |
| 7. N,N'-ethylenebis(vinylsulfonacetamide) | 2.96 g |
| 8. Sodium hydroxide (on a solid basis) | 0.37 g |

9. Water (added to make the total amount 1,350 ml)

<Preparation of Coating Composition-1 for Protective Layer on Back Side>

In a vessel kept at 40° C. was prepared a coating composition-1 for a protective layer on the back side by mixing the following ingredients:

| | |
|---|---|
| 1. Gelatin (Ca ion content: 30 ppm) | 133 g |
| 2. sodium polystyrenesulfonate | 0.45 g |
| 3. Benzisothiazolinone | 0.19 g |
| 4. Aerosol-OT (produced by American Cyanamid Co.) | 1.0 g |
| 5. Fluorine-containing surfactant (F-2: polyethylene glycol mono (N-perfluoro-octylsulfonyl-N-propyl-2-aminoethyl) ether (average polymerization degree of ethylene oxide: 15)) | 0.84 g |
| 6. Copolymer of acrylic acid and ethyl acrylate (copolymerization ratio = 5/95 by weight) | 20 g |
| 7. Liquid paraffin emulsion (on a liquid paraffin basis) | 10.7 g |
| 8. Sodium hydroxide (on a solid basis) | 0.21 g |
| 9. Water (added to make the total amount 2,000 ml) | |

<<Production of Supports A1 to A6 Provided with Backing>>

On the back side of the support provided with the undercoat layers, the coating composition-1 for an anti-halation layer was coated so as to have a gelatin coverage of 0.70 g/m$^2$ and the coating composition-1 for the back protective layer so as to have a gelatin coverage of 0.79 g/m$^2$ in accordance with a simultaneous double coating method, and then dried to prepare a back layer.

The following were coating and drying conditions adopted.

The coating operation was carried out at a speed of 160 m/min, the clearance between the tip of the coating die and the support was chosen from the range of 0.10 to 0.30 mm, and the pressure of the vacuum chamber was controlled so as to be from 196 to 882 Pa lower than atmospheric pressure. Prior to coating, static charge of the support was eliminated by ion wind.

In a chilling zone subsequent to the coating zone, the air having a dry-bulb temperature of 10–20° C. was made to blow against the coated layers to effect chilling. Thereafter, the support with the coated layers was conveyed in a contact-free condition, and dried by blowing drying air having a dry-bulb temperature of 23–45° C. and a wet-bulb temperature of 15–21° C. by use of a helical non-contact dryer.

After the drying, the coated layers underwent moisture adjustment at 25° C. under humidity of 40–60% RH, and then heated up to 70–90° C., followed by cooling to 25° C.

COMPARATIVE EXAMPLE 1

(Production of Support A7 Provided with Backing)

A support A7 provided with a backing layer was produced in the same manner as in Example 1, except that the dye dispersion used in preparation of the coating composition-1 for the anti-halation layer, which is set forth in Table 1, was replaced by a dye dispersion 151 described below and the dye dispersion 151 was added in such an amount that the absorbance at 655 nm became 0.3 on the back side.

<Preparation of Dye Dispersion 151>

In 305 ml of distilled water were mixed 9.6 g of Cyanine Dye Compound-1 (the structural formula of which is illustrated hereinafter) (the same as Cyanine Dye Compound (16) disclosed in JP-A-11-352626) and 5.8 g of sodium p-alkylbenzenesulfonate. The mixture obtained was subjected to beads dispersion by means of a sand mill (¼ Gallon sand grinder mill, made by AIMEX Co., Ltd.) to prepare a dye Dispersion 151 having an average grain size of 0.2 μm.

(Production of Support A8 Provided with Backing)

<Preparation of Solid Particulate Dispersion (a) of Base Precursor>

Distilled water was admixed with 1.5 kg of a base precursor Compound-1 (the structural formula of which is illustrated hereinafter), 225 g of a surfactant (DEMOL N, trade name, a product of Kao Corporation), 375 g of diphenylsulfone and 15 g of methyl p-hydroxybenzoate (Mekkins M, trade name, a product of Ueno Pharmaceutical Co., Ltd.). The distilled water was used in an amount to make the total amount of the resulting liquid admixture 5.0 kg. The admixture obtained was subjected to beads dispersion by means of a horizontal sand mill (Model UVM-2, made by AIMEX Co., Ltd.). More specifically, the admixture was fed into the sand mill UVM-2 packed with zirconia beads having an average diameter of 0.5 mm by means of a diaphragm pump, and underwent a dispersing operation under an inner pressure of at least 50 hPa until the desired average grain size was attained.

While making spectral absorption measurements during the dispersing operation, the operation was continued until the dispersion prepared came to have an absorbance ratio of at least 2.2 between the spectral absorption at 450 nm and that at 650 nm (D450/D650). The thus obtained dispersion was diluted with distilled water so as to have a base precursor concentration of 20 weight %, and filtrated for removal of dusts (by means of a polypropylene filter having an average pore size of 3 μm), and then put to practical use.

<Preparation of Coating Composition-2 for Anti-Halation Layer>

A vessel was kept at 40° C., and therein were admixed the following ingredients to prepare a coating composition-2 for the back sides.

| | |
|---|---|
| 1. Gelatin (Ca ion content: 30 ppm) | 1,000 g |
| 2. Dye dispersion 151 | 1,180 g |
| 3. Benzisothiazolinone | 2.54 g |
| 4. Fine particles of polymethyl methacrylate (average particle size: 8 μm, standard deviation of particle sizes: 0.4) | 91 g |
| 5. sodium polystyrenesulfonate | 19.6 g |
| 6. Copolymer of acrylic acid and ethyl acrylate (copolymerization ratio = 5/95 by weight) | 275.2 g |

-continued

| | |
|---|---|
| 7. Solid particulate Dispersion (a) of base precursor | 2,460 g |
| 8. Sodium hydroxide (solid basis) | 2.9 g |
| 9. Polyacrylamide | 815.4 g |

Distilled water was added to make the total amount of the coating composition 27,277 ml.

<Preparation of Coating Composition-2 for Protective Layer on Back Side>

In a vessel kept at 40° C. was prepared a coating composition-2 for a protective layer on the back side by mixing the following ingredients:

| | |
|---|---|
| 1. Gelatin (Ca ion content: 30 ppm) | 1,000 g |
| 2. Sodium polystyrenesulfonate | 6.75 g |
| 3. Benzisothiazolinone | 0.815 g |
| 4. Aerosol-OT (produced by American Cyanamid Co.) | 12.5 g |
| 5. Fluorine-containing surfactant (F-2: polyethylene glycol mono(N-perfluoro-octylsulfonyl-N-propyl-2-aminoethyl) ether (average polymerization degree of ethylene oxide: 15)) | 2.96 g |
| 6. Copolymer of acrylic acid and ethyl acrylate (copolymerization ratio = 5/95 by weight) | 150 g |
| 7. Liquid paraffin emulsion (liquid paraffin basis) | 37.5 g |
| 8. Sodium hydroxide (solid basis) | 6.8 g |

Distilled water was added to make the total amount of the composition 25,006 ml.

On the back side of the support provided with the undercoat layers, the coating composition-2 for an anti-halation layer was coated so as to have a gelatin coverage of 0.44 g/m$^2$ and the coating composition-2 for the back protective layer so as to have a gelatin coverage of 1.70 g/m$^2$ in accordance with a simultaneous double coating method, and then dried to prepare a backing. The coating and drying conditions adopted therein were the same as described above.

The mattness of the thus produced support with backing was 130 seconds on the backing side in terms of Bekk smoothness. In the foregoing manners, the backing-provided Supports A1 to A8 were produced.

The thus produced backing-provided Supports A1 to A8 were each evaluated as follows.

(Evaluation of Coloration)

Modifications were made on the heat-development section of Fuji Medical Dry Laser Imager FM-DPL so as to meet the intended experiments, and each of the backing-provided Supports A1 to A8 thus produced was subjected to heat development without undergoing any exposure (under conditions that 4 built-in panel heaters were set at 109° C., 116° C., 118° C. and 118° C., respectively, and the total heat-development time was adjusted to 14 seconds). The coloration caused in each support sample was evaluated by visual observation. More specifically, the heat-developed samples were placed on a standard light box, and evaluated the coloration degree by visual observation in comparison with the backing-free support.

(Criterion for Visual Evaluation)

Excellent: Coloration is not observed at all.

Good: Slight coloration is observed but a good feeling is generated thereby.

Bad: Coloration is readily recognized.

(Storage Stability Evaluation)

The backing-provided Supports A1 to A8 thus produced were stored for 3 days under a high temperature (50° C.)-high humidity (70% RH) condition, and examined for absorbance at 660 nm before and after the storage. The dye remaining rate given by the following expression was calculated from the measurement results of the absorbance before the storage (Db) and the absorbance after the storage (Da), and adopted as a barometer of storage stability:

$$100\times(Da)/(Db)$$

The above-defined value nearer 100 means that the dye incorporated in the backing has the higher storage stability. Results obtained are shown in Table 1.

TABLE 1

| Backing-Provided Support | Dye Dispersion | Coloration Evaluation by Visual Observation | Storage Stability | Note |
|---|---|---|---|---|
| A1 | 101 | Good | 99 | Invention |
| A2 | 102 | Good | 99 | Invention |
| A3 | 103 | Good | 99 | Invention |
| A4 | 104 | Good | 99 | Invention |
| A5 | 105 | Good | 99 | Invention |
| A6 | 106 | Good | 99 | Invention |
| A7 | 151 | Bad | 70 | Comparison |
| A8 | — | Good | 80 | Comparison |

As can be seen from these results, the supports with the backing using the present dye caused slight coloration and had excellent storage stability.

EXAMPLE 2

(Preparation of Silver Halide Emulsion)

<<Preparation of Silver Halide Emulsion 1>>

A solution prepared by adding 3.1 ml of a 1 wt % potassium bromide solution to 1,421 ml of distilled water and then adding thereto 3.5 ml of diluted sulfuric acid having a concentration of 0.5 mole/L and 31.7 g of phthalated gelatin was placed in a reaction pot made of stainless steel, and kept at 30° C. with stirring. Thereto, Solution A prepared by diluting 22.22 g of silver nitrate to 95.4 ml with distilled water and Solution B prepared by diluting 15.3 g of potassium bromide and 0.8 g of potassium iodide to 97.4 ml with distilled water were added at constant flow rates in their entirety over a 45-second period. Thereafter, 10 ml of a 3.5 wt % aqueous solution of hydrogen peroxide was further added, followed by addition of 10.8 ml of a 10 wt % aqueous solution of benzimidazole. Furthermore, Solution C prepared by diluting 51.86 g of silver nitrate to 317.5 ml with distilled water and Solution D prepared by diluting 44.2 g of potassium bromide and 2.2 g of potassium iodide to 400 ml with distilled water were added in a manner that the total amount of Solution C was added at a constant flow rate over a 20-minute period and Solution D was added in accordance with a controlled double jet method while keeping the pAg of the resultant mixture at 8.1. After a 10-minute lapse from the start of the addition of Solutions C and D, potassium hexachloroiridate (III) in an amount of $1\times10^{-4}$ mole per mole of silver was further added at once. In addition, after a 5-second lapse from the addition end of Solution C, an aqueous solution of potassium iron (II) hexacyanide in an amount of $3\times10^{-4}$ mole per mole of silver was added at once. The pH of the resultant reaction mixture was adjusted to 3.8 by the use of diluted sulfuric acid having a concentration of 0.5 mole/L. At this point the reaction mixture ceased to be stirred, and it was subjected successively to precipitation, desalting and washing operations. In addition, the pH adjustment to 5.9 was carried out by addition of an aqueous solution of NaOH having a concentration of 1 mole/L. Thus, a silver halide dispersion having a pAg value of 8.0 was prepared.

The-silver halide dispersion was kept at 38° C. with stirring and admixed with 5 ml of a 0.34 wt % methanol solution of 1,2-benzisothiazoline-3-one, After a lapse of 40 minutes, the resulting dispersion was admixed with a methanol solution containing a 1:1 by mole mixture of Spectral Sensitizing Dyes A and B (structural formulae of which are illustrated hereinafter). The total amount of the sensitizing dyes added was $1.2\times10^{-3}$ mole per mole of silver. After a 1-miture lapse, the temperature of the dispersion was raised to 47° C. After a 20-minute lapse from the temperature raise, sodium benzenethiosulfonate in an amount of $7.6\times10^{-5}$ mole/mole silver was added as a methanol solution. After a further lapse of 5 minutes, tellurium sensitizer C (the structural formula of which is illustrated hereinafter) in an amount of $2.9\times10^{-4}$ mole per mole of silver was added as a methanol solution. The resulting dispersion was ripened for 91 minutes. The thus ripened dispersion was admixed with 1.3 ml of a 0.8 wt % methanol solution of N,N'-dihydroxy-N"-diethylmelamine. After a 4-minute lapse, there to were further added $4.8\times10^{-3}$ mole/mole silver of 5-methyl-2-mercaptobenzimidazole as a methanol solution and $5.4\times10^{-3}$ mole/mole silver of 1-phenyl-2-heptyl-5-mercapto-1,3,4-triazole as a methanol solution. Thus, silver halide Emulsion 1 was obtained.

The grains in the thus prepared silver halide emulsion were silver iodobromide grains containing 3.5 mole % of iodide homogeneously and having an average sphere equivalent diameter of 0.042 μm and a variation coefficient of 20% with respect to sphere equivalent diameter. For determination of such values concerning grain sizes, 1,000 grains were examined with an electron microscope, and the average thereof was calculated. By using Kubelka-Munk method, it was determined that these grains had (100) surfaces in a proportion of 80%.

<<Preparation of Silver Halide Emulsion 2>>

A silver halide Emulsion 2 was prepared in the same manner as the silver halide Emulsion 1, except that the solution temperature at the time of grain formation was changed to 47° C. from 30° C., the preparation of Solution B was changed to dilution of 15.9 g of potassium bromide to a volume of 97.4 ml with distilled water, the preparation of Solution D was changed to dilution of 45.8 g of potassium bromide to a volume of 400 ml with distilled water and the addition of potassium iron (II) hexcyanide was omitted. Similarly to the preparation of the silver halide Emulsion 1, precipitating, desalting, washing and dispersing operations were carried out successively. Further, spectral sensitization and chemical sensitization were performed in the same way as in Emulsion 1, except that the addition amount of the methanol solution containing a 1:1 by mole mixture of spectral sensitizing Dyes A and B was changed to $7.5\times10^{-4}$ mole per mole silver in terms of the total amount of the sensitizing Dyes A and B, the amount of the tellurium Sensitizer C was changed to $1.1\times10^{-4}$ mole per mole silver and the addition amount of 1-phenyl-2-heptyl-5-mercapto-1,3,4-triazole was changed to $3.3\times10^{-3}$ mole per mole silver. The thus obtained emulsion grains of silver halide Emulsion 2 were cubic grains of pure silver bromide having an average sphere equivalent diameter of 0.080 μm and a variation coefficient of 20% with respect to the sphere equivalent diameter.

Preparation of Silver Halide Emulsion 3>>

A silver halide Emulsion 3 was prepared in the same manner as the silver halide Emulsion 1, except that the solution temperature at the time of grain formation was changed to 27° C. from 30° C. Similarly to the preparation of the silver halide Emulsion 1, precipitating, desalting, washing and dispersing operations were carried out successively. Further, spectral sensitization and chemical sensitization were performed in the same way as in Emulsion 1, except that a solid dispersion containing spectral sensitizing Dyes A and B in a ratio of 1:1 by mole was added as an aqueous gelatin solution in an amount of $6\times10^{-3}$ mole per mole silver in terms of the total amount of the sensitizing Dyes A and B, and besides, the amount of the tellurium Sensitizer C was changed to $5.2\times10^{-4}$ mole per mole silver. The thus obtained emulsion grains of silver halide Emulsion 3 were silver iodobromide grains containing 3.5 mole % iodide homogeneously and having an average sphere equivalent diameter of 0.034 μm and a variation coefficient of 20% with respect to sphere equivalent diameter.

<<Preparation of Mixed Emulsion A for Coating Composition>>

The silver halide Emulsions 1, 2 and 3 were dissolved in a ratio of 70:15:15 by weight, and thereto was added a 1 wt % aqueous solution of benzothiazolium iodide in a proportion of $7\times10^{-3}$ mole per mole silver. Further, water was added thereto in an amount that the silver halide content became 38.2 g per kg of an mixed emulsion for a coating composition.

<<Preparation of Dispersion of Silver Salt of Fatty Acid>>

Behenic acid (Edenor $C_{22}$-85R, trade name, a product of Henkel Co.) in an amount of 87.6 kg was mixed with 423 L of distilled water, 49.2 L of an aqueous solution containing NaOH in a concentration of 5 mole/L and 120 L of tert-butanol, and stirred for one hour at 75° C. to prepare a sodium behenate solution. Separately, 206.2 L of an aqueous solution (pH 4.0) containing 40.4 kg of silver nitrate was prepared, and kept at 10° C. A reaction vessel in which 635 L of distilled water and 30 L of tert-butanol were placed was kept at 30° C. with vigorous stirring, and thereto the total amount of the foregoing sodium behenate solution and the total amount of the foregoing silver nitrate solution were added at their individual constant flow rates over a period of 93 minutes and 15 seconds and a period of 90 minutes, respectively. More specifically, these two solutions were added in the following manner: The aqueous solution of silver nitrate alone was added for a period from the beginning of addition to a lapse of 11 minutes, then the sodium behenate solution began to be added, and further the addition of the sodium behenate solution alone was continued for a period of 14 minutes and 15 seconds after finishing the addition of aqueous silver nitrate solution. During the addition, the temperature inside the reaction vessel was maintained at 30° C. by controlling externally so that the mixed solution temperature was kept constant. The jacketed pipe laid for feeding the sodium behenate solution was kept warm by circulating hot water through the outer part thereof, and the solution temperature at the exit of the addition nozzle tip was regulated at 75° C. As to the jacketed pipe laid for feeding the aqueous silver nitrate solution, the solution temperature was kept constant by circulating cold water through the outer part of the pipe. The nozzle tip from which the sodium behenate solution was fed and that from which the aqueous silver nitrate solution was fed were arranged symmetrically about the stirring axis, and situated above the reaction solution so as to avoid the contact of those solutions with the reaction solution.

After the addition of the sodium behenate solution was completed, the reaction solution was stirred for 20 minutes as the temperature thereof was kept unchanged, and then the solution temperature was raised to 35° C. over a 30-minute period. And the resulting solution was ripened for 210 minutes. Immediately after the completion of ripening, the solid matter in the ripened solution was filtered off by centrifugal filtration, and washed with water till the filtrated water came to have a conductivity of 30 μS/cm. Thus, the silver salt of fatty acid was obtained. The solid matter obtained was stored as wet cake without undergoing any drying treatment.

The form of the thus produced silver behenate grains was evaluated by electron micrography. As a result, the grains were found to have the crystal shape of scales, specifically with, on average, a=0.14 μm, b=0.4 μm and c=0.6 μm, an average aspect ratio of 5, an average sphere equivalent diameter of 0.52 μm and a variation coefficient of 15% with respect to the sphere equivalent diameter (wherein a, b and c have the same meaning as defined hereinbefore, respectively).

To the wet cake in the amount corresponding to 260 kg on a dry solids basis, 19.3 kg of polyvinyl alcohol (PVA-217, trade name, a product of Kuraray Co. Ltd.) was added. Further, water was added thereto in the amount to adjust the total weight of the resultant mixture to 1,000 kg, and the mixture was made into slurry with dissolver blades and preliminary dispersed with a pipeline mixer (Model PM-10, made by MIZUHO INDUSTRIAL CO., LTD.)

The thus preliminarily dispersed solution was processed three times by using a dispersing machine, Microfluidizer M-610 (trade name, a product of Microfluidex International Corporation, wherein Z-type interaction chamber was used), under the pressure adjusted to 1260 kg/cm$^2$, thereby preparing a dispersion of silver behenate. The dispersion temperature was set at 18° C. by mounting coiled heat exchangers on the front and the rear of interaction chamber respectively, and controlling the temperature of the coolant used therein.

(Preparation of Reducing Agent Dispersion)

<<Preparation of Dispersion of Reducing Agent-2>>

Water in amount of 10 kg was added to and thoroughly mixed with 10 kg of Reducing Agent-2 (6,6'-di-tert-butyl-4,4'-dimethyl-2,2'-butylidenedip ehnol) and 16 kg of a 10 wt % aqueous solution of modified polyvinyl alcohol (Poval MP-203 produced by Kuraray Co., Ltd.), thereby preparing a slurry. The slurry was fed by means of a diaphragm pump into a horizontal sand mill (Model UVM-2, made by AIMEX Co.,Ltd.) packed with zirconia beads having an average diameter of 0.5 mm, and underwent a dispersing operation over a period of 3 hours and 30 minutes, and further adjusted so as to have a reducing agent concentration of 25 wt % by addition of 0.2 g of sodium salt of benzisothiazolinone and water. Thus, a dispersion of Reducing Agent-2 was obtained. The reducing agent particles present in the thus prepared dispersion had a median diameter of 0.40 μm and the maximum diameter of 1.5 μm or below. The dispersion was passed through a polypropylene filter having a pore size of 3.0 μm to eliminate extraneous matter including dust, and then stored.

<<Preparation of Dispersion of Hydrogen Bond-Forming Compound-1>>

To 10 kg of Hydrogen Bond-forming Compound-1 (tri (4-tert-butylphenyl)phosphine oxide) and 16 kg of a 10 wt % aqueous solution of modified polyvinyl alcohol (Poval MP-203 produced by Kuraray Co., Ltd.), 10 kg of water was added and thoroughly mixed therein to prepare a slurry. The slurry was fed by means of a diaphragm pump into a horizontal sand mill (Model UVM-2, made by AIMEX Co., Ltd.) packed with zirconia beads having an average diameter of 0.5 mm, and underwent a dispersing operation over a period of 3 hours and 30 minutes, and further adjusted so as to have a hydrogen bond-forming compound concentration of 25 wt % by addition of 0.2 g of sodium salt of benzisothiazolinone and water. Thus, a dispersion of Hydrogen Bond-Forming Compound-1 was obtained. The hydrogen bond-forming compound particles present in the thus prepared dispersion had a median diameter of 0.35 μm and the maximum diameter of 1.5 μm or below. The dispersion was passed through a polypropylene filter having a pore size of 3.0 μm to eliminate extraneous matter including dust, and then stored.

<<Preparation of Dispersion of Development Accelerator-1>>

To 10 kg of Development Accelerator-1 (the structural formula of which is illustrated hereinafter) and 20 kg of a 10 wt % aqueous solution of modified polyvinyl alcohol (Poval MP-203 produced by Kuraray Co., Ltd.), 10 kg of water was added and thoroughly mixed therein to prepare a slurry. The slurry was fed by means of a diaphragm pump into a horizontal sand mill (Model UVM-2, made by AIMEX Co., Ltd.) packed with zirconia beads having an average diameter of 0.5 mm, and underwent a dispersing operation over a period of 3 hours and 30 minutes, and further adjusted so as to have a development accelerator concentration of 20 wt % by addition of 0.2 g of sodium salt of benzisothiazolinone and water. Thus, a dispersion of Development Accelerator-1 was obtained. The development accelerator particles present in the thus prepared dispersion had a median diameter of 0.48 μm and the maximum diameter of 1.4 μm or below. The dispersion was passed through a polypropylene filter having a pore size of 3.0 μm to eliminate extraneous matter including dust, and then stored.

Solid dispersions of Development Accelerator-2, Development Accelerator-3 and Tone Adjuster-1 (the structural formulae of which are illustrated hereinafter) were each prepared in the same manner as that of Development Accelerator-1. The concentration of each dispersion was 20 wt %.

(Preparation of Polyhalogen Compound Dispersion)

<<Preparation of Dispersion of Organic Polyhalogen Compound 1>>

Ten kilogram of Organic Polyhalogen Compound 1 (tribromomethanesulfonylbenzene), 10 kg of a 20 wt % aqueous solution of modified polyvinyl alcohol (Poval MP-203 produced by Kuraray Co., Ltd.), 0.4 kg of a 20 wt % aqueous solution of sodium triisopropylnaphthalenesulfonate and 14 kg of water were thoroughly mixed together to prepare a slurry. The slurry was fed by means of a diaphragm pump into a horizontal sand mill (Model UVM-2, made by AIMEX Co., Ltd.) packed with zirconia beads having an average diameter of 0.5 mm, and subjected to a dispersing operation over a period of 5 hours, and further adjusted so as to have an organic polyhalogen compound concentration of 26 wt % by addition of 0.2 g of sodium salt of benzisothiazolinone and water. Thus, a dispersion of Organic Polyhalogen Compound 1 was obtained. The organic polyhalogen compound particles present in the thus prepared dispersion had a median diameter of 0.41 μm and the maximum diameter of 2.0 μm or below. The dispersion was passed through a polypropylene filter having a pore size of 10.0 μm to eliminate extraneous matter including dust, and then stored.

<<Preparation of Dispersion of Organic Polyhalogen Compound 2>>

Ten kilogram of Organic Polyhalogen Compound 2 (N-butyl-3-tribromomethanesulfonylbenzamide), 20 kg of a 10 wt % aqueous solution of modified polyvinyl alcohol (Poval MP-203 produced by Kuraray Co., Ltd.) and 0.4 kg of a 20 wt % aqueous solution of sodium triisopropylnaphthalenesulfonate were thoroughly mixed together to prepare a slurry. The slurry was fed by means of a diaphragm pump into a horizontal sand mill (Model UVM-2, made by AIMEX Co., Ltd.) packed with zirconia beads having an average diameter of 0.5 mm, and subjected to a dispersing operation over a period of 5 hours, and further adjusted so as to have an organic polyhalogen compound concentration of 30 wt % by addition of 0.2 g of sodium salt of benzisothiazolinone and water. The dispersion obtained was heated at 40° C. for 5 hours. Thus, a dispersion of Organic Polyhalogen Compound 2 was obtained. The organic polyhalogen compound particles present in the thus prepared dispersion had a median diameter of 0.40 μm and the maximum diameter of 1.3 μm or below. The dispersion was passed through a polypropylene filter having a pore size of 3.0 μm to eliminate extraneous matter including dust, and then stored.

<<Preparation of Solution of Phthalazine Compound-1>>

In 174.57 kg of water, 8 kg of modified polyvinyl alcohol (Poval MP-203 produced by Kuraray Co., Ltd.) was dissolved. Thereto were added 3.15 kg of a 20 wt % aqueous solution of sodium triisopropylnaphthalenesulfonate and 14.28 kg of a 70 wt % aqueous solution of Phthalazine Compound-1 (6-isopropylphthalazine). Thus, a 5 wt % solution of Phtahalzine Compound-1 was prepared.

(Preparation of Solution of Mercapto Compound)

<<Preparation of Aqueous Solution of Mercapto Compound-2>>

Mercapto Compound-2 (sodium salt of 1-(3-methylureido)-5-mercaptotetrazole) in an amount of 20 g was dissolved in 980 g of water to-prepare a 2.0 wt % aqueous solution.

<<Preparation of Dispersion of Pigment-1>>

To wet cake of C.I. Pigment Blue 60 (Pigment-1) in an amount of 24 g on a solid basis and 2.4 g of Demol N produced by Kao Corporation, water was added and thereby the total amount was made 400 g. These ingredients were fully mixed and formed into slurry. The slurry thus obtained and 800 g of zirconia beads having an average diameter of 0.5 mm were put in a vessel, and dispersed for 10 minutes by means of a dispersing machine (¼ G sand grinder mill made by AIMEX Co., Ltd.). Thus, a dispersion of Pigment-1 was prepared. The pigment particles in the pigment dispersion thus obtained had an average particle size of 0.21 μm.

<<Preparation of SBR Latex>>

A latex of SBR having Tg of 22° C. was prepared in the following manner.

Emulsion polymerization of 70 parts by weight of styrene, 27.0 parts by weight of butadiene and 3.0 parts by weight of acrylic acid was performed in the presence of ammonium persulfate as a polymerization initiator and an anionic surfactant as an emulsifier, followed by aging at 80° C. for 8 hours. Then, the polymerization product was cooled to 40° C. and adjusted to pH 7.0 by use of aqueous ammonia. Thereto, SANDET BL produced by Sanyo Chemical Industries, Ltd. was added in an amount to reach a content of 0.22%. Next the pH of the resultant matter was adjusted to 8.3 by addition of a 5% 8-hours solution of sodium hydroxide, and further to 8.4 by use of aqueous ammonia. The ratio of sodium ion to ammonium ion used in this pH adjustment was 1:2.3 by mole. Then 0.15 ml of a 7% aqueous solution of sodium salt of benzisothiazolinone was added per kg of the mixture, thereby obtaining a SBR latex. The thus obtained SBR latex had the following characteristics.

(SBR latex: Latex of -St(70.0)-Bu(27.0)-AA(3.0)-)

Tg: 22° C., average particle size: 0.1 μm, concentration: 43 wt %, equilibrium water content at 25° C.-60% RH: 0.6 wt %, ionic conductivity of undiluted latex (43 wt %): 4.2 mS/cm (measured at 25° C. with a conducto meter, Model CM-30S, made by DKK-TOA CORPORATION), pH: 8.4

SBR latices having different Tg values can be prepared in a similar manner described above by appropriately varying the ratio of styrene to butadiene.

<<Preparation of Coating Composition-1 for Emulsion Layer (Photosensitive Layer)>>

To 1,000 g of the dispersion of silver salt of fatty acid were added successively 309 ml of water, 21 g of the dispersion of Organic Polyhalogen Compound 1, 58 g of the dispersion of Organic Polyhalogen Compound 2, 173 g of the solution of Phthalazine Compound-1, 1,082 g of the SBR latex (Tg: 22° C.), 155 g of the dispersion of Reducing Agent-2, 55 g of the dispersion of Hydrogen Bond-Forming Compound-1, 6 g of the dispersion of Development Accelerator-1, 2 g of the dispersion of Development Accelerator-2, 3 g of the dispersion of Development Accelerator-3, 2 g of the dispersion of Tone Adjuster-1 and 6 ml of the aqueous solution of Mercapto Compound-2. Thereto, 117 g of the silver halide mixed Emulsion A was added just before coating, and mixed thoroughly. A coating composition thus prepared for an emulsion layer was fed into a coating die without delay, and underwent coating operation.

The viscosity of the coating composition was 39 [mPa·s], as measured at 40° C. (No.1 rotor, 60 rpm) with a Brookfield type viscometer made by Tokyo Keiki Kogyo.

Further, the coating composition had viscosity values of 530, 140, 95, 49 and 28 [mpa·s] as measured at 25° C. under shear rates of 0.1, 1, 10, 100 and 1,000 [1/sec], respectively, by means of RFS Fluid Spectrometer made by Rheometrics Fareast Co. Ltd.

The content of zirconium in the coating composition was 0.38 mg per g of silver.

<<Preparation of Coating Composition-2 for Emulsion Layer (Photosensitive Layer)>>

To 1,000 g of the dispersion of silver salt of fatty acid were added successively 276 ml of water, 32.8 g of the dispersion of Pigment-1, 21 g of the dispersion of Organic Polyhalogen Compound 1, 58 g of the dispersion of Organic Polyhalogen Compound 2, 173 g of the solution of Phthalazine Compound-1, 1,082 g of the SBR latex (Tg:20° C.), 155 g of the dispersion of Reducing Agent-2, 55 g of the dispersion of Hydrogen Bond-Forming Compound-1, 6 g of the dispersion of Development Accelerator-1, 2 g of the dispersion of Development Accelerator-2, 3 g of the dispersion of Development Accelerator-3, 2 g of the dispersion of Tone Adjuster-1 and 6 ml of the aqueous solution of Mercapto Compound-2. Thereto, 117 g of the silver halide mixed Emulsion A was added just before coating, and mixed thoroughly. A coating composition thus prepared for an emulsion layer was fed into a coating die without delay, and underwent coating operation.

The viscosity of the coating composition was 40 [mPa·s], as measured at 40° C. (No.1 rotor, 60 rpm) with a Brookfield type viscometer made by Tokyo Keiki Kogyo.

Further, the coating composition had viscosity values of 530, 144, 96, 51 and 28 [mPa·s] as measured at 25° C. under shear rates of 0.1, 1, 10, 100 and 1,000 [1/sec], respectively, by means of RFS Fluid Spectrometer made by Rheometrics Fareast Co. Ltd.

The content of zirconium in the coating composition was 0.25 mg per g of silver.

<<Preparation of Coating Composition for Interlayer on Emulsion Side>>

The coating composition for interlayer was prepared by mixing 1,000 g of polyvinyl alcohol (PVA-205 produced by Kuraray Co., Ltd.), 272 g of a 5 wt % pigment dispersion, 4,200 ml of a 19 wt % latex of methyl methacrylate/styrene/butyl acrylate/hydroxyethyl methacrylate/acrylic acid copolymer (copolymerization ratio: 64/9/20/5/2 by weight), 27 ml of a 5 wt % aqueous solution of Aerosol OT (produced by American Cyanamid Co.) and 135 ml of a 20 wt % aqueous solution of diammonium phthalate, adding thereto water in an amount to make the total amount 10,000 g, and adjusting the pH to 7.5 by addition of NaOH. The composition thus prepared was fed into a coating die to attain a coverage of 9.1 ml/m$^2$.

The viscosity of the coating composition was 58 [mPa·s] at 40° C. (No.1 rotor., 60 rpm) as measured with the Brookfield type viscometer.

<<Preparation of Coating Composition for First Protective Layer on Emulsion Side>>

Inert gelatin in an amount of 64 g was dissolved in water, and thereto were added 80 g of a 27.5 wt % latex of methyl methacrylate/styrene/butyl acrylate/hydroxyethyl methacrylate/acrylic acid copolymer (copolymerization ratio: 64/9/20/5/2 by weight), 23 ml of a 10 wt % methanol solution of phthalic acid, 23 ml of a 10 wt % aqueous solution of 4-methylphthalic acid, 28 ml of diluted sulfuric acid having a concentration of 0.5 mole/L, 5 ml of a 5 wt % aqueous solution of Aerosol OT (American Cyanamid Co.), 0.5 g of phenoxyethanol and 0.1 g of benzoisothiazolinone. Further, water was added thereto in an amount to adjust the total weight of the resultant mixture to 750 g, thereby preparing a coating composition. The composition was mixed with 26 ml of a 4 wt % aqueous solution of chrome alum by means of a static mixer just before coating, and fed into a coating die to attain a coverage of 18.6 ml/m$^2$.

The viscosity of the coating composition was 20 [mPa·s] at 40° C. (No.1 rotor, 60 rpm) as measured with the Brookfield type viscometer.

<<Preparation of Coating Composition for Second Protective Layer on Emulsion Side>>

Inert gelatin in an amount of 80 g was dissolved in water, and thereto were added 102 g of a 27.5 wt % latex of methyl methacrylate/styrene/butyl acrylate/hydroxyethyl methacrylate/acrylic acid copolymer (copolymerization ratio: 64/9/20/5/2 by weight), 3.2 ml of a 5 wt % solution of fluorine-containing surfactant (F-1: potassium salt of N-perfluorooctylsulfonyl-N-propylalanine), 32 ml of a 2 wt % aqueous solution of fluorine-containing surfactant (F-2: polyethylene glycol mono(N-perfluorooctylsulfonyl-N-propyl-2-aminoethyl) ether (average polymerization degree of ethylene oxide=15)), 23 ml of a 5 wt % aqueous solution of Aerosol OT. (American Cyanamid Co.), 4 g of particulate polymethyl methacrylate (average particle size: 0.7 μm), 21 g of particulate polymethyl methacrylate (average particle size: 4.5 μm), 1.6 g of 4-methylphthalic acid, 4.8 g of phthalic acid, 44 ml of diluted sulfuric acid having a concentration of 0.5 mole/L and 10 mg of benzoisothiazolinone. Further, water was added thereto in an amount to adjust the total weight to 650 g and, just before coating, mixed with 445 ml of aqueous solution containing 4 wt % chrome alum and 0.67 wt % phthalic acid by means of a static mixer, thereby preparing a coating composition for second surface protective layer on the emulsion side. The composition was fed into a coating die to attain a coverage of 8.3 ml/m$^2$.

The viscosity of the coating composition was 19 [mPa·s] at 40° C. (No.1 rotor, 60 rpm) as measured with the Brookfield type viscometer.

(Production of Heat-Developable Photosensitive Material)

<<Production of Heat-Developable Photosensitive Materials (Sample Nos. 201 to 208)>>

On the undercoat side opposite to the back side of each of the backing-provided support A1 to A8, the emulsion layer (Coating Composition-2), the interlayer, the first protective layer and the second protective layer were simultaneously coated in the order using a slide beads multiple coating method, thereby producing a sample heat-developable photosensitive material. The temperature of the emulsion layer and the interlayer was adjusted to 31° C., that of the first protective layer to 36° C., and that of the second protective layer to 37° C.

The coverage (g/m$^2$) of each ingredient in the emulsion layer is described below:

| | |
|---|---|
| Silver behenate | 5.27 |
| Pigment (C.I. Pigment Blue 60) | 0.034 |
| Polyhalogen Compound-1 | 0.11 |
| Polyhalogen Compound-2 | 0.35 |
| Phthalazine Compound-1 | 0.18 |
| SBR latex | 9.19 |
| Reducing Agent-2 | 0.77 |
| Hydrogen Bond-Forming Compound-1 | 0.29 |
| Development Accelerator-1 | 0.023 |
| Development Accelerator-2 | 0.0095 |
| Development Accelerator-3 | 0.014 |
| Tone Adjuster-1 | 0.0095 |
| Mercapto Compound-2 | 0.002 |
| Silver halide (based on silver) | 0.086 |

The coating and drying conditions were as follows:

The coating operation was carried out at a speed of 160 m/min, the clearance between the tip of the coating die and the support was chosen from the range of 0.10 to 0.30 mm, and the pressure of the vacuum chamber was controlled so as to be from 196 to 882 Pa lower than atmospheric pressure. Prior to coating, static charge of the support was eliminated by ion wind.

In the chilling zone subsequent to the coating zone, the air having a dry-bulb temperature of 10–20° C. was made to blow against the coated layers to effect the chilling. Thereafter, the support with the coated layers was conveyed in a contact-free condition, and dried by blowing drying air having a dry-bulb temperature of 23–45° C. and a wet-bulb temperature of 15–21° C. by use of a helical non-contact dryer.

After the drying, the coated layers underwent moisture adjustment at 25° C. under humidity of 40–60% RH, and then heated up to 70–90° C., followed by cooling to 25° C.

The mattness of the heat-developable photosensitive material thus produced was 550 seconds on the photosensitive layer side and 130 seconds on the back layer side in terms of Bekk smoothness. The pH of the surface on the photosensitive layer side was found to be 6.0

The coerrespondences between the backing-provided supports and sample heat-developable photosensitive materials are shown in Table 2.

TABLE 2

| Sample No. | Support Provided with Backing | Note |
|---|---|---|
| 201 | A1 | Invention |
| 202 | A2 | Invention |
| 203 | A3 | Invention |
| 204 | A4 | Invention |
| 205 | A5 | Invention |
| 206 | A6 | Invention |
| 207 | A7 | Comparison |
| 208 | A8 | Comparison |

The chemical structures of the compounds used in the example illustrated below.

Spectral Sensitizing Dye A

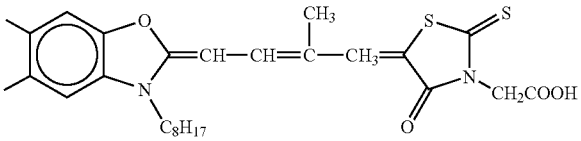

Spectral Sensitizing Dye B

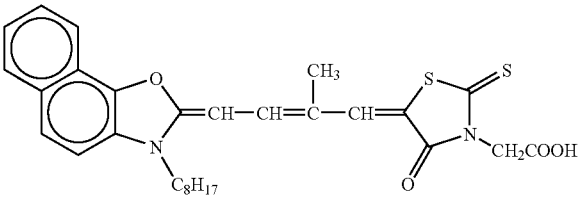

Tellurium Sensitizer C

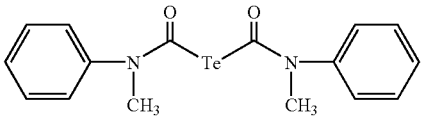

-continued

Base Precursor Compound-1

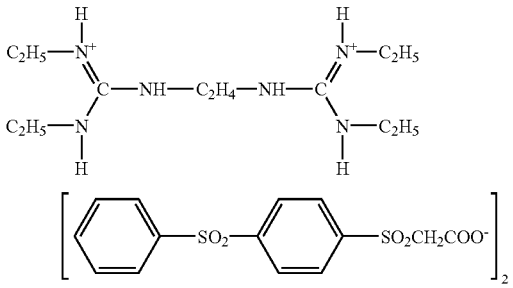

Cyanine Dye Compound-1

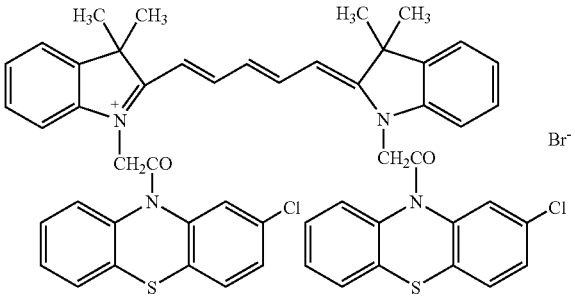

Blue Dye Compound-1

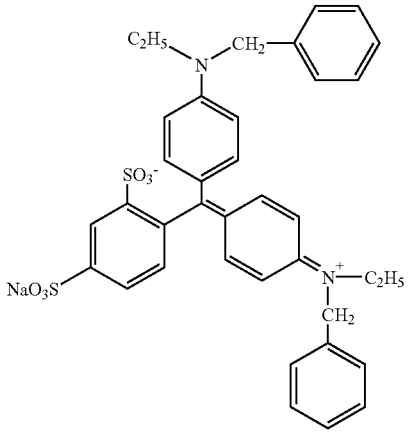

Yellow Dye Compound-1

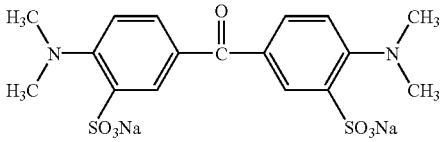

Reducing Agent Complex-1

1:1 Complex of

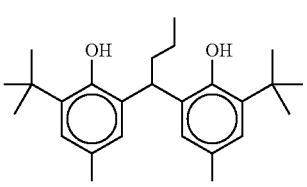

and

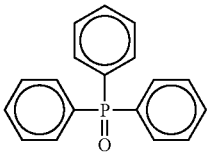

-continued

Reducing Agent-2

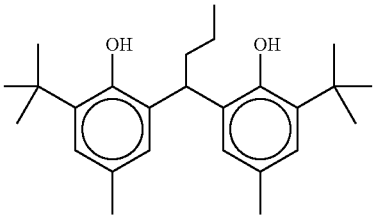

Hydrogen Bond-Forming Compound-1

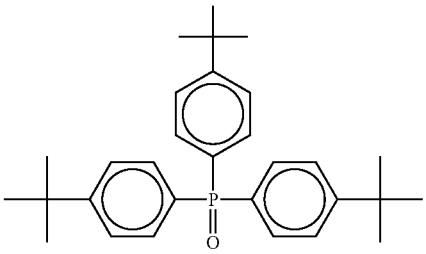

Polyhalogen Compound 1

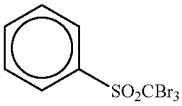

Polyhalogen Compound 2

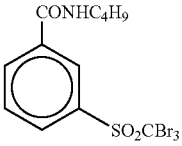

Mercapto Compound-1

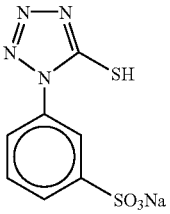

Mercapto Compound-2

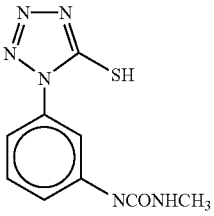

Phthalazine Compound-1

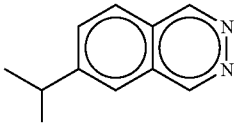

Development Accelerator-1

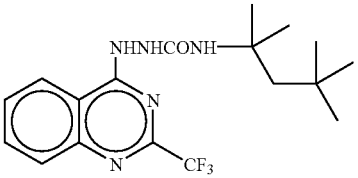

-continued

Development Accelerator-2

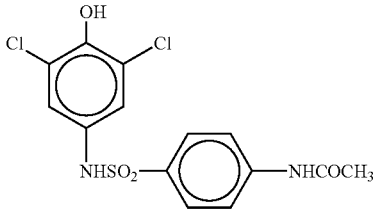

Development Accelerator-3

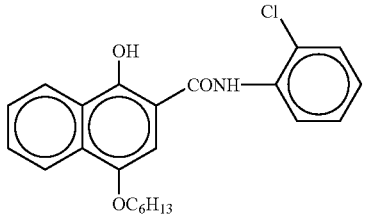

Tone Adjuster-1

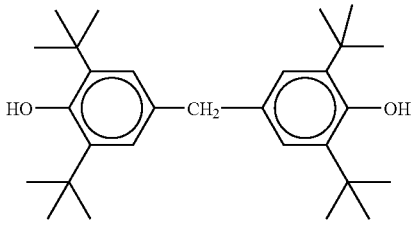

F-1

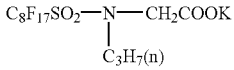

F-2

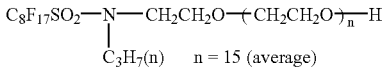

F-3

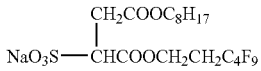

F-4

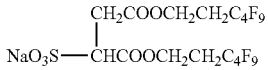

(Evaluation of Photographic Properties)

Each sample material obtained was cut into sheets measuring 356 mm by 432 mm, wrapped in the following wrapping material in surroundings of 25° C. and 50% RH, and stored for 2 weeks at room temperature.

(Wrapping Material)

A laminate of 10 μm-thick PET, 12 μm-thick PE, 9 μm-thick Al, 15 μm-thick Ny and 50 μm-thick polyethylene containing 3% carbon black (oxygen permeability: $2.28\times10^{-3}$ pl/Pa·m$^2$·25° C.·s (0.02 ml/atm·m$^2$·25° C.·day), moisture permeability: $1.14\times10^{-2}$ ng/Pa·m$^2$·25° C.·s (0.10 g/atm·m$^2$·25° C.·day)) was used.

Each sample was exposed by means of Fuji Medical Dry Laser Imager FM-DPL (equipped with 660 nm semiconductor laser generating power (IIIB) of 60 mW at the maximum) and heat-developed (with 4 built-in panel heaters set at 112° C., 119° C., 121° C. and 121° C., respectively, under conditions that the total heat-development time was adjusted to 14 seconds. Evaluations of the images thus produced were made by measurements with a densitometer.

Each of Sample Nos. 201 to 206 produced images of good contrast.

(Determination of L*a*b*)

The transmission object color of the highlight area of images produced in each sample was measured by use of the method described in JIS Z 8722:2000. In the case of using a light source D50 for colorimetry, the color coordinates in the L*a*b* color system were determined in accordance with the method described in JIS Z 8729:1994.

The results obtained are shown in Table 3.

TABLE 3

| Sample No. | L* | a* | b* | Note |
|---|---|---|---|---|
| 201 | 88.3 | −7.4 | −10.6 | Invention |
| 202 | 89.2 | −7.8 | −9.9 | Invention |
| 203 | 88.4 | −7.5 | −10.3 | Invention |
| 204 | 88.2 | −7.6 | −10.2 | Invention |
| 205 | 88.0 | −7.3 | −10.6 | Invention |
| 206 | 89.0 | −7.1 | −10.0 | Invention |
| 207 | 82.3 | −10.0 | −15.2 | Comparison |
| 208 | 84.3 | −8.4 | −13.6 | Comparison |

(Evaluations of Preservability: Image Quality and Handleability)

Ten sheets of each unprocessed sample were stacked so that the emulsion layer surface of one sheet was brought into contact with the backing surface of another sheet, and thereon a weight of 200 g was set. These sheets were sealed up in a package and stored for 10 days in the 50° C. and 60% environment. Thereafter, the sealed package was opened and the sheets were peeled away one by one, and then processed in the same manner as described in the foregoing section of "Evaluation of Photographic Properties". Visual evaluation of the images produced was made by the following criterion.

Excellent: Images produced in each sample after the storage in the sealed state are equivalent in quality to those produced before the storage, so the storage presents no problem.

Good: Images produced in each sample after the storage in the sealed state are somewhat inferior in quality to those produced before the storage, but the storage presents practically no problem.

Bad: Images produced in each sample after the storage in the sealed state are considerably inferior in quality to those produced before the storage, so the stored sample has no practical use.

Next, the images produced in each sample after the storage were sealed again in a package and allowed to stand for 3 days in the 50° C. and 60% environment under a condition that 10 sheets of each sample were stacked so as to bring the emulsion layer surface of one sheet into contact with the backing surface of another sheet. Then, a work of peeling off the 10 stacked sheets of each sample one by one was conducted and handleability of each sample (whether or not the sample partly caused adhesion) was evaluated relatively according to the following criterion with the reference to Sample No. 102.

Excellent: The sample tested has equal handleability to the reference sample, so the storage presents no problem.

Good: The sample tested is inferior in handleability to thee reference sample, but the storage presents practically no problem.

Bad: The sample tested is considerably inferior in handleability to the reference sample, so it cannot be put to practical use.

The results obtained are shown in Table 4.

TABLE 4

| Sample No. | Image Quality after Storage | Handeability after Storgage | Note |
|---|---|---|---|
| 201 | Excellent | Excellent (standard) | Invention |
| 202 | Excellent | Excellent | Invention |
| 203 | Excellent | Excellent | Invention |
| 204 | Excellent | Excellent | Invention |
| 205 | Excellent | Excellent | Invention |
| 206 | Excellent | Excellent | Invention |
| 207 | Bad | Good | Comparison |
| 208 | Good | Bad | Comparison |

As can be seen from the above results, the heat-developable photosensitive material Samples Nos. 201 to 206 according to the invention were all superior in tone of highlight areas of the images produced therein and image quality and handleability after storage.

EXAMPLE 3

Heat-developable photosensitive materials, Sample Nos. 301 to 308, were prepared respectively in the same manners as heat developable photosensitive materials, Sample Nos. 201 to 208, prepared in Example 2, except that their respective emulsion layers were free of the pigment (C.I. Pigment Blue 60) contained in the emulsion layers of Sample Nos. 201 to 208.

The samples thus obtained were each exposed and heat-developed in the same manners as in Example 2, thereby producing images. L*, a* and b* values of the transmission object color in the highlight area of images produced in each sample were determined as in Example 2. The results obtained are shown in Table 5.

TABLE 5

| Sample No. | L* | a* | b* | Note |
|---|---|---|---|---|
| 301 | 95.6 | −2.8 | −3.1 | Invention |
| 302 | 95.6 | −2.9 | −3.0 | Invention |
| 303 | 95.6 | −3.0 | −2.9 | Invention |
| 304 | 95.6 | −2.7 | −3.1 | Invention |
| 305 | 95.6 | −2.9 | −3.2 | Invention |
| 306 | 95.6 | −2.5 | −3.6 | Invention |
| 307 | 88.0 | −6.2 | −4.0 | Comparison |
| 308 | 85.3 | −7.6 | −10.0 | Comparison |

The Samples obtained were evaluated by the same methods as adopted for Samples Nos. 201 to 208 in Example 2. As a result, it was found that each of the present heat-developable photosensitive materials, Sample Nos. 301 to 306, were superior in tone of the highlight area of the images and image quality and handleability after storage.

The results obtained are shown in Table 6.

TABLE 6

| Sample No. | Image Quality after Storage | Handleability after Storage | Note |
|---|---|---|---|
| 301 | Excellent | Excellent | Invention |
| 302 | Excellent | Excellent | Invention |
| 303 | Excellent | Excellent | Invention |
| 304 | Excellent | Excellent | Invention |
| 305 | Excellent | Excellent | Invention |
| 306 | Excellent | Excellent | Invention |

TABLE 6-continued

| Sample No. | Image Quality after Storage | Handleability after Storage | Note |
|---|---|---|---|
| 307 | Bad | Good | Comparison |
| 308 | Good | Bad | Comparison |

EXAMPLE 4

Heat-developable photosensitive materials, Sample Nos. 401 and 402, were prepared respectively using the same backing-provided supports A1 and A7 as produced in Example 1, except that the undercoat on the light-sensitive layer side was not provided for each of the supports, and forming the coatings on the emulsion layer side in the same manner as the photothermographic material (Sample #1) disclosed in JP-A-7-13294, page 7, except that the dye, C.I. Basic Blue 742595, was removed from the coating composition for the emulsion layer.

(Evaluation of Photographic Properties)

The heat-developable photosensitive materials thus prepared were each exposed with an exposure apparatus equipped with 10 mW He—Ne laser, and thermally processed at 127° C. for 17 seconds. As a result, the samples each produced clear images as clinical photograph. More specifically, each of the present heat-developable photosensitive materials, Sample Nos. 401 and 402, was superior in tone of highlight areas of the images and image quality and handleability after storage.

The results obtained are shown in Table 7.

TABLE 7

| Sample No. | Image Quality after Storage | Handleability after Storage | Note |
|---|---|---|---|
| 401 | Excellent | Excellent | Invention |
| 402 | Excellent | Excellent | Invention |

The invention can provide heat-developable photosensitive materials which can produce images having excellent tone in the highlight areas, and have low absorbance in the high luminosity region without undergoing substantial decoloration treatment, practically no problem about tone in the low-density areas of images and excellent storage stability.

The entire disclosure of each and every foreign patent application from which the benefit of foreign priority has been claimed in the present application is incorporated herein by reference, as if fully set forth herein.

While the invention has been described in detail and with reference to specific embodiments thereof, it will be apparent to one skilled in the art that various changes and modifications can be made therein without departing from the spirit and scope thereof.

What is claimed is:

1. A heat-developable photosensitive material having on a support at least one light-sensitive layer comprising an organic silver salt, a light-sensitive silver halide and a reducing agent and at least one light-insensitive layer, which comprises an antihalation dye represented by formula (I) or formula (II):

(I)

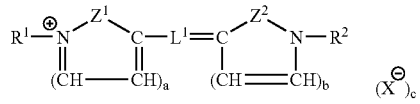

(II)

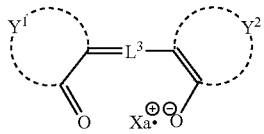

wherein in formula (I), $Z^1$ and $Z^2$ each independently represents a nonmetallic atomic group for forming a 5- or 6-membered nitrogen-containing heterocyclic rings $R^1$ and $R^2$ each independently represents an alkyl group, an alkenyl group, and aralkyl group or an aryl group, $L^1$ represents a methine chain having 3 or 5 methine groups, a, b, and c each independently represents 0 or 1, provided that c is 0 when the antihalation dye of formula (I) has an anionic substituent such as a sulfo or carboxyl group and forms an inner salt, and X represents an anion, wherein in formula (II), $Y^1$ and $Y^2$ each independently represents nonmetallic atoms forming an aliphatic or heterocyclic ring, $L^3$ represents a methine chain having 3 or 5 methine groups, and Xa represents a proton or a cation, and wherein the antihalation dye causing no decoloration by heat is a dye aggregate and the antihalation dye has a maximum absorption wavelength of transmission absorption spectra between 600 nm and 750 nm, has an absorbance peak whose half width is 100 nm or below in its transmission absorption spectrum, and provides a tone represented by inequalities $92<L^*\geqq 85$ $324\geqq(a^*)^2+(b^*)^2 16$, $0\geqq a^*$ and $0\geqq b^*$ on the CIELAB space in a background after heat development, as determined using a standard light source D50 for colorimetry.

2. A heat-developable photosensitive material having on a support at least one light-sensitive layer comprising an organic silver salt, a light-sensitive silver halide and a reducing agent and at least one light-insensitive layer, which comprises an antihalation dye represented by formula (I) or formula (II):

(I)

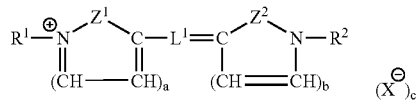

(II)

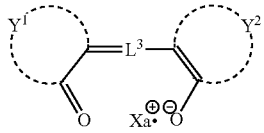

wherein in formula (I), $Z^1$ and $Z^2$ each independently represents a nonmetallic atomic group for forming a 5- or 6-membered nitrogen-containing heterocyclic ring, $R^1$ and $R^2$ each independently represents an alkyl group, an alkenyl group, and aralkyl group or an aryl group, $L^1$ represents a methine chain having 3 or 5 methine groups, a, b, and c each independently represents 0 or 1, provided that c is 0 when the antihalation dye of formula (I) has an anionic substituent such as a sulfo or carboxyl group and forms an inner salt, and X represents an anion, wherein in formula (II), $Y^1$ and $Y^2$ each independently represents nonmetallic atoms forming an aliphatic or heterocyclic ring, $L^3$ represents a methine chain having 3 or 5 methine groups, and Xa represents a proton or a cation, wherein the antihalation dye causing no decoloration by heat is a dye aggregate, the dye aggregate being an aqueous fine-grain dispersion containing a hydrophilic colloid, and wherein the antihalation dye has a maximum absorption wavelength of transmission absorption spectra between 600 nm and 750 nm, has an absorbance peak whose half width is 100 nm or below in its transmission absorption spectrum, and provides a tone represented by inequalities $92>L^*\geqq 85$, $324\geqq(a^*)^2+(b^*)^2\geqq 16$, $0\geqq a^*$ and $0\geqq b^*$ on the CIELAB space in a background after heat development, as determined using a standard light source D50 for colorimetry.

3. A heat-developable photosensitive material having on a support at least one light-sensitive layer comprising an organic silver salt, a light-sensitive silver halide and a reducing agent and at least one light-insensitive layer, which comprises an antihalation dye represented by formula (I):

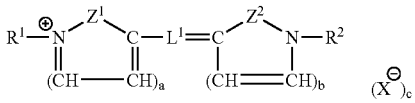

(I)

wherein $Z^1$ and $Z^2$ each independently represents a nonmetallic atomic group for forming a 5- or 6-membered nitrogen-containing heterocyclic ring, $R^1$ and $R^2$ each independently represents an alkyl group, an alkenyl group, and aralkyl group or an aryl group, $L^1$ represents a methine chain having 3 or 5 methine groups, a, b, and c each independently represents 0 or 1, provided that c is 0 when the antihalation dye of formula (I) has an anionic substituent such as a sulfo or carboxyl group and forms an inner salt, and X represents an anion, and wherein the antihalation dye causes no decoloration by heat, has a maximum absorption wavelength of transmission absorption spectra between 600 nm and 750 nm, has an absorbance peak whose half width is 100 nm or below in its transmission absorption spectrum, and provides a tone represented by inequalities $92>L^*\geqq 85$, $324\geqq(a^*)^2+(b^*)^2\geqq 16$, $0\geqq a^*$ and $0\geqq b^*$ on the CIELAB space in a background after heat development, as determined using a standard light source D50 for colorimetry.

4. The heat-developable photosensitive material as claimed in claim 3, wherein the antihalation dye causing no decoloration by heat is a dye aggregate.

5. The heat-developable photosensitive material as claimed in claim 4, wherein the dye aggregate is an aqueous fine-grain dispersion containing a hydrophilic colloid.

* * * * *